US009182698B2

(12) United States Patent
Ichikawa et al.

(10) Patent No.: US 9,182,698 B2
(45) Date of Patent: Nov. 10, 2015

(54) METHOD OF TRANSFERRING IMAGE AND IMAGE TRANSFERRING SYSTEM AND IMAGE FORMING APPARATUS WITH SAME

(71) Applicants: Junichi Ichikawa, Kanagawa (JP); Kenji Sengoku, Kanagawa (JP); Shinya Tanaka, Kanagawa (JP); Junpei Fujita, Kanagawa (JP); Kunio Hasegawa, Kanagawa (JP)

(72) Inventors: Junichi Ichikawa, Kanagawa (JP); Kenji Sengoku, Kanagawa (JP); Shinya Tanaka, Kanagawa (JP); Junpei Fujita, Kanagawa (JP); Kunio Hasegawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/163,042

(22) Filed: Jan. 24, 2014

(65) Prior Publication Data

US 2014/0219691 A1 Aug. 7, 2014

(30) Foreign Application Priority Data

| | | |
|---|---|---|
| Feb. 1, 2013 | (JP) | 2013-018919 |
| Feb. 1, 2013 | (JP) | 2013-018920 |
| Dec. 5, 2013 | (JP) | 2013-251827 |
| Dec. 5, 2013 | (JP) | 2013-251831 |

(51) Int. Cl.

| | |
|---|---|
| ***G03G 15/16*** | (2006.01) |
| ***G03G 21/00*** | (2006.01) |
| ***G03G 13/14*** | (2006.01) |

(52) U.S. Cl.

CPC ..... *G03G 13/14* (2013.01); *G03G 15/1605* (2013.01); *G03G 21/0005* (2013.01); *G03G 21/0041* (2013.01)

(58) Field of Classification Search

CPC ..... G03G 13/14; G03G 21/0058
USPC ..... 399/313, 343
See application file for complete search history.

(56) References Cited

U.S. PATENT DOCUMENTS

| | | | | |
|---|---|---|---|---|
| 3,942,888 | A * | 3/1976 | Maksymiak et al. | 399/313 |
| 6,188,862 | B1 * | 2/2001 | Ishii | 399/313 |
| 2002/0009316 | A1 * | 1/2002 | Endo et al. | 399/349 |
| 2004/0141776 | A1 | 7/2004 | Sohmiya et al. | |
| 2009/0311003 | A1 * | 12/2009 | Shouno et al. | 399/101 |
| 2010/0054826 | A1 * | 3/2010 | Hieda | 399/313 |
| 2011/0229187 | A1 * | 9/2011 | Hozumi et al. | 399/101 |

FOREIGN PATENT DOCUMENTS

| | | |
|---|---|---|
| JP | 6-075510 | 3/1994 |
| JP | 2004-206054 | 7/2004 |
| JP | 2007-293032 | 11/2007 |
| JP | 2009-003035 | 1/2009 |
| JP | 2009-192805 | 8/2009 |

OTHER PUBLICATIONS

Machine translation of JP 06075510 A.*

* cited by examiner

*Primary Examiner* — David Bolduc
(74) *Attorney, Agent, or Firm* — Oblon, McClelland, Maier & Neustadt, L.L.P.

(57) ABSTRACT

A method of transferring an image includes the steps of; bringing an image bearer bearing an image thereon as a transfer origin in contact with a transferring objective (onto which the image is transferred) as a transfer destination; moving at least one of the image bearer and the transferring objective in a prescribed direction; and sequentially transferring the image borne on the image bearer onto the transferring objective in a contacting section in which the image bearer and the transferring objective contact each other in a direction in which the image does not pass through the contacting section.

12 Claims, 47 Drawing Sheets

METHOD OF TRANSFERRING IMAGE AND IMAGE TRANSFERRING SYSTEM AND IMAGE FORMING APPARATUS WITH SAME

CROSS-REFERENCE TO RELATED APPLICATION

This patent application is based on and claims priority pursuant to 35 U.S.C. §119 to Japanese Patent Application Nos. 2013-18920, filed on February 1, 2013-18919, filed on February 1, 2013-251827, filed on December 5, and 2013-251831, filed on December 5, all 2013 in the Japan Patent Office, the entire disclosures of which are hereby incorporated by reference herein.

BACKGROUND

1. Technical Field

This invention relates to a novel image transferring method, an image transferring system implementing the image transferring method, and an image forming apparatus with same.

2. Related Art

A conventional image transferring system transfers an image formed and rendered visible by developer from a transfer origin that bears the image onto a transfer destination using an electric transfer field. Another conventional transferring system transfers an image formed and rendered visible by ink drops from the transfer origin that bears the image onto the transfer destination. There is also a known system that transfers an image in a transfer station using either a pair of rollers or a roller and a belt.

To transfer an image using the electric transfer field in a conventional image transferring system, a prescribed member and a power supply for generating the electric transfer field are needed, thereby becoming a bottleneck to cost reduction.

Further, performance of the electric transfer field varies in accordance with an environmental condition, such as temperature, humidity, etc. A transfer condition also varies in accordance with temperature and humidity or the like as well. Thus, these member and power supply need to be made of prescribed material and avoid the impact of the environmental condition.

Further, with a system in which an image is formed by ink drops and is transferred on a transfer destination by pressing the image against the transfer destination, a transfer rate tends to decrease.

Further, when the image is transferred in a transfer section of a conventional system, an image generally passes through the transfer section and likely disturbs a transferred image.

SUMMARY

Accordingly, one aspect of the present invention provides a novel method of transferring an image comprising the steps of; bringing an image bearer bearing an image thereon as a transfer origin in contact with a transferring objective, onto which the image is transferred, as a transfer destination; moving at least one of the image bearer and the transferring objective in a prescribed direction; and sequentially transferring the image borne on the image bearer onto the transferring objective in a contacting section in which the image bearer and the transferring objective contact each other in a direction in which the image does not pass through the contacting section.

Another aspect of the present invention provides a novel image transferring system that comprises: an image bearer to bear an image thereon as a transfer origin; and a transferring objective in contact with the image bearer as a transfer destination. The image on the image bearer is transferred onto the transferring objective by implementing the above-described method.

Yet another aspect of the present invention provides a novel image forming apparatus that comprises: an image forming device to form an image on an image bearer as a transfer origin; and the above-described image transferring system.

Yet another aspect of the present invention provides a novel image forming apparatus that comprises: an image bearer to bear an image thereon; a transferring objective having a surface contacting a surface of the image bearer in a contacting section therebetween; and a power source to drive one of the image bearer and the transferring objective and render the surface of the image bearer to sequentially enter the contacting section from a first side, and render the surface of the transferring objective to sequentially exit from the contacting section toward the first side.

Yet another aspect of the present invention provides a novel image forming apparatus that comprises: a first image bearer to bear a toner image thereon; a second image bearer contacting the first image bearer in a contacting section; a first motor to rotate the first image bearer in a first rotational direction; and a second motor to rotate the second image bearer in the first rotational direction.

Yet another aspect of the present invention provides a novel image forming apparatus that comprises: an image bearer to bear a toner image thereon; a sheet conveying roller to convey the recording sheet by bringing it in contact with the image bearer in a contacting section; a first motor to drive and move the image bearer in a first direction in the contacting section; and a second motor to drive the conveying roller to convey the recording sheet in a second direction opposite the first direction in the contacting section Yet another aspect of the present invention provides a novel cleaning system that comprises: a cleaning member having a surface brought in contact with a movable surface of an image bearer to clean the image bearer by collecting adhering substances adhering and remaining on the movable surface of the image bearer, the cleaning member including an edge or a small diameter portion in a contacting section contacting the surface of the image bearer; and a moving system to move a surface of the cleaning member in a direction in which the adhering substances on the surface of the image bearer do not pass through the contacting section.

Yet another aspect of the present invention provides a novel image forming apparatus that comprising: an image bearer to bear a toner image on its surface; a cleaning member having an edge portion or a small diameter section, the cleaning member contacting the image bearer at the edge portion or the small diameter section; and a driving source to move the surface of the image bearer in the first direction in a contacting section contacting the edge portion or the small diameter section of the cleaning member, and move the surface of the cleaning member in a second direction opposite the first direction in the edge portion or the small diameter section thereof.

BRIEF DESCRIPTION OF THE DRAWINGS

A more complete appreciation of the present invention and many of the attendant advantages thereof will be more readily obtained as substantially the same becomes better understood by reference to the following detailed description when considered in connection with the accompanying drawings, wherein.

DETAILED DESCRIPTION

Figure 1:
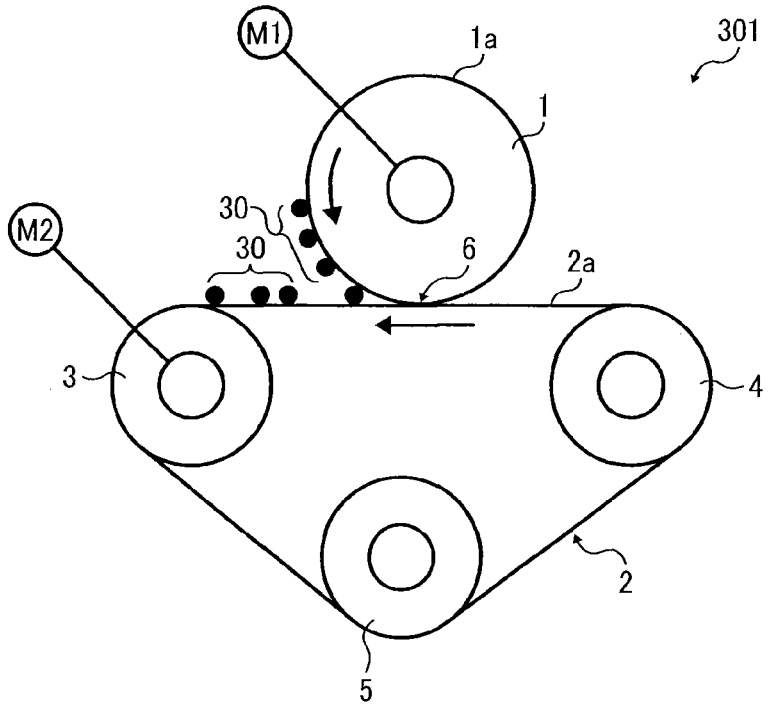
FIG. 1 illustrates an exemplary image transferring system according to a first embodiment of the present invention.

Referring now to the drawings, wherein like reference numerals designate identical or corresponding parts throughout the several views thereof and in particular to FIGS. 1 to 14, various embodiments employing different image transferring systems which execute image transfer processes in various directions are described, and the image transferring systems and image transfer directions are described first and the image forming apparatuses employing these various image transferring systems are described next.

Initially, a first embodiment of the present invention is described with reference to FIG. 1. As shown in FIG. 1, an image transferring unit 301 includes a roller type image bearer 1 that bears an image 30 on its surface (hereinafter, simply referred to as a surface of the image bearer) 1*a* as a transfer origin (i.e., a source of a transferred image), and a transferring objective 2 that receives the image 30 transferred from the image bearer 1 on its surface (hereinafter, simply referred to as a surface of the transfer objective) 2*a* as a transfer destination. Here, the surface 1*a* of the image bearer 1 and the surface of the transferring objective 2*a* contact each other and collectively form a contacting section 6 therebetween. Accordingly, when the image transferring unit 301 according to this embodiment is applied to an image forming apparatus that employs an electronic photography, the image bearer 1 corresponds to a photoconductor, and the transferring objective 2 corresponds to an intermediate transfer belt 2.

The image bearer 1 is driven and rotated counterclockwise in the drawing by a driving motor M1 acting as a driving source. The transferring objective 2 is wound around multiple rollers 3, 4, and 5 serving as rotary members and is thereby given a prescribed tension. Among these multiple rollers, the roller 3 is driven counterclockwise in the drawing by the driving motor M2, and the other rollers 4, 5 are driven and rotated as the rollers 3 is driven and is rotated. For this reason, the transferring objective 2 rotates and moves counter-clockwise. In this embodiment, an image 30 on the image bearer 1 is sequentially transferred onto the transferring objective 2 in a contacting section 6, in which the surface 1*a* of the image bearer 1 and the surface 2*a* of the transferring objective contact each other, in a direction in which the image 30 does not pass downstream through the contacting section 6. That is, relative moving directions of the image bearer surface 1A and the transferring objective surface 2*a* are rendered to be opposite to each other in the contacting section 6. For example, in this embodiment, rotational directions of the image bearer 1 and the transferring objective 2 driven by multiple driving motors M1 and M2, respectively, are the same to each other. Specifically, in the contacting section 6, the surface 1*a* of the image bearer 1 and that of the transferring objective surface 2*a* are driven and rotated by these multiple motors M1 and M2, respectively, so that moving directions of the surface 1*a* of the image bearer 1 and that of the transferring objective surface 2*a* become opposite to each other. Thus, as shown in FIG. 1, in the contacting section 6, the surface 1*a* of the image bearer 1 moves from left to right. By contrast, the surface 2*a* of the transfer objective moves from right to left there at the same time.

Here, the applicants prepared and tested a model with such a configuration by forming a toner image 30 on the image bearer 1 while regarding the intermediate transfer belt as the transferring objective 2. As a result, the applicants have confirmed that the image does not pass downstream though the contacting section 6 of (contacting) the transferring objective 2 in a rotating direction of the image bearer 1, and that the image is sequentially transferred on to the transferring objective 2 in a moving direction in which the image does not pass through the contacting section 6 in the downstream rotational direction of the image bearer 1 (i.e., in a direction, in which the transferring objective 2 movies). Because of this, the image 30 on the image bearer 1 can be transferred onto the transferring objective 2 while omitting a transfer electric field in the contacting section 6, which is typically generated by applying a transfer bias to the transferring objective 2 as in a conventional system. Further, since the electric transfer field is not used, neither an electric transfer field nor a transfer condition varies even if an environmental condition, such as temperature, humidity, etc., changes. Thus, when the image 30 is transferred from the image bearer 1 onto the transferring objective 2, such a process is rarely affected by either the electric transfer field or the environmental condition. Accordingly, excellent image transfer performance can be obtained. Further, since a transfer electric filed is not needed, and accordingly, a power source can be omitted as well, space saving and cost reduction can be readily accomplished.

Figure 2:
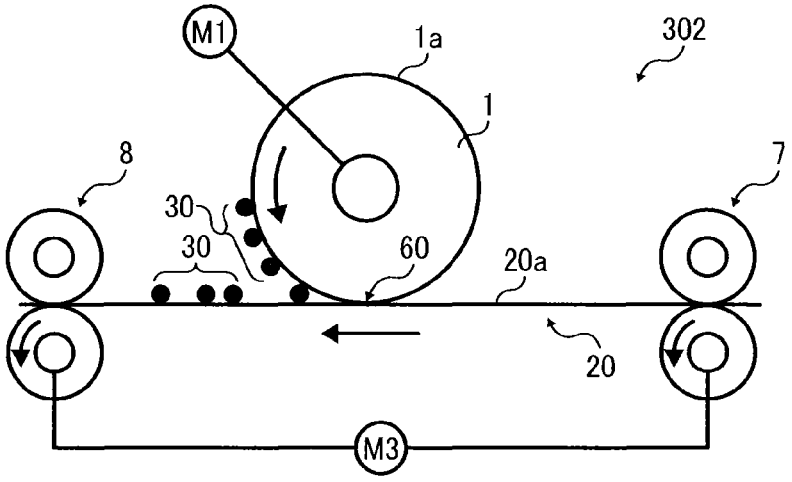
FIG. 2 illustrates an exemplary image transferring system according to a second embodiment of the present invention.

Now, a second embodiment of the present invention is described with reference to FIG. 2. As shown in FIG. 2, an image transferring unit 302 includes an image bearer 1 that bears an image 30 on its surface (hereinafter, simply referred to as a surface of the image bearer) 1*a* as a transfer origin, and a transferring objective 20 that receives a transferred image 30 on its surface (hereinafter, simply referred to as a transfer objective surface) 20*a* as a transfer destination. Here, the surface 1*a* of the image bearer 1 and the surface 20*a* of the transferring objective 20 contact each other and collectively form a contacting section 60 therebetween. Accordingly, when the image transferring unit 302 according to this embodiment is applied to an image forming apparatus that employs an electronic photography and the image bearer 1 corresponds to a photoconductor, the transferring objective 20 corresponds to a recording sheet. Otherwise, when an intermediate transferring system is employed and the image bearer 1 corresponds to a photoconductor, the transferring objective 20 corresponds to an intermediate transfer belt. Yet otherwise, when the intermediate transferring system is employed and the image bearer 1 corresponds to the intermediate transfer belt, the transferring objective 20 corresponds to the recording sheet. The transferring objective 20 is conveyed and moved by a pair of conveyor rollers 7 and 8 driven by a driving motor M3 in an opposite direction to that in which the surface 1*a* of the image bearer 1 moves in a contacting section 60 in which the surface 1*a* of the image bearer 1 and the surface 2*a* of the transferring objective contact each other. Specifically, in this embodiment, an image 30 on the image bearer 1 is sequentially transferred onto the transferring objective 20 in a contacting section 60, in which the surface 1*a* of the image bearer 1 and the surface 20*a* of the transferring objective 20 contact each other, in a direction in which the image 30 does not pass downstream through the contacting section 60.

Again, the applicants prepared and tested a model with such a configuration by forming a toner image 30 on the image bearer 1 while regarding the intermediate transfer belt as the transferring objective 20. As a result, the applicants have confirmed that the image does not pass downstream though the contacting section 60 of the transferring objective 20 in a rotating direction of the image bearer 1, and that the image is sequentially transferred on to the transferring objective 20 in a moving direction in which the image does not pass through the contacting section 60 in the downstream rotational direction of the image bearer 1. Because of this, the image 30 on the image bearer 1 can be transferred onto the transferring objective 20 without a conventionally formed transfer electric field in the contacting section 60. As a result, neither the electric transfer field nor a transfer condition varies even if an environmental condition, such as temperature, humidity, etc., changes. Thus, when the image 30 is transferred from the image bearer 1 onto the transferring objective 20, such a process is rarely affected by either the electric transfer field or the environmental condition. Accordingly, excellent image transfer performance can be obtained. Further, since a transfer electric filed is not needed, and accordingly, a power source can be omitted as well, space saving and cost reduction can be readily accomplished.

Figure 3:
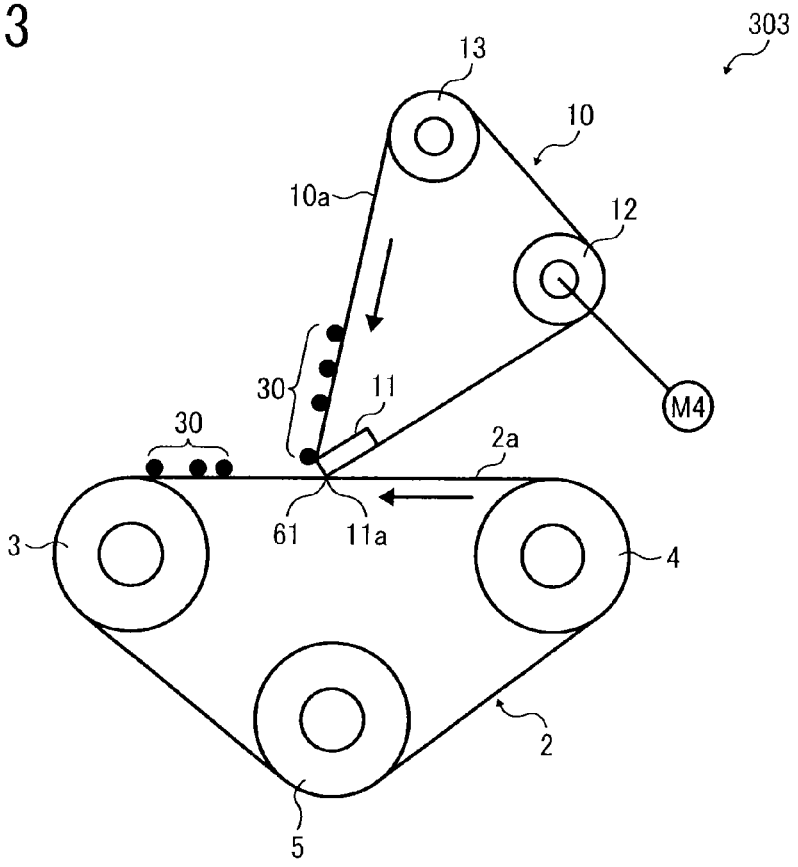
FIG. 3 illustrates an exemplary image transferring system according to a third embodiment of the present invention.

Now, a third embodiment of the present invention is described with reference to FIG. 3. As shown in FIG. 3, an image transferring unit 303 includes a belt shaped image bearer 10 that bears an image 30 on its surface 10*a* as a transfer origin, a transferring objective 2 that receives the image 30 transferred from the image bearer 1 on its surface 2*a* as a transfer destination, and a contacting member 11 that engages with the transferring objective 2 through the image bearer 10. Here, the surface of the image bearer 10*a* and the transferring surface 2*a* contact each other and collectively form a contacting section 61 therebetween. Accordingly, when the image transferring unit 303 according to this embodiment is applied to an image forming apparatus that employs an electronic photography and the image bearer 1 corresponds to a photoconductor, the transferring objective 20 corresponds to an intermediate transfer belt 2. The image bearer 10 is stretched and wound around several rotating rollers 12 and 13 and the contacting member 11. Among these multiple rollers, the roller 12 is driven by a driving motor M4 counterclockwise in the drawing, and the roller 13 is driven and rotated as the driving roller 12 is driven and rotated. For this reason, the image bearer 10 rotates and moves counterclockwise. The contacting member 11 is composed of a plate like member, and engages with the transferring objective 2 at its tip section 11*a* through the image bearer 10 in the contacting section 61. In this embodiment, an image 30 on the image bearer 10 is sequentially transferred onto the transferring objective 2 in a contacting section 61, in which the surface 10*a* of the image bearer 10 and the surface 2*a* of the transferring objective contact each other, in a direction in which the image 30 does not pass downstream through the contacting section 61. That is, relative moving directions of the surface 10*a* of the image bearer 10 and the transferring objective surface 2*a* are rendered to be opposite to each other in the contacting section 61. For example, in this embodiment, rotational directions of the image bearer 10 and the transferring objective 2 driven by multiple driving motors M3 and M4, respectively, are oppositely set.

Again, the applicants prepared and tested a model with the above-described configuration by forming a toner image 30 on the image bearer 10 while regarding the intermediate transfer belt as the transferring objective 2. As a result, the applicants have confirmed that the image does not pass downstream though the contacting section 61 of the transferring objective 2 in a rotating direction of the image bearer 10, and that the image is sequentially transferred on to the transferring objective 2 in a moving direction in which the image does not pass through the contacting section 61 in the downstream rotational direction of the image bearer 10. Further, with the above-described configuration, a more preferable image transferring process can be executed than that in the first embodiment. Because of this, the image 30 on the image bearer 10 can be transferred onto the transferring objective 2 while omitting a transfer electric field in the contacting section 61, which is typically generated by applying a transfer bias to the transferring objective 2 as in a conventional system. Further, since the electric transfer field is not used, neither an electric transfer field nor a transfer condition varies even if an environmental condition, such as temperature, humidity, etc., changes. Thus, when the image 30 is transferred from the image bearer 10 onto the transferring objective 2, such a process is rarely affected by either the electric transfer field or the environmental condition. Accordingly, excellent image transfer performance can be obtained. Further, in this embodiment, it is considered that since the contacting member 11 is additionally provided to the configuration of the first embodiment and accordingly the image 30 is stripped off and is preferably transferred from the image bearer 10 onto the transferring objective 2 when the image bearer 10 rotates and reaches the contacting section 61 while passing through the contacting member 11. Further, since a transfer electric filed is not needed, and accordingly, a power source can be omitted as well, space saving and cost reduction can be readily accomplished.

Figure 4:
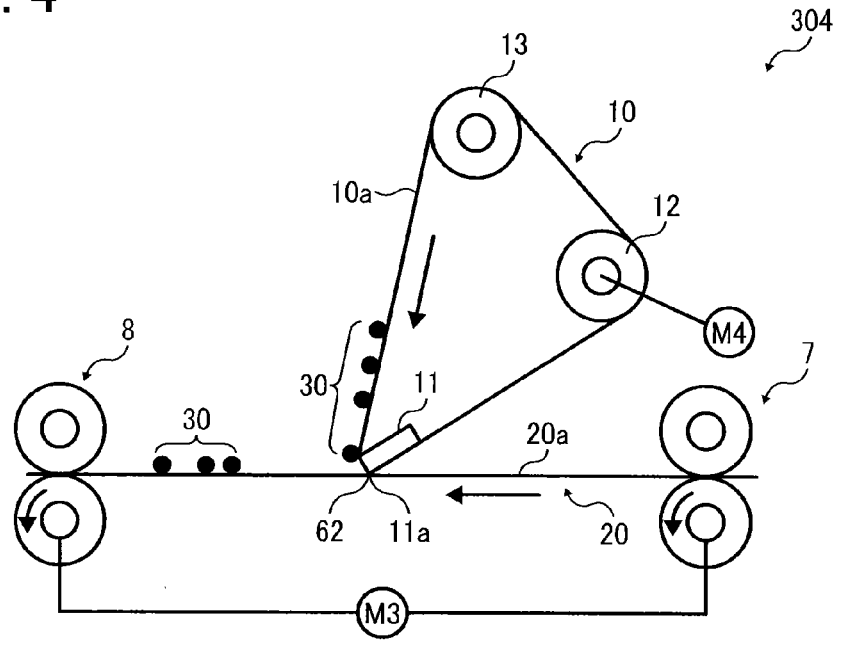
FIG. 4 illustrates an exemplary image transferring system according to a fourth embodiment of the present invention.

Now, a fourth embodiment of the present invention is described with reference to FIG. 4. As shown in FIG. 4, an image transferring unit 304 of this embodiment is prepared by using the image bearer 10 of the third embodiment in place of the image bearer 1 of the second embodiment. That is, in this embodiment, the surface 10*a* of the image bearer 10 and the surface 20*a* of the transferring objective 20 contact each other and collectively form a contacting section 62. Further, a tip section 11*a* of the contacting member 11 contacts the transferring objective 20 through the image bearer 10 in a contacting section 62. Further, in this embodiment, an image 30 on the image bearer 10 is sequentially transferred onto the transferring objective 20 in the contacting section 62, in which the surface 10*a* of the image bearer 10 and the surface 20*a* of the transferring objective 20 contact each other, in a direction in which the image 30 does not pass downstream through the contacting section 62. That is, relative moving directions of the surface 10*a* of the image bearer 10 and the transferring objective surface 20*a* are rendered to be opposite to each other in the contacting section 62. For example, in this embodiment, rotational directions of the image bearer 10 and a pair of conveyor rollers 7 and 8 driven by multiple driving motors M4 and M2, respectively, are oppositely set.

Again, the applicants prepared and tested a model with the above-described configuration by forming a toner image 30 on the image bearer 10 while regarding the intermediate transfer belt as the transferring objective 20. As a result, the applicants have confirmed that the image does not pass downstream though the contacting section 62 of the transferring objective 20 in a rotating direction of the image bearer 10, and that the image is sequentially transferred on to the transferring objective 20 in a moving direction in which the image does not pass through the contacting section 62 in the downstream rotational direction of the image bearer 10. Because of this, the image 30 on the image bearer 10 can be transferred onto the transferring objective 20 while omitting a transfer electric field in the contacting section 62 as provided in a conventional system. As a result, neither an electric transfer field nor a transfer condition varies even if an environmental condition, such as temperature, humidity, etc., changes. Thus, when the image 30 is transferred from the image bearer 10 onto the transferring objective 20, such a process is rarely affected by either the electric transfer field or the environmental condition. Accordingly, excellent image transfer performance can be obtained. Further, in this embodiment, it is considered that since the contacting member 11 is additionally provided beside the configuration of the second embodiment, the image 30 is stripped off and is preferably transferred from the image bearer 10 onto the transferring objective 20 when the image bearer 10 rotates and reaches the contacting section 62 while passing through the contacting member 11. Further, since a transfer electric filed is not needed, and accordingly, a power source can be omitted, space saving and cost reduction can be readily accomplished at the same time.

Figure 5:
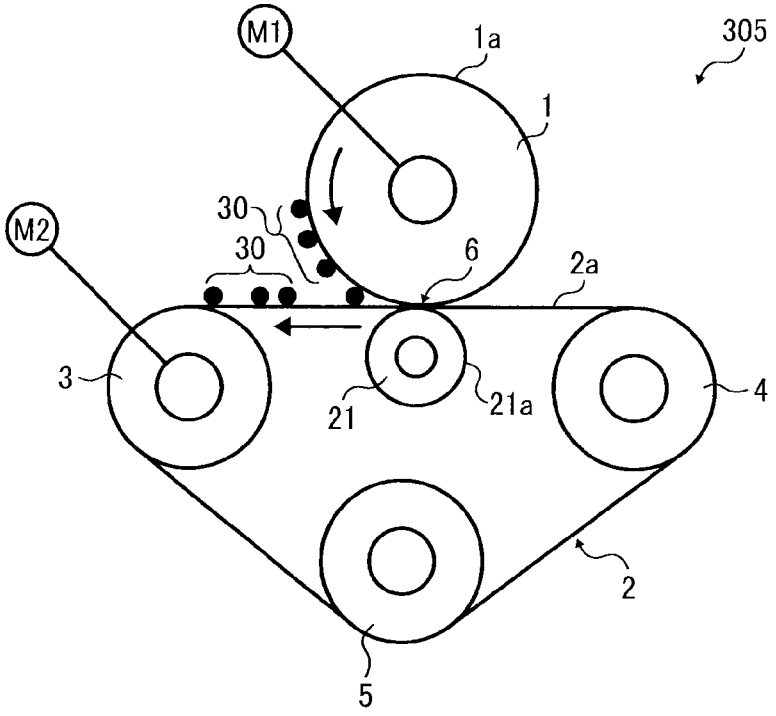
FIG. 5 illustrates an exemplary image transferring system according to a fifth embodiment of the present invention.

Now, a fifth embodiment of the present invention is described with reference to FIG. 5. As shown in FIG. 5, an image transferring unit 305 of this embodiment is prepared by adding a contacting member 21 that contacts the image bearer 1 via the transferring objective 2 beside the configuration of the first embodiment. Specifically, as shown in FIG. 5, an image transferring unit 305 includes an image bearer 1 that bears an image 30 on its surface 1*a* as a transfer origin, a transferring objective 2 that receives the image 30 transferred from the image bearer 1 on its surface 2*a* as a transfer destination, and a roller type contacting member 21 that engages with the image bearer 1 via the transferring objective 2. The contacting member 21 is freely rotatably supported with its outer surface 21*a* contacting the image bearer 1 via the transferring objective 2 in a contacting section 6. Further, in this embodiment, to render relative moving directions of the surface 1*a* of the image bearer 1 and the transferring objective surface 2*a* to be opposite to each other in the contacting section 6, rotational directions of the image bearer 1 and the transferring objective 2 driven by multiple driving motors M1 and M2, respectively, are oppositely set.

Again, the applicants prepared and tested a model with the above-described configuration by forming a toner image 30 on the image bearer 1 while regarding a recording sheet as the transferring objective 2. As a result, the applicants have confirmed that the image 30 does not pass downstream though the contacting section 6 in a rotating direction of the image bearer 1, and that the image 30 rather is sequentially transferred on to the transferring objective 2 in a moving direction of the transferring objective 2 in which the image 30 does not pass through the contacting section 6 in the downstream rotational direction of the image bearer 1. Because of this, since the image 30 on the image bearer 1 can be transferred onto the transferring objective 2 while omitting a transfer electric field in the contacting section 6, which is typically generated (by applying a transfer bias to the transferring objective 2 as) in a conventional system, neither an electric transfer field nor a transfer condition varies even if an environmental condition, such as temperature, humidity, etc., changes. Thus, when the image 30 is transferred from the image bearer 1 onto the transferring objective 2, since either the electric transfer field or the environmental condition rarely impacts such a process, excellent image transfer performance can be obtained. Further, in this embodiment, it is considered that since the contacting member 21 is additionally provided to the configuration of the second embodiment and accordingly the contacting section 6 is steadily formed, the image 30 is preferably transferred from the image bearer 10 onto the transferring objective 2. Further, since a transfer electric filed is not needed, and accordingly, a power source therefor can be omitted as well, space saving and cost reduction can be readily accomplished.

Figure 6:
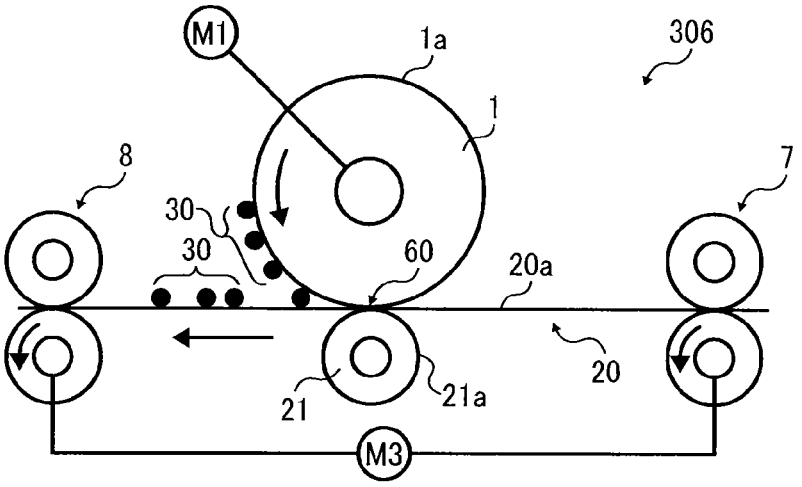
FIG. 6 illustrates an exemplary image transferring system according to a sixth embodiment of the present invention.

Now, a sixth embodiment of the present invention is described with reference to FIG. 6. As shown in FIG. 6, an image transferring unit 306 of this embodiment is prepared by adding a roller type-contacting member 21 that contacts the image bearer 1 via the transferring objective 20 to the configuration of the second embodiment. Specifically, as shown in FIG. 6, an image transferring unit 306 includes an image bearer 1 that bears an image 30 on its surface 1*a* as a transfer origin, a transferring objective 20 that receives the image 30 transferred from the image bearer 1 on its surface 20*a* as a transfer destination, and the roller type contacting member 21 that engages with the image bearer 1 via the transferring objective 20. The contacting member 21 is freely rotatably supported with its outer surface 21*a* contacting the image bearer 1 via the transferring objective 20 in a contacting section 60. Further, in this embodiment, to render relative moving directions of the surface 1*a* of the image bearer 1 and the surface 2*a* of the transferring objective to be opposite to each other in the contacting section 6, rotational directions of the image bearer 1 and the pair of conveying rollers 7 and 8 driven by multiple driving motors M1 and M3, respectively, are oppositely set.

Again, the applicants prepared and tested a model with the above-described configuration by forming a toner image 30 on the image bearer 1 while regarding a recording sheet as the transferring objective 20. As a result, the applicants have confirmed that the image 30 on the transferring objective 20 does not pass downstream though the contacting section 60 in a rotating direction of the image bearer 1, and that the image 30 is rather sequentially transferred on to the transferring objective 20 in a moving direction of the transferring objective 20 in which the image 30 does not pass through the contacting section 60 in the downstream rotational direction of the image bearer 1. Because of this, since the image 30 on the image bearer 1 can be transferred onto the transferring objective 20 while omitting a transfer electric field in the contacting section 60, which is typically generated (by applying a transfer bias to the transferring objective 20 as) in a conventional system, neither an electric transfer field nor a transfer condition varies even if an environmental condition, such as temperature, humidity, etc., changes. Thus, when the image 30 is transferred from the image bearer 1 onto the transferring objective 20, since either the electric transfer field or the environmental condition rarely impacts such a process, excellent image transfer performance can be obtained. Further, in this embodiment, it is considered that since the contacting member 21 is additionally provided to the configuration of the second embodiment, and accordingly, the contacting section 60 is steadily formed, the image 30 is preferably transferred from the image bearer 1 onto the transferring objective 20. Further, since a transfer electric filed is not needed, and accordingly, a power source therefor can be omitted as well, space saving and cost reduction can be readily accomplished.

Figure 7:
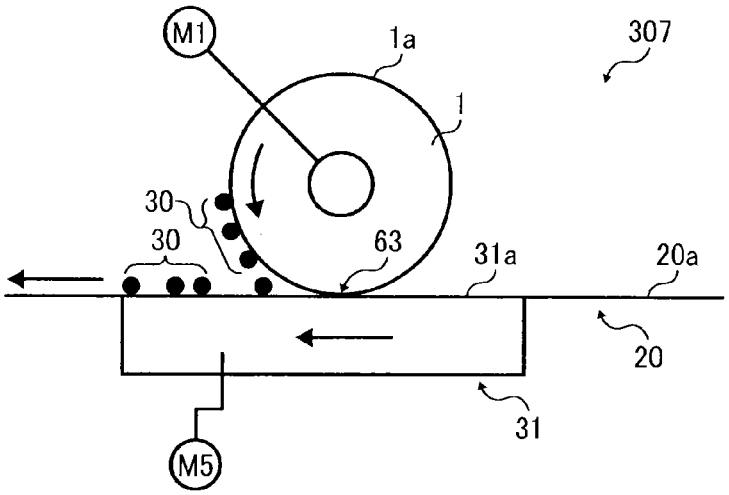
FIG. 7 illustrates an exemplary image transferring system according to a seventh embodiment of the present invention.

Now, a seventh embodiment of the present invention is described with reference to FIG. 7. As shown in FIG. 7, an image transferring unit 307 of this embodiment is prepared by adding a movable contacting member 31 in place of the pair of conveying rollers 7 and 8 provided in the second embodiment. Specifically, in this embodiment, as shown in FIG. 7, an image transferring unit 307 includes an image bearer 1 that bears an image 30 on its surface 1*a*, a transferring objective 20 that receives the image 30 transferred from the image bearer 1 on its surface 20*a*, and a plate like contacting member 31 that engages with the image bearer 1 via the transferring objective 20. The plate like contacting member 31 acts as a slider with its flat surface 31*a* (hereinafter referred to as a transferring objective surface 31*a*) contacting the surface 1*a* of the image bearer 1 through the transferring objective 20 in the bordered section 63. The contacting member 31 is horizontally movably supported in the contacting section 63 in parallel to a rotational axis of the image bearer 1. Thus, the contacting member 31 moves in parallel to the contacting section 63 therein when driven by a driving motor 5. In this embodiment, moving directions of the image bearer 1 and the contacting member 31 driven by multiple driving motors M1 and M5, respectively, in the contacting section 63 are opposite each other. Further, the contacting member 31 includes a function to hold the transferring objective 20, and can move the transferring objective 20 in the same direction by moving itself. Further, in this embodiment, to render relative moving directions of the surface 1*a* of the image bearer 1 and the transferring objective surf 20*a* to be opposite to each other in the contacting section 63, moving directions of the image bearer 1 and the contacting member 31 driven by multiple driving motors M1 and M5, respectively, are opposite each other.

Again, the applicants prepared and tested a model with the above-described configuration by forming a toner image 30 on the image bearer 1 while regarding a recording sheet as the transferring objective 20. As a result, the applicants have confirmed that the image 30 on the transferring objective 20 does not pass downstream though the contacting section 63 in a rotating direction of the image bearer 1, and that the image 30 rather is sequentially transferred on to the transferring objective 20 in a moving direction of the transferring objective 20 in which the image 30 does not pass through the contacting section 63 in the downstream rotational direction of the image bearer 1. Because of this, since the image 30 on the image bearer 1 can be transferred onto the transferring objective 20 while omitting a transfer electric field in the contacting section 63, which is typically generated (by applying a transfer bias to the transferring objective 20 as) in a conventional system, neither an electric transfer field nor a transfer condition varies even if an environmental condition, such as temperature, humidity, etc., changes. Thus, when the image 30 is transferred from the image bearer 1 onto the transferring objective 20, since either the electric transfer field or the environmental condition rarely impacts such a process, excellent image transfer performance can be obtained. Further, in this embodiment, it is considered that since the contacting member 31 is additionally provided to the configuration of the second embodiment, and accordingly, the contacting section 63 is steadily formed, the image 30 is preferably transferred from the image bearer 1 onto the transferring objective 20. Further, since a transfer electric filed is not needed, and accordingly, a power source can be omitted as well, space saving and cost reduction can be readily accomplished.

Figure 8:
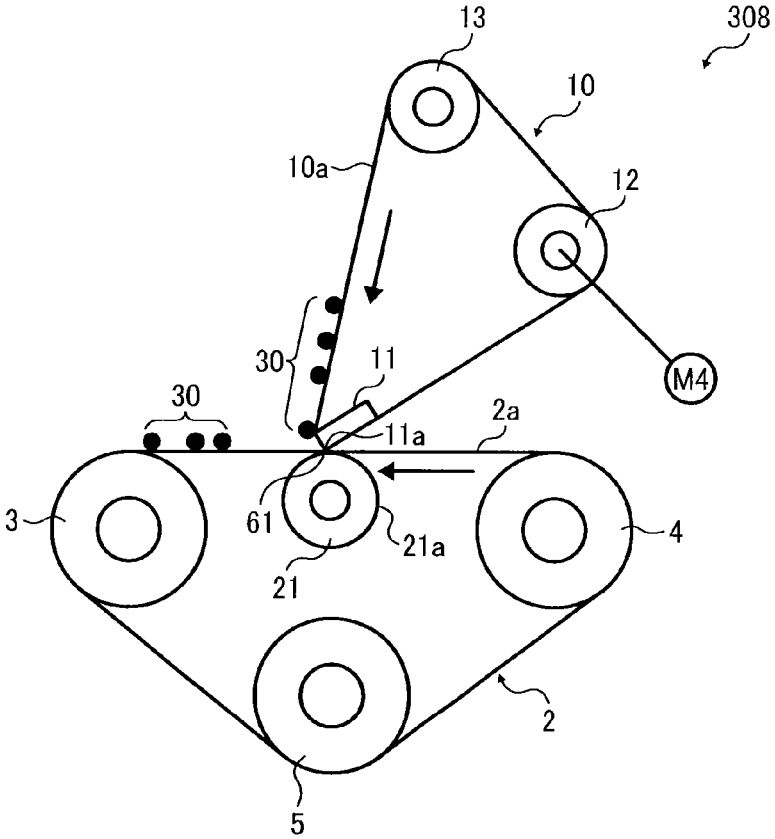
FIG. 8 illustrates an exemplary image transferring system according to an eighth embodiment of the present invention.

Now, an eighth embodiment of the present invention is described with reference to FIG. 8. As shown in FIG. 8, an image transferring unit 308 of this embodiment is prepared by adding a contacting member 21 to the configuration of the third embodiment. Specifically, as shown in FIG. 8, an image transferring unit 308 includes an image bearer 10 that bears an image 30 on its surface 10*a* (as a transfer origin), a transferring objective 2 that receives the image 30 transferred from the image bearer 10 on its surface 2*a* (as a transfer destination), and an contacting member 11 that engages with the transferring objective 2 via the image bearer 10, and a roller type contacting member 21 that engages with the image bearer 10 via the transferring objective 2. The surface 10*a* of the image bearer 10 and the surface 2*a* of the transfer objective contact each other and collectively form a contacting section 61. In this embodiment, the contacting member 11 contacts the transferring objective 2 via the image bearer 10 in a contacting section 61. The contacting member 21 also contacts the image bearer 1 via the transferring objective 2 in a contacting section 61 as well.

Again, the applicants prepared and tested a model with the above-described configuration by forming a toner image 30 on the image bearer 10 while regarding a recording sheet as the transferring objective 2. As a result, the applicants have confirmed that the image 30 on the transferring objective 20 does not pass downstream though the contacting section 61 in a rotating direction of the image bearer 10, and that the image 30 rather is sequentially transferred on to the transferring objective 20 in a moving direction of the transferring objective 20 in which the image 30 does not pass through the contacting section 61 in the downstream rotational direction of the image bearer 10. Because of this, since the image 30 on the image bearer 10 can be transferred onto the transferring objective 20 while omitting a transfer electric field in the contacting section 62, which is typically generated (by applying a transfer bias to the transferring objective 20 as) in a conventional system, neither an electric transfer field nor a transfer condition varies even if an environmental condition, such as temperature, humidity, etc., changes. Thus, when the image 30 is transferred from the image bearer 10 onto the transferring objective 20, since either the electric transfer field or the environmental condition rarely impacts such a process, excellent image transfer performance can be obtained. Further, in this embodiment, it is considered that since the contacting member 11 and 21 are additionally provided to the configuration of the first embodiment, and accordingly, the image 30 is stripped off and is preferably transferred from the image bearer 1 onto the transferring objective 20 while stabilizing the contacting section 61 when the image bearer 10 is rotated and reaches the contacting section 62. Further, since a transfer electric filed is not needed, and accordingly, a power source can be omitted as well, space saving and cost reduction can be readily accomplished.

Figure 9:
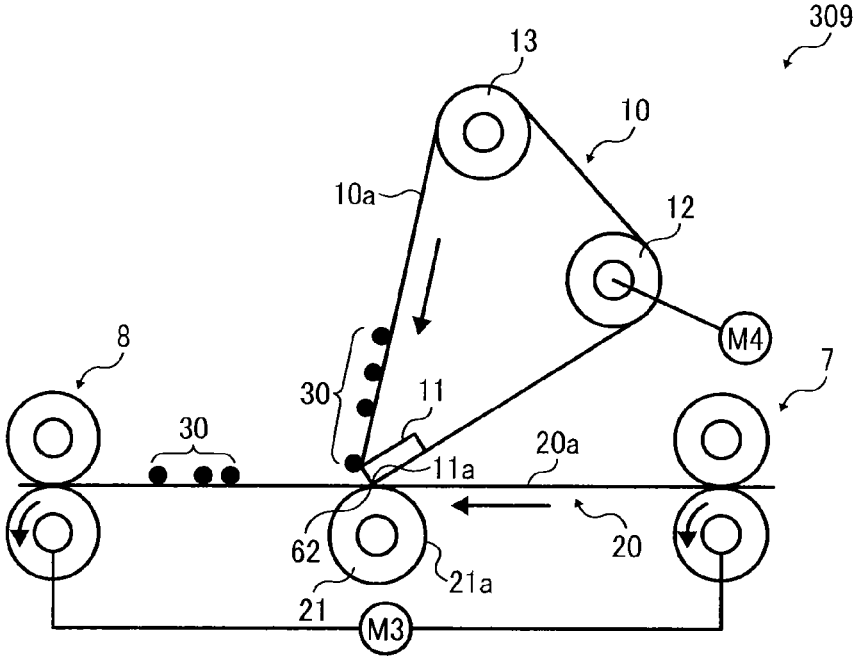
FIG. 9 illustrates an exemplary image transferring system according to a ninth embodiment of the present invention.

Now, a ninth embodiment of the present invention is described with reference to FIG. 9. As shown in FIG. 9, an image transferring unit 309 of this embodiment is prepared by adding a contacting member 21 to the configuration of the fourth embodiment. Specifically, as shown in FIG. 9, an image transferring unit 309 includes an image bearer 10 that bears an image 30 on its surface 10*a* (as a transfer origin), a transferring objective 2 that receives the image 30 transferred from the image bearer 10 on its surface 2*a* (as a transfer destination), and an contacting member 11 that engages with the transferring objective 2 via the image bearer 10, and a roller type contacting member 21 that engages with the image bearer 10 via the transferring objective 2. The surface 10*a* of the image bearer 10 and the transferring objective surface 20*a* contact each other and collectively form a contacting section 62. In this embodiment, the contacting member 11 contacts the transferring objective 20 via the image bearer 10 in a contacting section 62. The contacting member 21 also contacts the image bearer 10 via the transferring objective 20 in a contacting section 62 as well.

Again, the applicants prepared and tested a model with the above-described configuration by forming a toner image 30 on the image bearer 10 while regarding a recording sheet as the transferring objective 20. As a result, the applicants have confirmed that the image 30 on the transferring objective 20 does not pass downstream though the contacting section 62 in a rotating direction of the image bearer 10, and that the image 30 is rather sequentially transferred on to the transferring objective 20 in a moving direction of the transferring objective 20 in which the image 30 does not pass through the contacting section 62 in the downstream rotational direction of the image bearer 10. Because of this, since the image 30 on the image bearer 10 can be transferred onto the transferring objective 20 while omitting a transfer electric field in the contacting section 62, which is typically generated (by applying a transfer bias to the transferring objective 20 as) in a conventional system, neither an electric transfer field nor a transfer condition varies even if an environmental condition, such as temperature, humidity, etc., changes. Thus, when the image 30 is transferred from the image bearer 10 onto the transferring objective 20, since either the electric transfer field or the environmental condition rarely impacts such a process, excellent image transfer performance can be obtained. Further, in this embodiment, it is considered that since the contacting member 11 or 21 is additionally provided beside the configuration of the second embodiment, and accordingly, the image 30 is stripped off and is preferably transferred from the image bearer 1 onto the transferring objective 20 while stabilizing the contacting section 62 when the image bearer 10 is rotated and reaches the contacting section 62. Further, since a transfer electric filed is not needed, and accordingly, a power source can be omitted as well, space saving and cost reduction can be readily accomplished.

Figure 10:
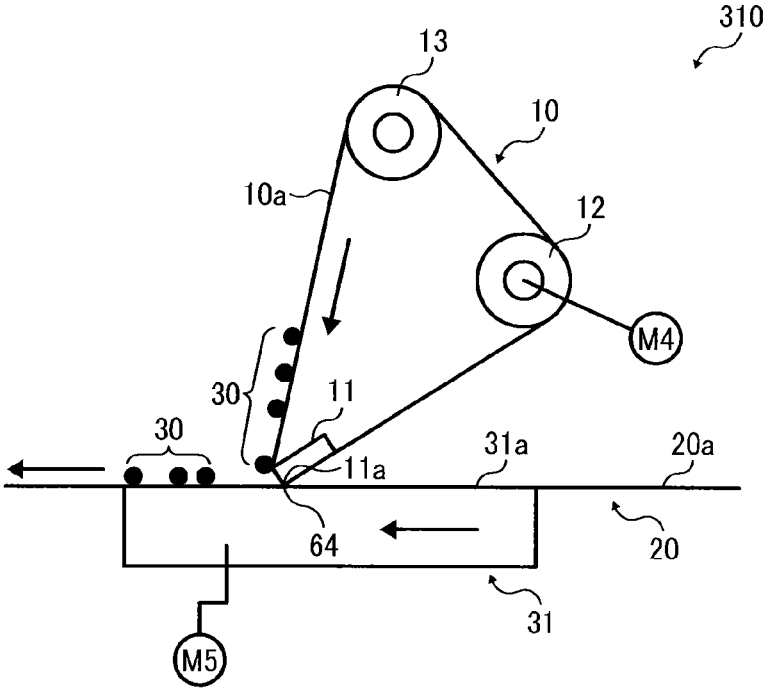
FIG. 10 illustrates an exemplary image transferring system according to a tenth embodiment of the present invention.

Now, a tenth embodiment of the present invention is described with reference to FIG. 10. As shown in FIG. 10, an image transferring system 310 of this embodiment is prepared by adding the contacting member 11 and the image bearer 10 employed in the third and fourth embodiments in place of the image bearer 1 employed in the seventh embodiment.

Specifically, as shown in FIG. 10, an image transferring system 310 includes an image bearer 10 that bears an image 30 on its surface 10*a* (as a transfer origin), a transferring objective 20 that receives the image 30 transferred from the image bearer 10 on its surface 20*a*, and an contacting member 11 that engages with the transferring objective 20 via the image bearer 10, and a roller type contacting member 21 that engages with the image bearer 10 via the transferring objective 20. The surface 10*a* of the image bearer 10 and the transferring objective surface 20*a* contact each other and collectively form a contacting section 64. In this embodiment, the contacting member 11 contacts the transferring objective 20 via the image bearer 10 in a contacting section 64. The contacting member 21 also contacts the image bearer 10 via the transferring objective 20 in a contacting section 64 as well.

Again, the applicants prepared and tested a model with the above-described configuration by forming a toner image 30 on the image bearer 10 while regarding a recording sheet as the transferring objective 20. As a result, the applicants have confirmed that the image 30 on the transferring objective 20 does not pass downstream though the contacting section 64 in a rotating direction of the image bearer 10, and that the image 30 rather is sequentially transferred on to the transferring objective 20 in a moving direction of the transferring objective 20 in which the image 30 does not pass through the contacting section 64 in the downstream rotational direction of the image bearer 10. Because of this, since the image 30 on the image bearer 10 can be transferred onto the transferring objective 20 while omitting a transfer electric field in the contacting section 64, which is typically generated (by applying a transfer bias to the transferring objective 20 as) in a conventional system, neither an electric transfer field nor a transfer condition varies even if an environmental condition, such as temperature, humidity, etc., changes. Thus, when the image 30 is transferred from the image bearer 10 onto the transferring objective 20, since either the electric transfer field or the environmental condition rarely impacts such a process, excellent image transfer performance can be obtained. Further, in this embodiment, it is considered that since the contacting member 11 is additionally provided to the configuration of the seventh embodiment, and accordingly, the image 30 is stripped off and is preferably transferred from the image bearer 10 onto the transferring objective 20 when the image bearer 10 is rotated and reaches the contacting section 64. Further, since a transfer electric filed is not needed, and accordingly, a power source can be omitted as well, space saving and cost reduction can be readily accomplished.

Although, the transferring objective 20 is integrally moved by moving the contacting member 31 in each of the image transferring systems 307 and 310 according to the seventh and tenth embodiments as shown in FIGS. 7 and 10, respectively, the present invention is not limited to such a configuration. For example, the contacting member 31 are positioned and fixed regarding the image bears 1 and 10, and the transferring objective 20 can be conveyed by a conveying device such as a roller, etc., in a left and right direction (i.e., horizontally) in the respective drawings.

Figure 11:
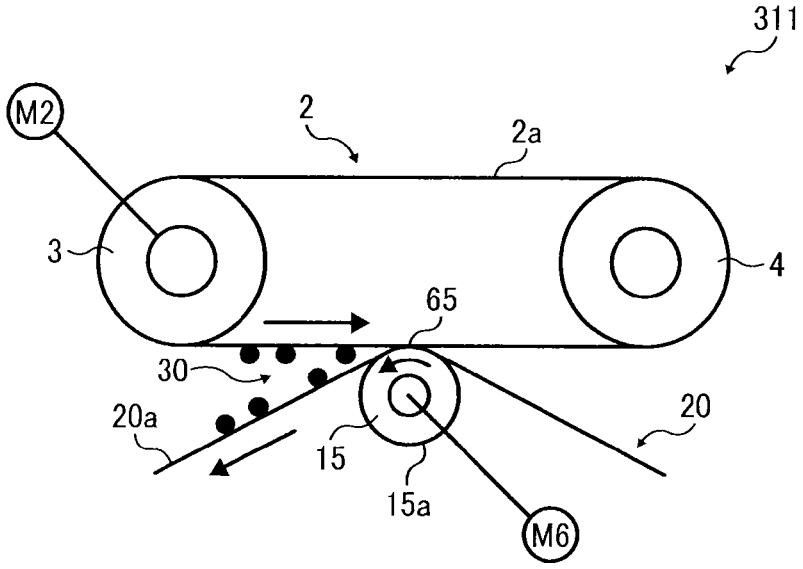
FIG. 11 illustrates an exemplary image transferring system according to an eleventh embodiment of the present invention.

Now, an eleventh embodiment of the present invention is described with reference to FIG. 11. As shown in FIG. 11, an image transferring system 311 of this embodiment includes a contacting section 65 formed by providing and bringing a transferring objective 20 in contact with a belt like-image bearer 2, which winds around the pair of rollers 3 and 4, via a driving roller 15. Specifically, the image bearer 2 and the transferring objective 20 are configured to move in a different direction to each other in the contacting section 65. That is, the transferring objective 20 is conveyed and moved by a driving roller 15 driven by a driving motor M6 in an opposite direction to that in which the surface 1*a* of the image bearer 1 rotates and moves counterclockwise driven by the driving motor M2. Specifically, in this embodiment, an image 30 on the image bearer 1 is sequentially transferred onto the transferring objective 20 in a contacting section 65, in which the surface 1*a* of the image bearer 1 and the surface 20*a* of the transferring objective 20 contact each other, in a direction in which the image 30 does not pass downstream through the contacting section 65.

Again, the applicants prepared and tested a model with the above-described configuration by forming a toner image 30 on the image bearer 1 while regarding a recording sheet as the transferring objective 20. As a result, the applicants have confirmed that the image 30 on the transferring objective 20 does not pass downstream though the contacting section 65 in a rotating direction of the image bearer 1, and that the image 30 rather is sequentially transferred on to the transferring objective 20 in a moving direction of the transferring objective 20 in which the image 30 does not pass through the contacting section 65 in the downstream rotational direction of the image bearer 1. Because of this, since the image 30 on the image bearer 1 can be transferred onto the transferring objective 20 while omitting a transfer electric field in the contacting section 65, which is typically generated (by applying a transfer bias to the transferring objective 20 as) in a conventional system, neither an electric transfer field nor a transfer condition varies even if an environmental condition, such as temperature, humidity, etc., changes. Thus, when the image 30 is transferred from the image bearer 1 onto the transferring objective 20, since either the electric transfer field or the environmental condition rarely impacts such a process, excellent image transfer performance can be obtained. Further, since a transfer electric filed is not needed, and accordingly, a power source can be omitted as well, space saving and cost reduction can be readily accomplished.

Figure 12:
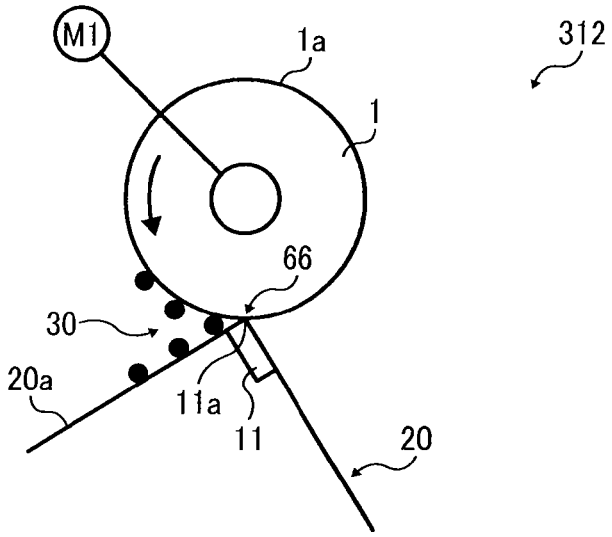
FIG. 12 illustrates an exemplary image transferring system according to a twelfth embodiment of the present invention.

Now, a twelfth embodiment of the present invention is described with reference to FIG. 12. As shown in FIG. 12, an image transferring system 312 includes a drum shaped image bearer 1 that bears an image 30 on its surface 1*a*, a transferring objective 20 that receives the image 30 transferred from the image bearer 1 on its surface 20*a*, and a contacting member 11 that engages with the image bearer 1 via the transferring objective 20. Further, the contacting member 11 changes an orientation of the transferring objective 20 as shown. In this embodiment, in this orientation changing section, the surface 1*a* of the image bearer 1 and the transferring surface 20*a* contact each other thereby forming a contacting section 66. Further, the image bearer 1 is rotated and moved by the driving motor M1 counterclockwise in the drawing. The transferring objective 20 is moved by a conveyor roller, not shown, in the opposite direction to that in which the surface 1*a* of the image bearer 1 moves, in the contacting section 66. Specifically, in this embodiment, an image 30 on the image bearer 1 is sequentially transferred onto the transferring objective 20 in a contacting section 66, in which the surface 1*a* of the image bearer 1 and the surface 20*a* of the transferring objective 20 contact each other, in a direction in which the image 30 does not pass downstream through the contacting section 66.

Again, the applicants prepared and tested a model with the above-described configuration by forming a toner image 30 on the image bearer 1 while regarding a recording sheet as the transferring objective 20. As a result, the applicants have confirmed that the image 30 on the transferring objective 20 does not pass downstream though the contacting section 66 in a rotating direction of the image bearer 1, and that the image 30 rather is sequentially transferred on to the transferring objective 20 in a moving direction of the transferring objective 20 in which the image 30 does not pass through the contacting section 66 in the downstream rotational direction of the image bearer 1. Further, since a transfer electric filed is not needed, and accordingly, a power source can be omitted as well, space saving and cost reduction can be readily accomplished at the same time. Although, the contacting members 11 and 22 are composed of the plate like member and the roller, respectively, in the above-described embodiment, the contacting member 11 and 22 can be composed of the roller and the plate like member, respectively, by contrast.

Figure 13:
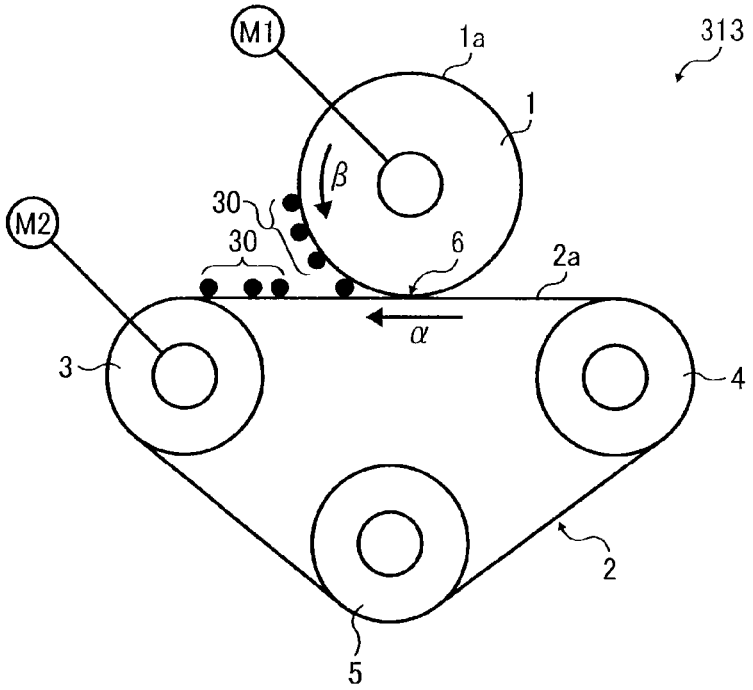
FIG. 13 illustrates an exemplary image transferring system according to a thirteenth embodiment of the present invention.

Now, a thirteenth embodiment of the present invention is described with reference to FIG. 13. In this embodiment, an image on an image bearer is sequentially transferred onto a transferring objective in a contacting section, in which the image-bearer and the transferring objective contact each other, in a direction in which the image does not pass downstream through the contacting section by creating a difference in relative rotational speed between the transferring objective and the image bearer. FIG. 13 illustrates a system, to which a configuration that creates a difference in relative rotational speed between the transferring objective and the image bearer is applied. Specifically, the image bearer 1 and the transferring objective 2 are configured to move in a different direction to each other in the contacting section 6. In such a configuration, only one of line velocities of those is simply either reduced or enhanced to differentiate a relative velocity between the image bearer 1 and the transferring objective 2, because both are moved by driving forces of the driving motors M1 and M2, respectively.

For example, when a line velocity of the transferring objective 2 is represented by $\alpha$, the line velocity of the image bearer 1 is represented by $\beta$, the following inequality may be employed; line velocity $\alpha$>line velocity $\beta$, or line velocity $\alpha$<line velocity $\beta$. In such a situation, when the inequality of line velocity $\alpha$>line velocity $\beta$ is satisfied, since a moving velocity of the image bearer can be reduced, durability of the image bearer can be upgraded while maintaining image forming productivity. Whereas, when the inequality of line velocity $\alpha$<line velocity $\beta$ is satisfied, since a quantity of the image 30 on the image bearer 1 can be reduced, the image 30 transferred onto the transferring objective 2 in the contacting section 6 becomes hardly collapse while enabling the transferring process to be stable. Further, when $\alpha=\beta$ is employed, a mechanism and control to generate the difference in velocity between the both parties can be simplified, because consideration of changing velocity, such as a decelerating and accelerating ratio of a driving system transmission, a rotational velocity of the driven motors M1 and M2, etc., are not needed.

Figure 14:
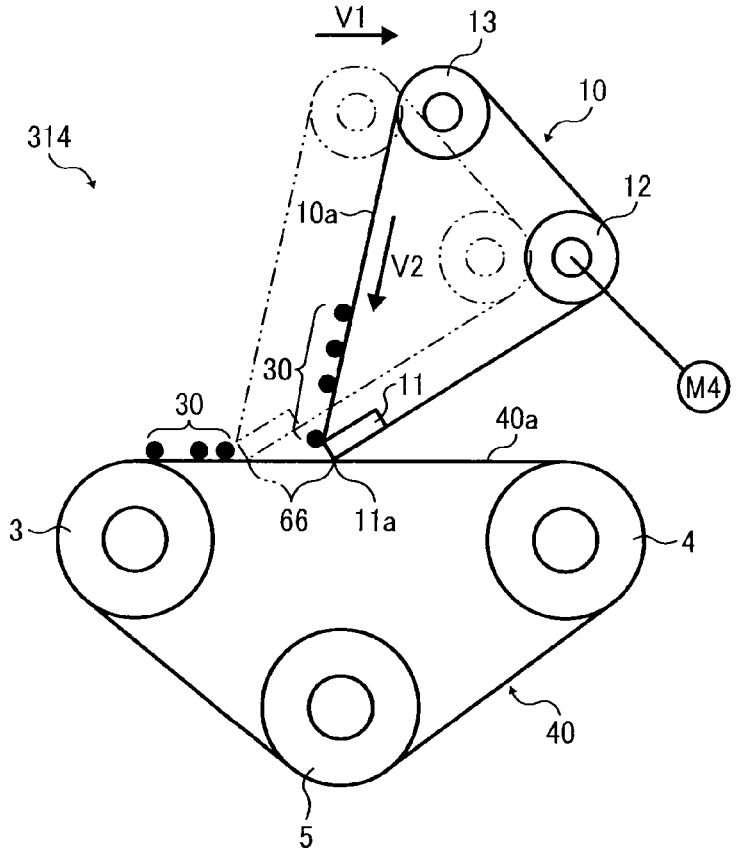
FIG. 14 illustrates an exemplary image transferring system and its modification according to a fourteenth embodiment of the present invention.

Now, a fourteenth embodiment of the present invention is described with reference to FIG. 14. The relative velocity difference between the transferring objective and the image bearer can also be accomplished only by moving any one of the both parties. For example, in an image transferring system 314 as shown in FIG. 14, a contacting section 66 is formed by bringing the image bearer 10, winding around the pair of rollers 12 and 13 and the contacting member 11 as described in the third embodiment, in contact with a sheet-like transferring objective 40 in a stopping condition. Further, the pair of rollers 12 and 13, the contacting member 11, and the image bearer 10 are integrated as a single unit, and is moved at a velocity V1 in the same direction as the image bearer 10 rotates and moves counterclockwise at a velocity V2, in the contacting section 66. Hence, with this configuration, since the contacting section 66 moves to the right in the drawing as the unit moves when the image bearer 10 rotates and moves, the image on the image bearer 10 is sequentially transferred onto a surface 40*a* of the transferring objective 40 in an opposite direction to that in which the image bearer surface 10*a* moves. That is, when viewed from the side of the image bearer 10, the transferring objective 40 moves right-to-left in the drawing at an apparent velocity V1 in the contacting section 66. Further, when viewed from the side of the image bearer 10, the surface 10*a* of the image bearer 10 moves left-to-right in the drawing at an apparent velocity V2 in the contacting section 66. Specifically, a moving direction of the surface 1*a* of the image bearer 1 and an apparent moving direction of the transferring objective 40 when viewed from the image bearer 10 are opposite to each other in the contacting section 66. Such a system to generate the relative velocity difference between the image bearer and the transferring objective can be applied to second to twelfth embodiments as well.

Figure 15A:
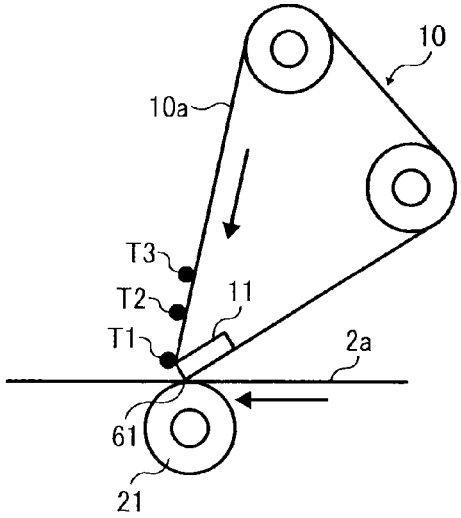
FIGS. 15A to 15D are diagrams collectively illustrating a principle of an image transferring process employed in the image transferring system according to one embodiment of the present invention.
Figure 15B:
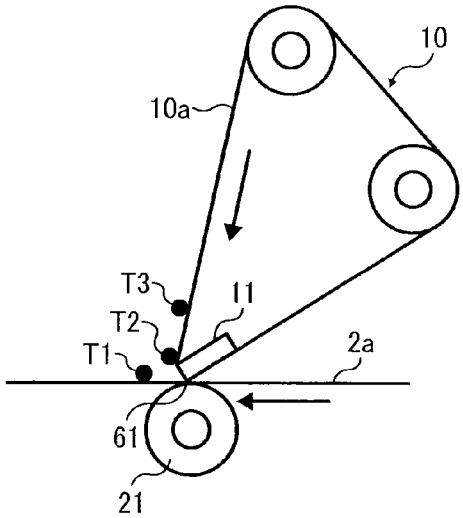
Figure 15C:
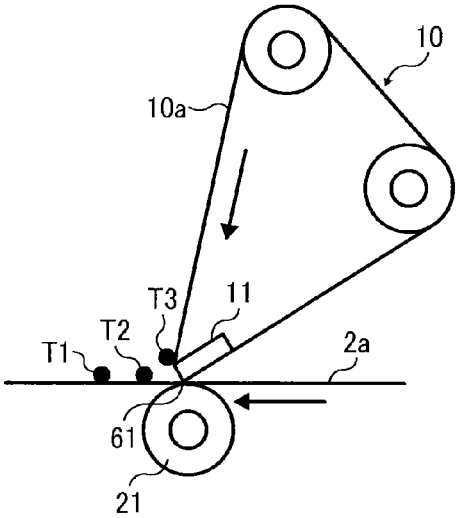
Figure 15D:
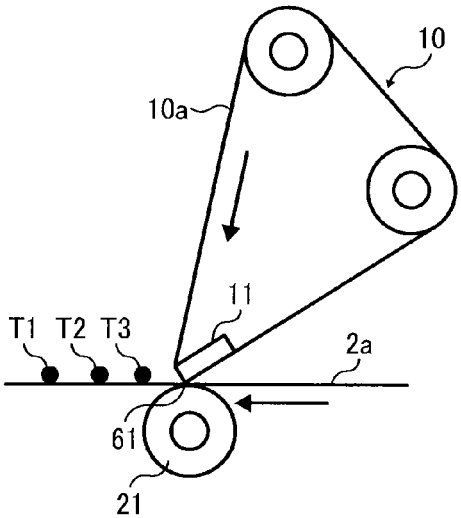

Now, exemplary transferring operation executed in an image transfer apparatus is herein below described with reference to FIGS. 15A to 15D. FIGS. 15A to 15D are partially enlarged views of FIG. 8. In FIG. 15, reference codes T1, T2, and T3 schematically illustrate images supported on a surface 10*a* of the image bearer 10. As shown in FIG. 15 A, these images T1, T2, and T3, are aligned in this order on the surface 10*a* of the image bearer 10 in a direction of its movement beginning with the image T1. As shown in FIG. 15B, since a surface 2*a* of a transferring objective 2 moves in a direction not to allow the image T1 to pass through a contacting section 61, it is supposed that the image T1 coming up to the contacting section 61 does not pass through the contacting section 61 and is rather transferred from the surface 10*a* of the image bearer 10 onto the transferring objective 2. Furthermore, the direction not to allow the image T1 to pass through a contacting section 61 is opposite a direction in which the image bearer surface 10*a* moves. Further, it is opposite a direction in which the image T1 tends to pass through the contacting section 61. Similarly, it is supposed that the image T2 coming up to the contacting section 61 does not pass through the contacting section 61 and is transferred from the surface 10*a* of the image bearer 10 onto the transferring objective 2 as shown in FIG. 15C as well. Yet similarly, it is supposed that the image T3 coming up to the contacting section 61 does not pass through the contacting section 61 and is transferred from the surface 10*a* of the image bearer 10 onto the transferring objective 2 as shown in FIG. 15D as well. Hence, it is supposed that images T1, T2 and T3 lined up in an order in a direction, in which the surface 10*a* of the image bearer 10 moves, are sequentially transferred onto the transferring objective 2 having a moving surface. Although the exemplary transferal activity of the image transferring system is described using the image transferring system 308 of the eighth embodiment heretofore, it is supposed that the images T1 to T3 can be similarly sequentially transferred in the other systems of the other embodiments as well.

Figure 16:
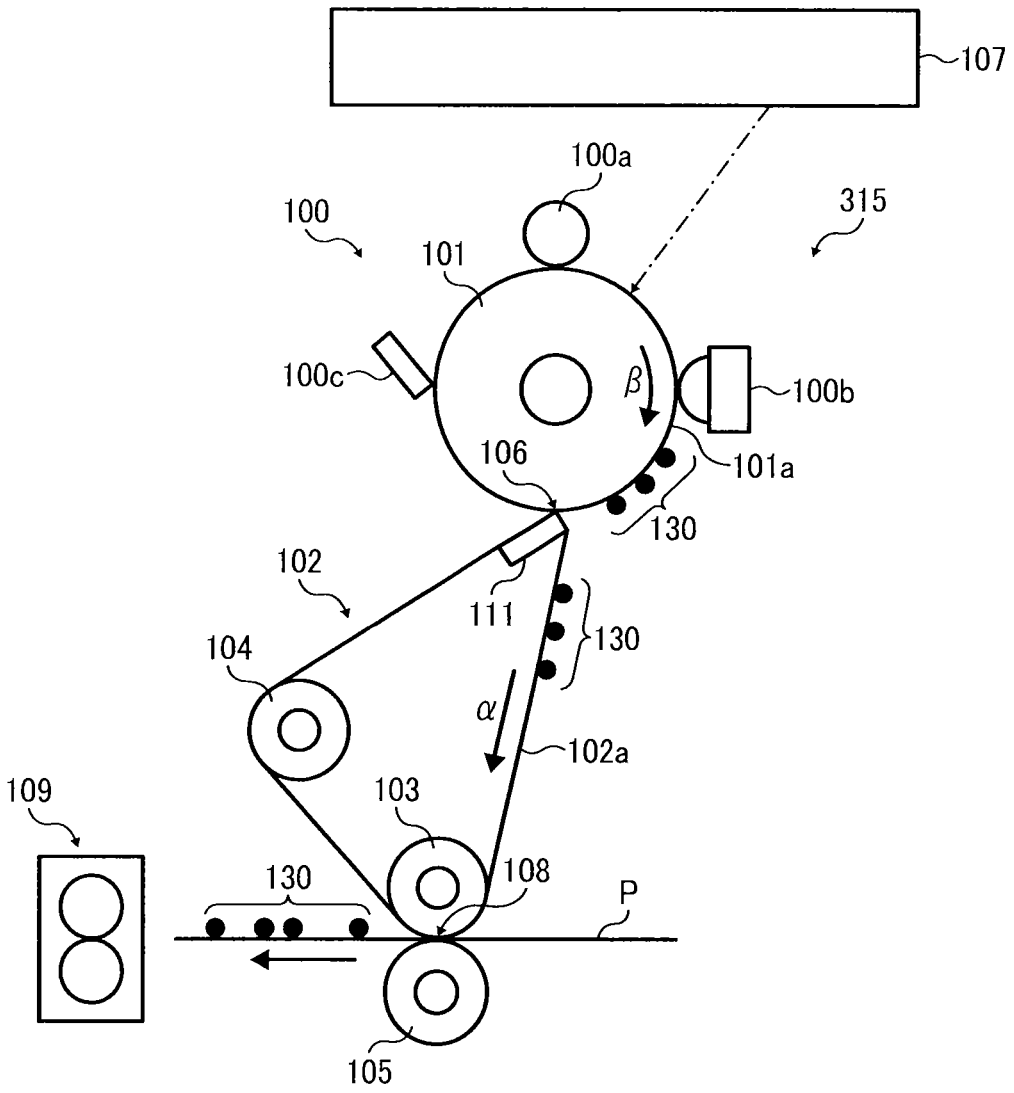
FIG. 16 illustrates an exemplary image forming apparatus according to a fifteenth embodiment of the present invention.

Now, various embodiments of image forming apparatuses, to which the above-described image transferring system and image transfer method are applied, are described with reference to FIGS. 16 to 19. Initially, a fifteenth embodiment is described with reference to FIG. 16. FIG. 16 is a schematic diagram illustrating an embodiment prepared by applying the above-described image transferring system 315 to a primary transfer section provided in an image forming apparatus that employs an electrophotography. The image forming apparatus shown in FIG. 16 includes a drum-shaped photoreceptor 101 serving as an image bearer, an image forming device 100 to form a toner image 130 on a surface 101*a* of the photoconductor, a belt-shaped intermediate transfer member 102 as a transferring objective, onto which the toner image 130 formed on the photosensitive surface 101 is transferred, and an exposing unit 107. The image forming device 100 includes a well-known electric charging device 100*a*, a well-known developing device 100*b*, and a well-known cleaning system 100*c* around the photoconductor 101 that rotates and moves clockwise in FIG. 16.

The intermediate transfer member 102 winds around a pair of rollers 103, 104 and a plate-like contacting member 111. The intermediate transfer member 102 accordingly forms a primary transfer section 106 by contacting a surface 101*a* of the photoconductor at a position, in which the contacting member 111 is opposed to the surface 101*a* of the photoconductor. Here, a transfer bias is not applied to the primary transfer section 106. In this embodiment, the intermediate transfer member 102 is enabled to move and circulate clockwise, and is thus configured to move and circulate in the primary transfer section 106 in a direction opposite to that the surface 101*a* of the photoconductor moves. In this embodiment, a (difference in) line velocity is set to satisfy the following inequality when a line velocity of the intermediate transfer member 102 is represented by α, and a line velocity of the image bearer 101 is represented by β; α<β.

A secondary transfer roller 105 is deployed with its surface contacting a surface of the roller 103 in an area facing a roller 103, thereby forming a secondary transfer section 108 in a contact area of both rollers. To the secondary transfer section 108, a transfer sheet P is conveyed from a sheet feeding unit, not shown, at a time when a toner image transferred onto the intermediate transfer member 102 reaches the secondary transfer section 108. To the secondary transfer roller 105, a transfer bias voltage is applied to generate an electric transfer field in the secondary transfer section 108 to secondarily transfer the toner image borne on the intermediate transfer member 102 onto the transfer sheet P.

When an image is formed in the image forming apparatus with such a configuration, the electrostatic device 100 charges the surface 101*a* of the photoconductor and a latent image is formed thereon receiving an exposure light beam from the exposing unit 107 that executes scanning exposure thereto. The latent image formed in this way is subsequently developed by toner supplied by the developing device 100*a* to be a toner image 130. The toner image 130 formed and borne on the surface 101*a* of the photoconductor reaches the primary transferring section 106. However, there exists a difference in line velocity between the photoconductor 101 and the intermediate transfer member 102 that satisfies the inequality α<β, and directions of movement of these two parties are opposite to each other in the transfer section 106. Because of this, the toner image 130 on the photosensitive surface 101*a* does not pass downstream through the transfer section 106 in a rotational direction of the photosensitive member, and is sequentially transferred onto the surface 102*a* of the intermediate transfer member 102, in a direction in which the toner image 130 does not pass therethrough. When it transferred onto the surface 102*a* of the intermediate transfer member 102 reaches the secondary transfer section 108, the toner image 130 is transferred onto the records sheet P by a secondary transfer bias. The transfer sheet P bearing the transferred toner image 130 is subsequently conveyed to a fixing device 109, and the toner image is subjected to heat and pressure and is accordingly fixed. On the other hand, the photoconductor 101 bearing the transferred toner image 130 is cleaned by a cleaning system 100*c*, and is initialized by a charge removing device, not shown.

Hence, when the image transferring system 315 according to this embodiment is applied to the image forming apparatus, either the electric transfer field or the environmental condition does not impact on a transferring process in which the toner image 130 is transferred in the primary transfer section 106. Thus, the image can be precisely transferred onto the intermediate transfer member 102, while achieving preferable image formation. Further, since a transfer electric filed can be omitted, a power supply facility becomes unnecessary, so that space saving and cost reduction can be readily promoted in the image forming apparatus. Further, since the difference in line velocity is set to satisfy the following inequality α<β between the line velocity alpha of the intermediate transfer member 102 and the line velocity β of the photoconductor 101, a quantity of the toner image 130 on the image bearer 101 can be reduced, and the image 30 transferred onto the intermediate transfer member 102 in the contacting section 106 becomes hardly collapse while enabling the transferring process to be stable.

Figure 17:
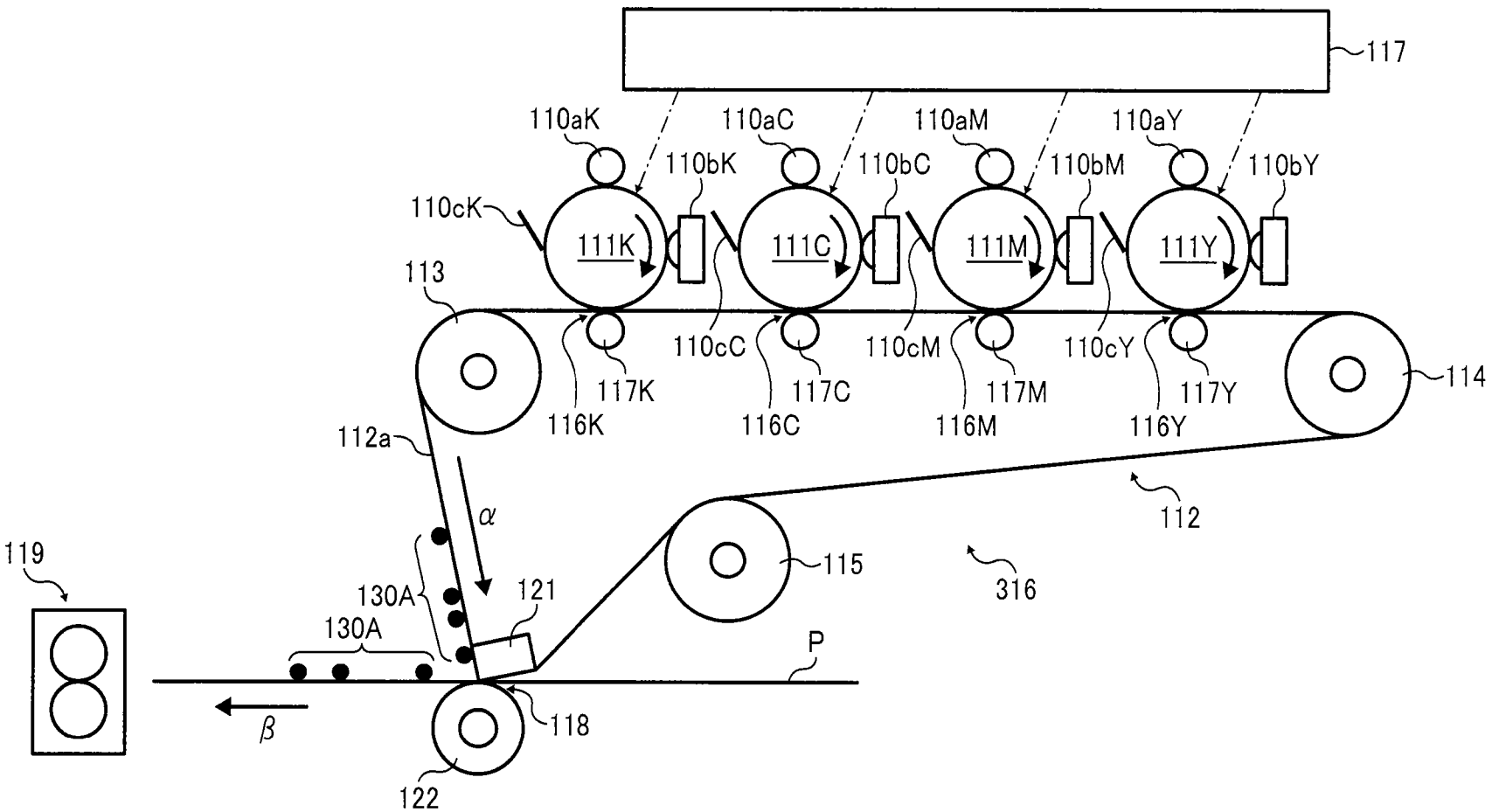
FIG. 17 illustrates an exemplary image forming apparatus according to a sixteenth embodiment of the present invention.

Now, a sixteenth embodiment of the present invention is described with reference to FIG. 17. FIG. 17 is a schematic diagram illustrating an embodiment prepared by applying the above-described image transferring system 315 to a secondary transfer section provided in an image forming apparatus that employs an electrophotography. An image forming apparatus shown in FIG. 17 is enabled to form a full-color image by using toner particles of yellow, magenta, cyan, and black colors. In applicable diagrams, subscripts Y, M, C, and K indicate devices handling yellow, magenta, cyan, and black colors, respectively. However, these subscripts Y, M, C, and K are omitted sometimes to avoid complexity. The Image forming apparatus shown in FIG. 17 includes multiple drum-shaped photoreceptors 111 (Y, M, C, and K) serving as image bearer, multiple image forming devices 100 to form toner image 130 of respective colors on surfaces 111*a* of the photoconductor, a belt-shaped intermediate transfer member 102 as a transferring objective, onto which the toner image 130A formed on the respective photosensitive surfaces 111 sequentially are transferred, and an exposing unit 117. Each of the image forming devices 110 includes a well-known electric charging device 110*a* (Y, M, C, and K), a well-known developing device 110*b* (Y, M, C, and K), and a well-known cleaning system 110*c* (Y, M, C, and K) around each of the photoconductors 111 that rotates and moves clockwise in FIG. 17.

The image transferring system 316 includes the intermediate transfer member 112 and a contacting member 121. The intermediate transfer member 112 winds around a pair of rollers 113, 114 and a plate like contacting member 121 and is given a prescribed tension by a roller 115. The intermediate transfer member 112 accordingly forms primary transfer sections 116 (Y, M, C, and K) between pair of rollers 113, 114 as it is contacted and pressed by the respective primary transfer rollers 117 (Y, M, C, and K) against the surfaces 111*a* of the photoconductor. Here, a transfer bias is applied to each of the primary transfer rollers 117. A secondary transfer roller 122 is located at a position opposed to the contacting member 121 to contact a surface 112*a* of the intermediate transfer member 112 thereby forming the secondary transfer section 118. Here, a transfer bias is not applied to the secondary transfer sec 118. To the secondary transfer section 118, a transfer sheet P is conveyed from a sheet feeding unit, not shown, at a time when a toner image 130A formed by toner images sequentially transferred onto the intermediate transfer member 112 reaches the secondary transfer section 118. In this embodiment, the intermediate transfer member 112 is enabled to move and circulate counterclockwise, and is thus configured to move and circulate in the secondary transfer section 118 in a direction opposite that the transfer sheet P is conveyed. In this embodiment, a line velocity is set to satisfy the following inequality when a line velocity of the intermediate transfer member 112 is represented by α, and a line velocity of the transfer sheet P is represented by β; α<β.

When a color image is formed in the image forming apparatus with such a configuration, each of the surfaces 111*a* of the photoconductor is charged by each of the electrostatic device 110*a* and a latent image of each col is formed thereon receiving an exposure light beam corresponding to the color from the exposing unit 117 that provides scanning exposure to each of these latent images. Each of the latent images formed in this way is subsequently developed by corresponding color toner supplied by the corresponding color-developing device 110*b* to be a corresponding color component toner image. The toner image formed and borne on the each of the photosensitive surfaces 110 are sequentially transferred on a surface 112*a* of the intermediate transfer member 112 in each of the transfer sections 116 under a transfer bias as a toner image 130*a*, and are further conveyed to the secondary transfer section 118. Each of the photoconductors 111 bearing the transferred toner image is cleaned by each of cleaning system 110*c*, and is initialized by each of charge removing devices, not shown. To the secondary transfer section 118, a transfer sheet P is conveyed from a sheet feeding unit, not shown, at a time when the toner image 130A reaches the secondary transfer section 118. At this moment, however, there exists a difference in line velocity between the intermediate transfer member 112 and that of the transfer sheet P that satisfies the inequality $\alpha<\beta$, and directions of movement of these both parties are opposite to each other in the secondary transfer section 118. Because of this, the toner image 130A borne on the photosensitive surface 112*a* does not pass downstream through the secondary transfer section 118 in a rotational direction of the intermediate transfer member 112, and is rather sequentially transferred onto the transfer sheet P, in a direction in which the toner image 130A does not pass therethrough. The transfer sheet P bearing the transferred toner images 130A is subsequently conveyed to a fixing device 119, so that the toner image 13A is subjected to heat and pressure and is accordingly fixed.

Hence, when the image transferring system 316 according to this embodiment is applied to the image forming apparatus, a transferring process for transferring the toner image 130A in the secondary transfer section 118 is not affected by either the electric transfer field or the environmental condition. Thus, the image can be precisely transferred onto the transfer sheet P while achieving preferable image formation. Further, since a transfer electric filed can be omitted, a power supply facility becomes unnecessary, so that space saving and cost reduction can be readily promoted in the image forming apparatus at the same time. Further, since the difference in line velocity is set to satisfy the inequality $\alpha<\beta$ between the line velocity $\alpha$ of the intermediate transfer member 102 and the line velocity $\beta$ of the transfer sheet P, the moving velocity of each of the photoconductors 111 and image forming sections 110 can be reduced. Accordingly, while maintaining image forming productivity, durability of each of the photoconductors 111 and image forming sections 110 can be upgraded.

Figure 18:
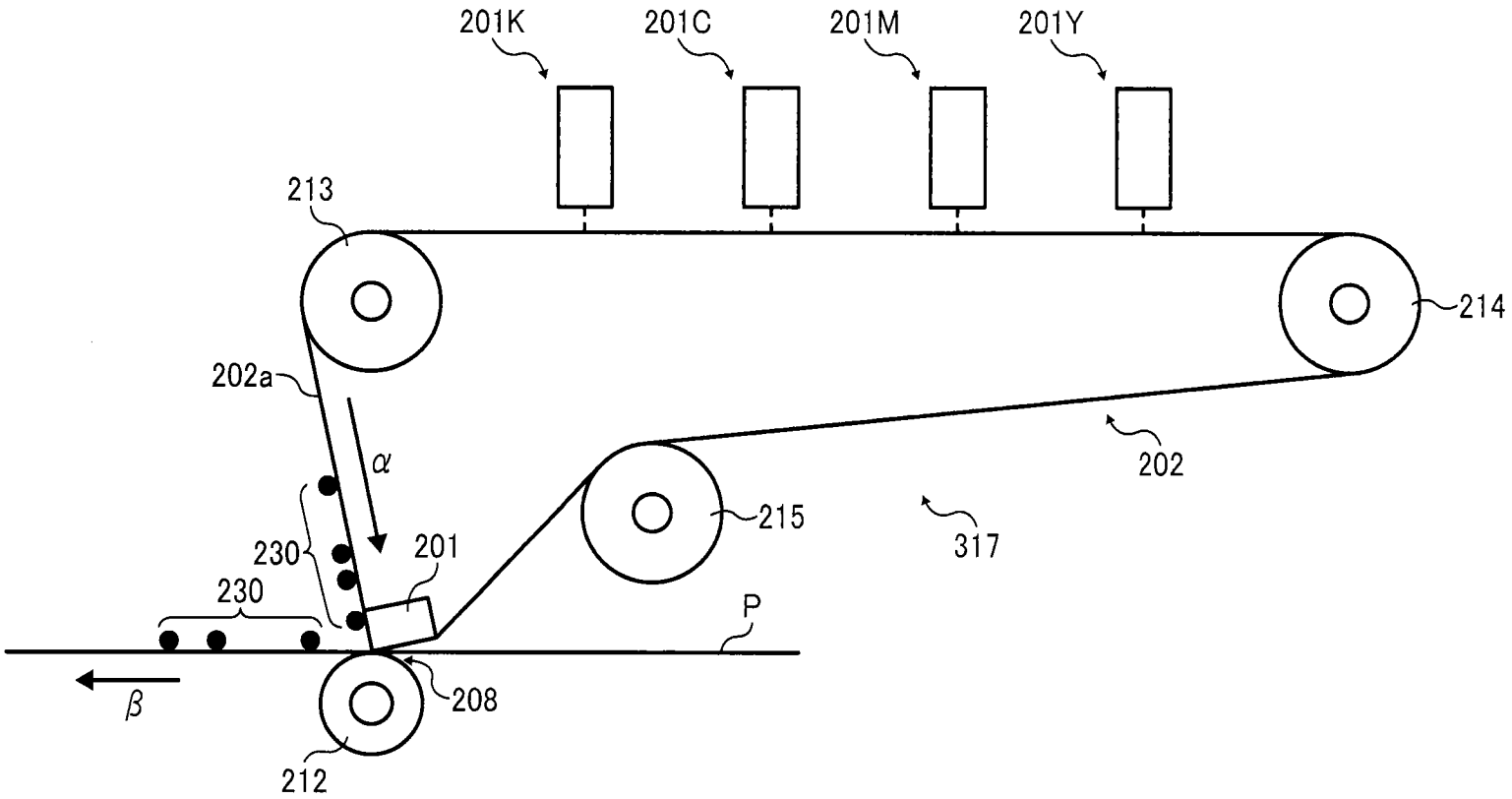
FIG. 18 illustrates an exemplary image forming apparatus according to a seventeenth embodiment of the present invention.

Now, a seventeenth embodiment of the present invention is described with reference to FIG. 18. FIG. 18 is a schematic diagram illustrating an embodiment prepared by applying the above-described image transferring system 317 to a secondary transfer section provided in an image forming apparatus that ejects drops of ink from a nozzle head. The image forming apparatus shown in FIG. 18 is enabled to form a full color image using ink drops of yellow, magenta, cyan, and black colors. In applicable diagrams, subscripts Y, M, C, and K indicate devices handling yellow, magenta, cyan, and black colors, respectively. However, these subscripts Y, M, C, and K are omitted sometimes to avoid complexity. The image forming apparatus includes nozzle heads 201 (Y, M, C, and K) to jet ink drops as image forming sections and a transfer belt 202 as an image bearer that bears images formed by ejecting the ink drops from each of the nozzle heads 201 (Y, M, C, and K).

The image transferring system 317 includes the transfer member 202 and a contacting member 211. The transfer belt 202 winds around a pair of rollers 213 and 214 and the plate like contacting member 221 and is given a prescribed tension by a roller 212. On a portion of the transfer belt 202 located between the rollers 213 and 214, an image 230 is formed by sequentially ejecting ink drops from the respective nozzle heads 201 and synthesizing ink drop images thereon. A transfer roller 212 is located at a position opposed to the contacting member 211 to contact the surface 202*a* of the transfer member 202 thereby forming the transfer section 208 as a contacting section. Here, a transfer bias is not applied to the transfer section 208. To the transfer section 208, a transfer sheet P is conveyed from a sheet feeding unit, not shown, at a time when an image 230A borne on the transfer member 202 reaches the transfer section 208. In this embodiment, the transfer member 202 is enabled to move and circulate counterclockwise, and is thus configured to move and circulate in the transfer section 208 in a direction opposite to that the transfer sheet P is conveyed. In this embodiment, a (difference in) line velocity is set to meet the following inequality when a line velocity of the transfer member 202 is represented by $\alpha$, and a line velocity of the transfer sheet P is represented by $\beta$; $\alpha<\beta$.

When a color image is formed in the image forming apparatus with such a configuration, the ink image 230 is formed on the surface 202*a* of the transfer belt 202 by ejecting ink drops from the respective nozzle heads 201. To the transfer section 208, a transfer sheet P is conveyed from a sheet feeding unit, not shown, at a time when the image 230 reaches the secondary transfer section 208. At this moment, however, there exists a difference in line velocity between the transfer member 202 and that of the transfer sheet P that satisfies the inequality $\alpha<\beta$, and directions of movement of these both parties are opposite each other in the secondary transfer section 208. The image 230 is supported on the transfer belt 202 and is further conveyed to the transfer section 208. Because of this, the image 230 borne on the surface 202*a* of the transfer belt 202 does not pass downstream through the transfer section 208 in a rotational direction of the transfer belt 202, and is rather transferred onto the transfer sheet P in a direction in which the toner image 230 does not pass therethrough.

Hence, when the image transferring system 317 according to this embodiment is applied to the image forming apparatus, a transferring process for transferring the toner image 230 in the transfer section 208 is rarely impacted by either the electric transfer field or the environmental condition. Thus, the image can be precisely transferred onto the transfer sheet P while precisely forming an image. Further, since a transfer electric filed can be omitted, a power supply facility therefor becomes unnecessary, so that space saving and cost reduction can be readily promoted in the image forming apparatus at the same time. Further, since the difference in line velocity is set to satisfy the following inequality $\alpha<\beta$ between the line velocity $\alpha$ of the transfer member 202 and the line velocity $\beta$ of the transfer sheet P, an injection velocity of each of the nozzle heads 201 and a moving velocity of the transfer belt 202 can be reduce. Consequently, while maintaining image forming productivity, durability of each of the nozzle heads 201 and the transfer belt 202 can be upgraded.

In the configuration of the image forming apparatus shown in FIG. 17, the transportation sheet P prepared by cutting a sheet into multiple pieces each having a prescribed length is conveyed to the secondary transfer section 118. However, as shown in FIG. 19B, a roll type continuous transfer sheet P1 can also be used as the transfer sheet P. In such a situation, the roll of transfer sheet P1 is conveyed below the intermediate transfer member 112 to contact the intermediate transfer member 112 at a position opposed to the contacting member 121 to form the secondary transfer section 118. Further, in this case, a recovery role section 301 that rolls up the transfer sheet P1 is placed upstream of the secondary transfer section 118 in a rotational direction of the intermediate transfer member, so that moving directions of the transfer sheet P and the intermediate transfer member 112 can be opposite each other in the secondary transfer section 118. Even with such a configuration, a transferring process for transferring the image 130A in the secondary transfer section 118 is rarely affected by either the electric transfer field or the environmental condition. Thus, the image can be precisely transferred onto the transfer sheet P, while precisely forming an image. Further, since a transfer electric filed can be omitted, a power supply facility becomes unnecessary, so that space saving and cost reduction can be readily promoted in the image forming apparatus.

Figure 19A:
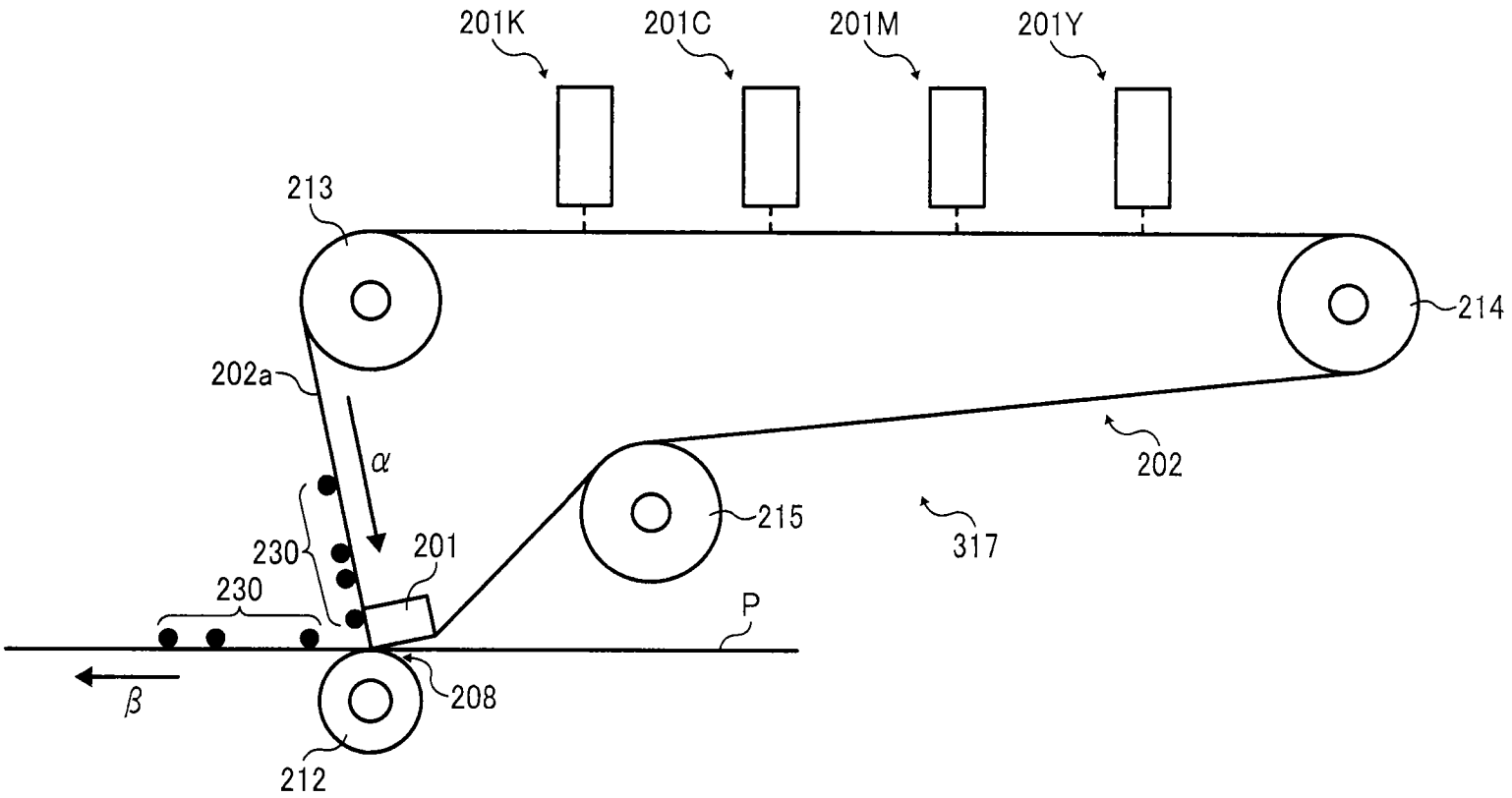
FIG. 19A is a diagram illustrating an exemplary image forming apparatus forming an image using ink drops according to one embodiment of the present invention.
Figure 19B:
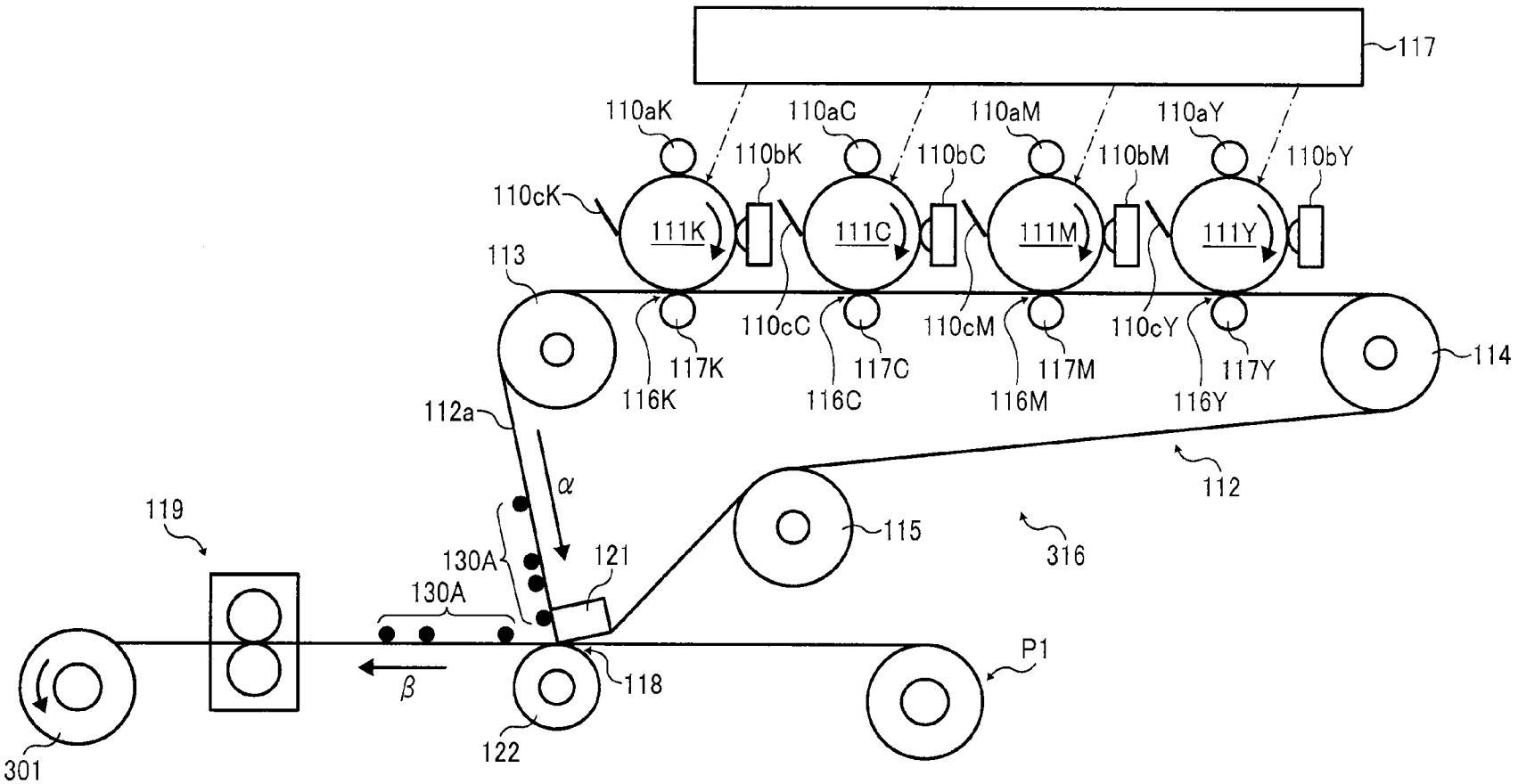
FIG. 19B is a diagram illustrating a modification of the image forming device of the sixteenth embodiment according to the present invention.
Figure 19C:
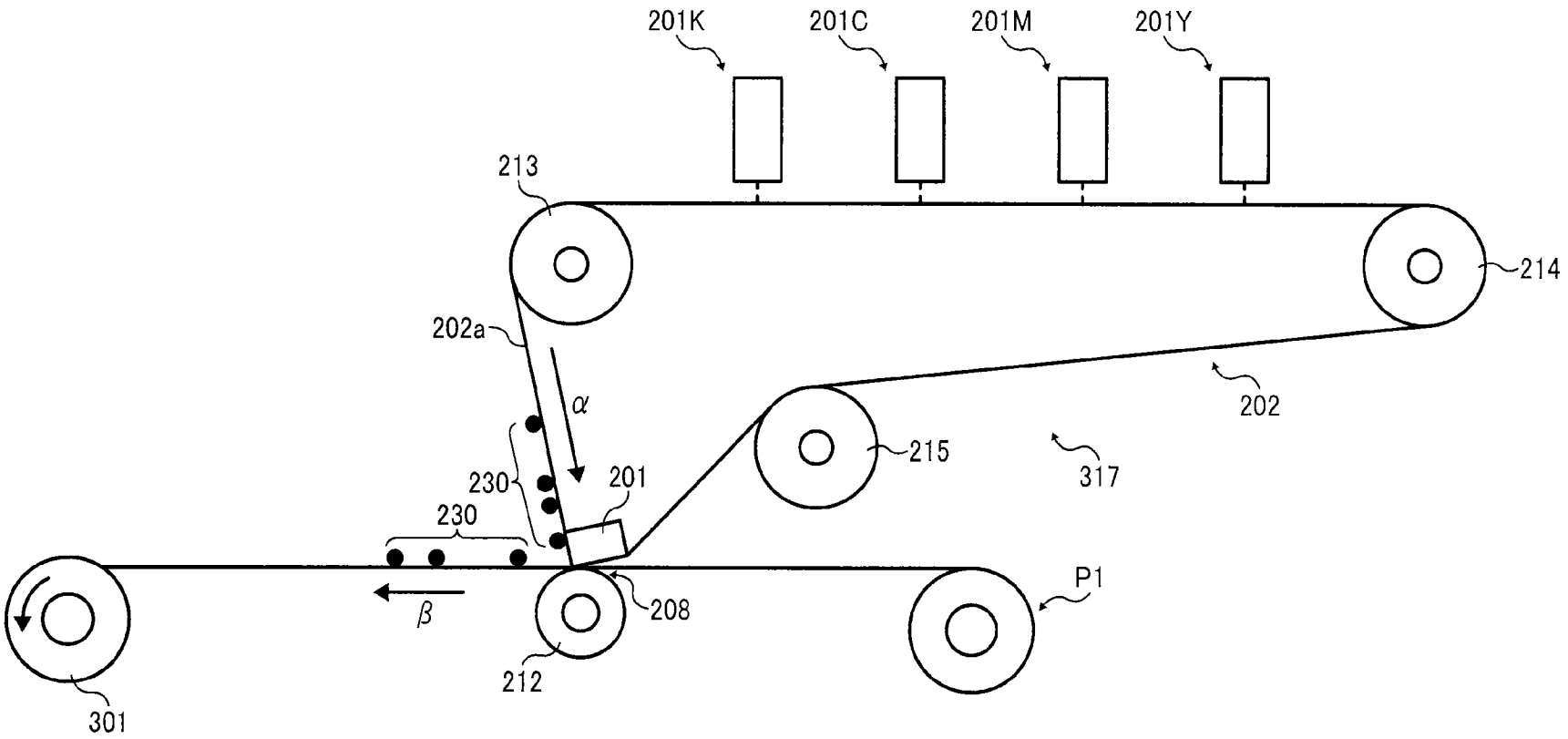
FIG. 19C is a diagram illustrating a modification of the image forming device of the sixteenth according to one embodiment of the present invention.

In the configuration of the image forming apparatus shown in FIGS. 18 and 19, the transportation sheet P prepared by cutting a sheet into multiple pieces each having a prescribed length is conveyed to the secondary transfer section 208. However, as shown in FIG. 19C, a roll type continuous transfer sheet P1 can also be used as the transfer sheet P. In such a situation, the roll of transfer sheet P1 is conveyed below the transfer member 202 to contact the transfer member 202 at a position opposed to the contacting member 212 to form the secondary transfer section 208. Further, in this case, a recovery role section 301 that rolls up the transfer sheet P1 is placed upstream of the secondary transfer section 208 in a rotational direction of the transfer member 202, so that moving directions of the transfer sheet P and the transfer member 202 can be opposite each other in the secondary transfer section 208. Even with such a configuration, a transferring process for transferring the toner image 230 in the secondary transfer section 208 is rarely affected by either the electric transfer field or the environmental condition. Thus, the image can be precisely transferred onto the transfer sheet P, while precisely forming an image. Further, since a transfer electric filed can be omitted, a power supply facility becomes unnecessary, so that space saving and cost reduction can be readily promoted in the image forming apparatus.

As the image transferring system applicable to the above-described image forming apparatus is not limited to those of embodiments as described in FIGS. 17, 18 and 19, and the image transferring system according to the first to fourteenth embodiments can be modified and applied precisely in accordance with an image forming unit and an image forming system. Further, in addition to the above-described image forming apparatus, a power supply can be employed to provide a bias to form an electric field at the contact sec, in which the image bearer and the transferring objective contact each other. Further, the above-described various embodiments of the present invention can be applied to a so-called offset printing device beside a system that employ an electrophotography or a system that ejects ink drops from a nozzle head.

Figure 20A:
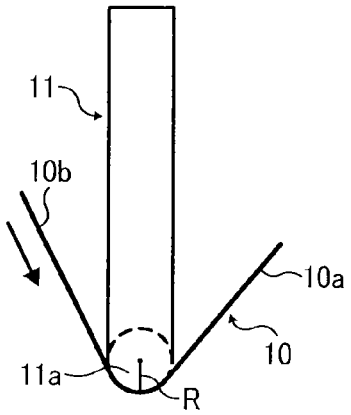
FIGS. 20A to 20C are enlarged views illustrating exemplary configurations of a contacting member and its modifications according to one embodiment of the present invention.
Figure 20B:
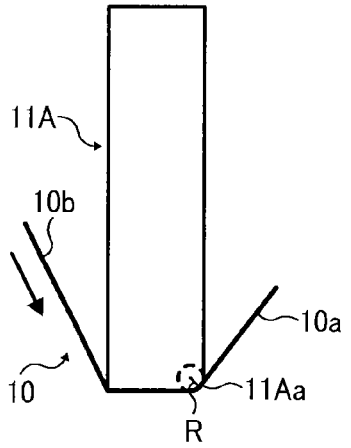
Figure 20C:
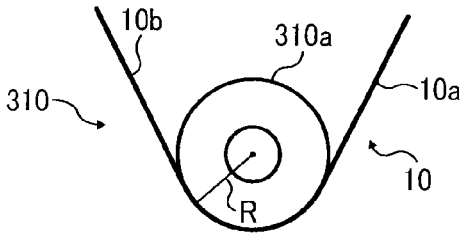

In the above-described various embodiments, the plate like contacting member 11 is demonstrated. However, the contacting member 11 is not limited to the plate like one, and may include a contacting member 310 composed of a roller as shown in FIG. 20C, and a contacting member 11A composed of a plate thicker than the contacting member 11, as shown in FIG. 20B. When the plate like contacting member 11 is used, a tip thereof can be pressed against an inner surface 10*b* opposite the surface 10*a* of the image bearer 10 to form a contacting section contacting the surface (10*a*) of the image bearer to be a cylindrical shape. In such a situation, the tip 11*a* of this contacting member 11 is entirely formed into the cylindrical shape as shown in FIG. 20A, and nearly the tip 11*a* is almost entirely pressed against the inner surface 2*b* of the transferring objective (the image bearer) to form the contacting section contacting the surface (10*a*) of the image bearer to be cylindrical.

Further, as shown in FIG. 20B, when the plate like contacting member 11A thicker than the contacting member 11 is used, a corner 11Aa of a tip thereof can be pressed against an inner surface 10*b* of the surface 10*a* of the image bearer 10 to form a contacting section contacting the surface 10*a* of the image bearer into the cylindrical shape. In such a situation, the tip 11A of this contacting member 11 does not need to be entirely formed into the cylindrical shape, and only a corner 11Aa of the tip thereof is pressed against the inner surface 10*b* of the image bearer 10 to form the contacting section contacting the surface 10*a* of the image bearer into the ac shape. Further, as shown in FIG. 20C, when a cylindrical contacting member 310 is used, the contact sec can be formed into the cylindrical surface by pressing almost the half-of its outer surface 310*a* of the contacting member 310 against the inner surface 10*b* of the image bearer surface 10.

The applicants have tested these various cylindrical surfaces by changing a dimension thereof and confirmed that images 30, 130, 130A and 230 do not pass through the respective contacting sections and excellent transfer performance can be obtained when a curvature radius B of the cylindrical surfaces is less than about 4 mm. Further, when the curvature radius R is about 2 mm or more, more favorable transfer performance is obtained. As material of the contacting member 11, 11A, and 110, resin and metals, such as aluminum, stainless steel, etc., may be used.

Figure 21A:
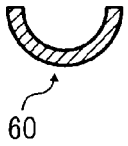
FIGS. 21A to 21D are enlarged views illustrating modifications of the contacting member according to one embodiment of the present invention.
Figure 21B:
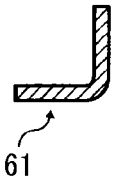
Figure 21C:
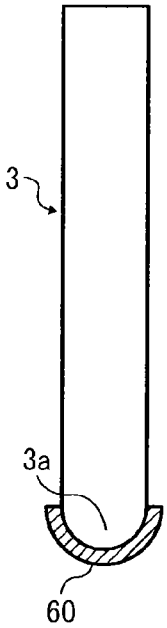
Figure 21D:
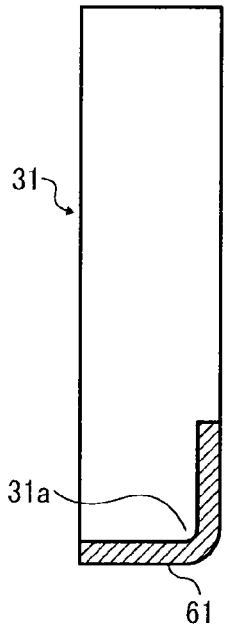

As the contacting member, it is not limited to the plates and roller shapes, and includes a cylindrical member 60 and an L-letter shape member 61 may be utilized as shown in FIGS. 21A and 21B, for example. Further, depending on material of each the image bearer, the contacting member likely wears away as it moves and rotates when the contacting member is made of the resin. For this reason, as shown in FIGS. 21C and 21D, to each of the tip 11*a* of the contacting member 11 and the corner of the contacting member 11A, a member 60 made of metal can be attached.

As the member of each of the 1 image bearer 1, 10, 101, 112, and 202 and that of each of the transferring objectives 2, 20, and 102, and (a transfer sheet) P, polypropylene, polyethylene, polyethylene terephthalate, polyester, polyolefin, vinyl, nylon, polyimide, and polyamide-imide, or the like may be used. Further, a sheet and film made of fluorine resin, such as PTFE (polytetrafluoroethylene), PFA (tetrafluoroethylene-perfluoroalkyl), PVDF (polyvinylidene fluoride), PVF (polyvinyl fluoride), etc., may be used as well. Further usable material is prepared by coating a sheet made of fiber, such as glass, carbon, aramid, etc., with fluorocarbon resin, etc.

Further, when a surface roughness Ra (e.g. an arithmetic average roughness (hereinafter, simply referred to as a surface roughness Ra) of each of the image bearers 1, 10, 101, 112, and 202 serving as a transferring origin, and each of the transferring objectives 1, 10, 101, 112, 2, 20, and 102, and P serving as a transferred objective is more desirably about 10 μm or less, because an image can be transferred without being destroyed. Such a surface roughness is measured using a laser microscopes (VK9500) manufactured by Keyence Corporation. Otherwise, the surface roughness Ra may be measured using a measurement system that complies with JIS B0031 as well.

The surface roughness Ra of each of the image bearers 1, 10, 101, 112, and 202 serving as the transferring origin, and each of the transferring objectives 2, 20, and 102, and P serving as the transferred objective is more desirably about 10 μm (micrometer) or less when a usage toner particle includes a diameter of about 6 μm (micrometer) or less. Whereas, the surface roughness Ra of each of the image bearers 1, 10, 101, 112, and 202 serving as the transferring origin, and each of the transferring objectives 2, 20, and 102, and P serving as the transferred objective is more desirably about 14 μm (micrometer) or less when the usage toner particle includes a diameter of about 8 μm or less. Further, the surface roughness Ra of each of the image bearers 1, 10, 101, 112, and 202 serving as the transferring origin, and each of the transferring objectives 2, 20, and 102, and P serving as the transferred objective is more desirably about 10 μm (micrometer) or less when usage drops include the ink. A diameter of the toner particle is measured using the Coulter counter Maultisizer™ (manufacture by Coulter Corp.) while employing an aperture of about 100 μm (micrometer) and calculating an average of particle sizes of 50000 pieces as measuring results. Here, the toner particle diameter represents the number average particle size.

The surface roughness Ra of each of the image bearers 1, 10, 101, 112, and 202 serving as the transferring origin, and each of the transferring objectives 2, 20, and 102, and P serving as the transfer destinations is desirably about 40 μm (micrometer) or less, when the line velocity (i.e., the surface velocity) of each of the transferring objectives 2, 20, and 102 and P is about 200 mm/sec or less. Whereas, the surface roughness Ra of each of the image bearers 1, 10, 101, 112, and 202 serving as the transferring origin, and each of the transferring objectives 2, 20, and 102, and P serving as the transferred objective is desirably about 30 μm (micrometer) or less, when the line velocity (i.e., the surface velocity) of each of the transferring objectives 2, 20, and 102 and P is about 200 mm/sec or more and about 400 mm/sec or less. Further, the surface roughness Ra of each of the image bearers 1, 10, 101, 112, and 202 serving as the transferring origin, and each of the transferring objectives 2, 20, and 102, and P serving as the transferred objective is desirably about 20 μm (micrometer) or less, when the line velocity (i.e., the surface velocity) of each of the transferring objectives 2, 20, and 102 and P is about 400 mm/sec or more.

Figure 22:
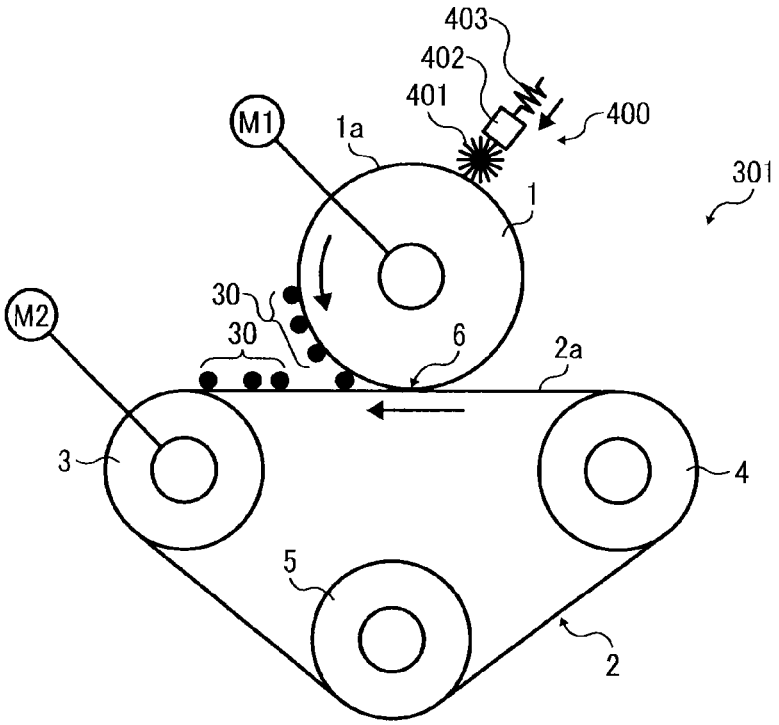
FIG. 22 illustrates an exemplary image transferring system according to an eighteenth embodiment of the present invention.

Now, an eighteenth embodiment of the present invention is described with reference to FIG. 22. As shown in FIG. 22, this embodiment additionally includes a protecting device 400 to the image transferring system 301 of the first embodiment. The protecting device 400 includes a solid lubricant 402 as a protecting member, a coating roller 401 to coat the solid lubricant 402 onto an image bearer surface 1*a* of an image bearer 1 as a coating member, and a spring 403 to urge the solid lubricant 402 toward the coating roller 401 as a biasing member. In this embodiment, the coating roller 401 is configured by a rotatable-brush roller, while a brush tip contacts both the surface 1*a* of the image bearer 1 of the image bearer 1 and the lubricant 402, preferably with pressure.

The coating roller 401 is placed upstream of a contacting section 6, in which the surface 1*a* of the image bearer 1 and a surface 2*a* of the transferring objective contact each other, in a rotating direction of the image bearer 1, and contacts the surface 1*a* of the image bearer 1 either with or without pressure. In this embodiment, the coating roller 401 is configured to be driven and rotated as the image bearer 1 moves. However, the coating roller 401 can be driven and rotated by providing driving force from a power source such as a driving motor, not shown, to the coating roller 401.

With such a configuration of the protecting device 400, the lubricant 402 pressed by spring power of the spring 403 against the coating roller 401 that is driven and rotated as the image bearer 1 rotates and moves is chipped off and coated onto the image bearer surface 1*a* by the coating roller 401. For this reason, since the image bearer surface 1*a* and the transferring objective surface 2*a* of the transferring objective 2 are protected, transfer performance transferring an image from the surface 1*a* of the image bearer 1 to the transcribing surface 2*a* can be upgraded. In the eighteenth embodiment, the configuration prepared by the adding the protecting device 400 to the first embodiment is demonstrated. However, even when the protecting device 400 is added to any one of the second to fourteenth embodiments, the similar result can be advantageously obtained as the eighteenth embodiment.

Figure 23:
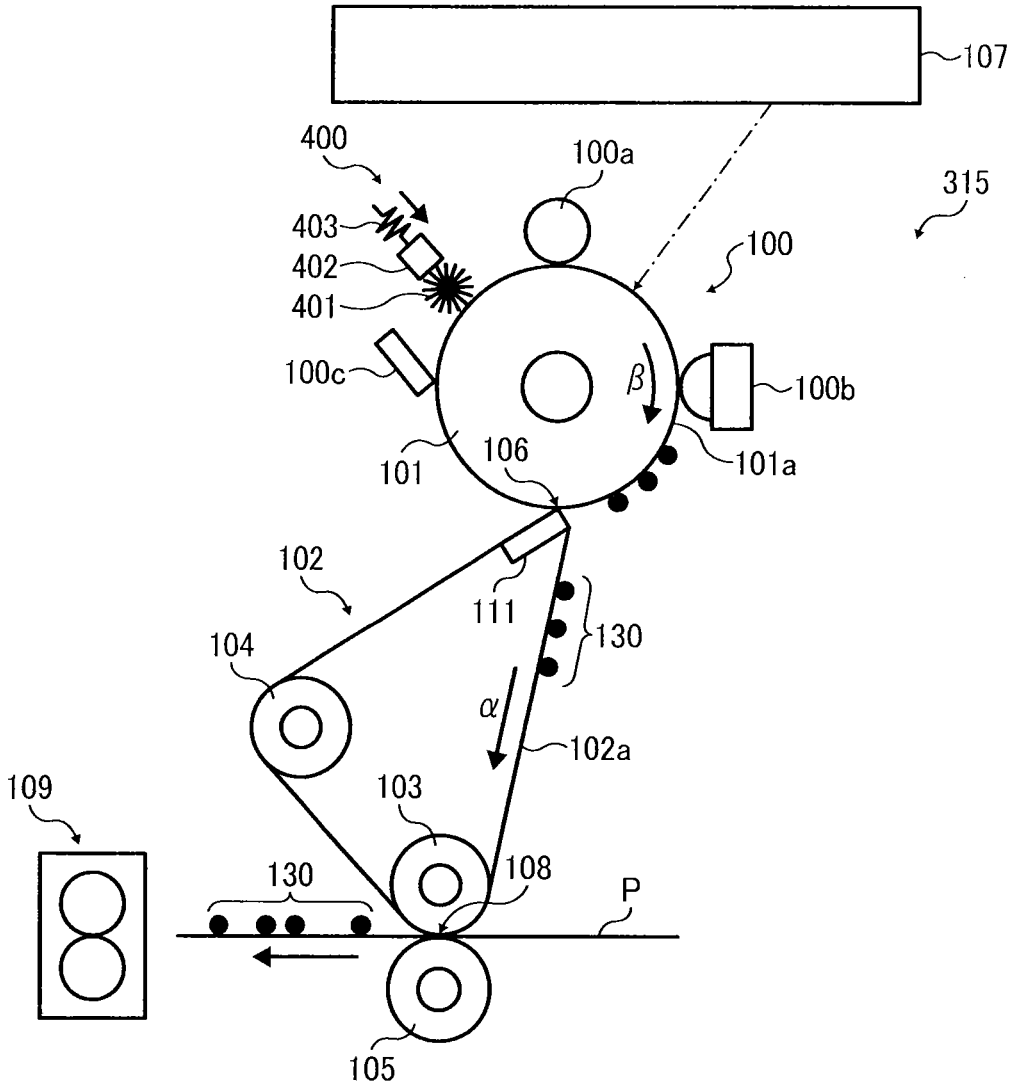
FIG. 23 illustrates an exemplary image transferring system according to a nineteenth embodiment of the present invention.

Now, a nineteenth embodiment of the present invention is described with reference to FIG. 23. As shown in FIG. 23, this embodiment additionally includes the protecting device 400 beside the image transferring system 315 of the fifteenth embodiment as described above with reference to FIG. 16. The protecting device 400 includes a solid lubricant 402 as a protecting member, a coating roller 401 to coat the solid lubricant 402 onto the surface 101*a* of the photoconductor as a coating member, and a spring 403 to urge the solid lubricant 402 toward the coating roller 401 as a biasing member. In this embodiment, the surface 101*a* of the photoconductor contacts the surface 102*a* of the intermediate transfer member 102 at the primary transfer section.

The coating roller 401 is placed on the downstream side of the cleaning system 100 and the upstream side of the primary transfer section 106 in a rotational direction of the photoreceptor 101. The coating roller 401 is configured to contact the surface 1*a* of the image bearer 1 either with or without pressure, and is thereby driven and rotated between the cleaning system 100 and the primary transfer section 106.

With such a configuration of the protecting device 400, the lubricant 402 pressed by spring power of the spring 403 against the coating roller 401 that is driven and rotated as the image bearer 1 rotates and moves is chipped off and coated onto the surface 101*a* of the photoconductor by the coating roller 401. For this reason, since the surface 101*a* of the photoconductor is protected, transfer performance transferring an image from the surface 101*a* of the photoconductor to the intermediate transfer member surface 102*a* can be upgraded. Further, since the protecting device 400 coats the surface 101*a* of the photoconductor with the lubricant 402 after the cleaning system 100*c* cleans thereof, the cleaning system 100*c* does not scrape off the lubricant 402 before it reaches the primary transfer section 106, and accordingly, coating efficiency can be preferably maintained.

Figure 24:
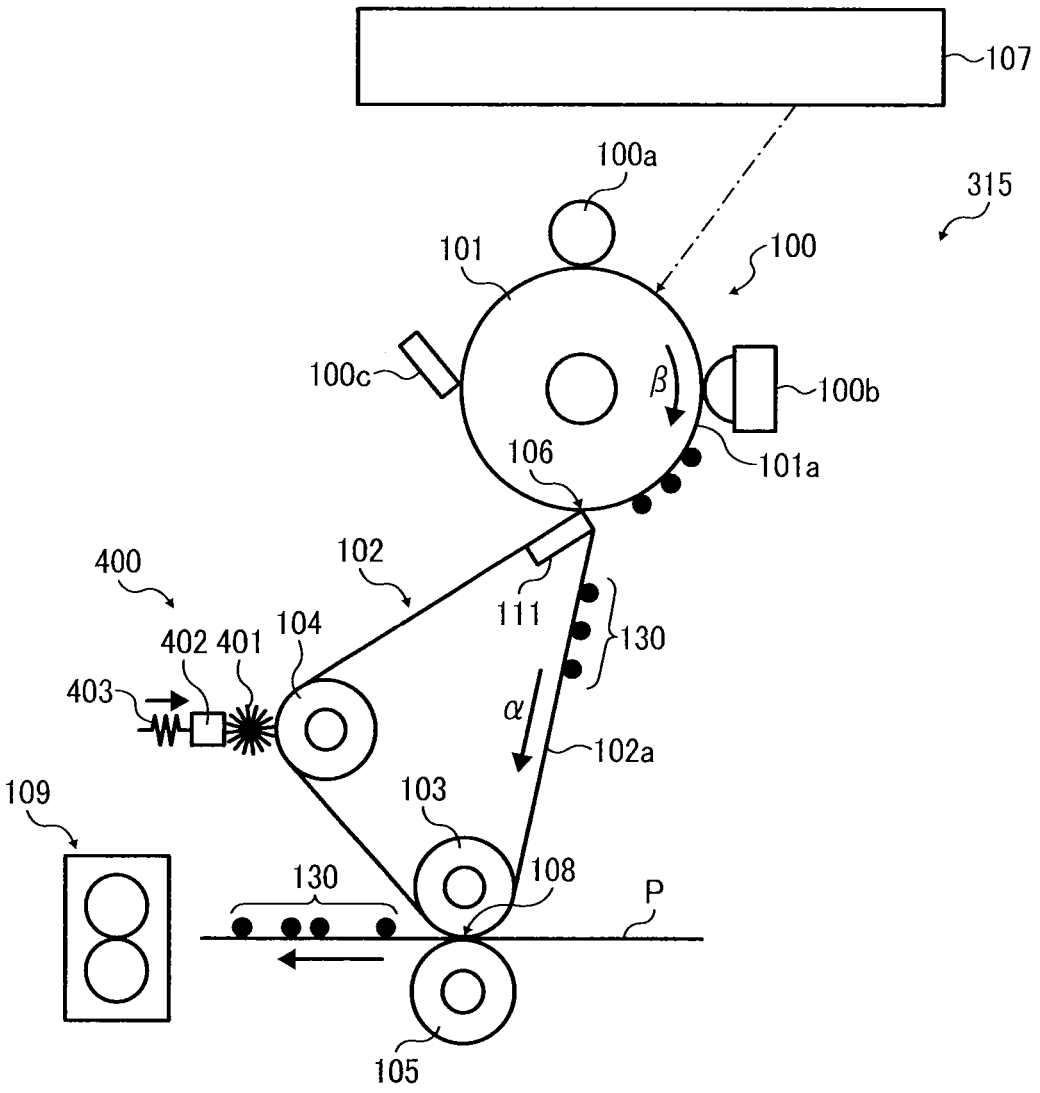
FIG. 24 illustrates an exemplary image transferring system according to a twelfth embodiment of the present invention.

Now, a twentieth embodiment of the present invention is described with reference to FIG. 24. As shown in FIG. 24, this embodiment includes a configuration prepared by additionally providing the protecting device 400 that includes the coating roller 401, the lubricant 402, and the spring 403 to the surf 102*a* of the intermediate transfer member 102 included in the image transferring system 315 of the fifteenth embodiment as described above with reference to FIG. 16. In this embodiment, the coating roller 401 is placed upstream of the primary transfer section 106 in a rotational direction of the intermediate transfer member 102 contacting the surface 102*a* of the intermediate transfer member 102 either with or without pressure and is driven and rotated at an opposed position to the roller 104. With such a configuration of the protecting device 400, the lubricant 402 pressed by spring power of the spring 403 against the coating roller 401 that is driven and rotated as the intermediate transfer member 102 moves is chipped off and coated onto the surface 102*a* of the intermediate transfer member 102 by the coating roller 401. For this reason, since the surface 102*a* of the intermediate transfer member 102 is protected, transfer performance transferring an image from the intermediate transfer member 102 to the transfer sheet P can be upgraded.

Figure 25:
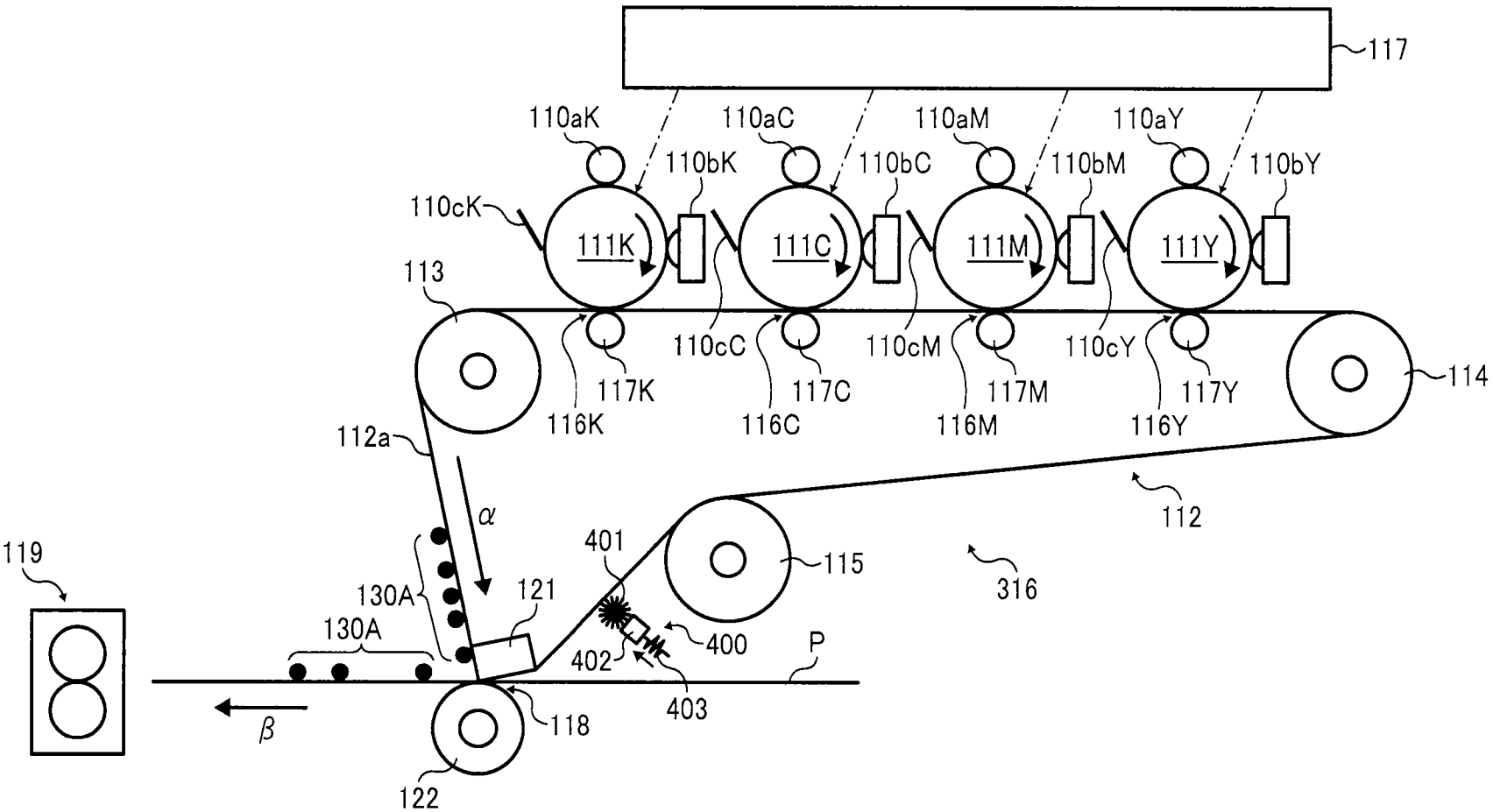
FIG. 25 illustrates an exemplary image transferring system according to a twenty-first embodiment of the present invention.

Now, a twenty-first embodiment of the present invention is described with reference to FIG. 25. As shown in FIG. 25, this embodiment additionally includes the protecting device 400 that includes the coating roller 401, the lubricant 402, and the spring 403 to the image transferring system 316 of the sixteenth embodiment as described above with reference to FIG. 17. The coating roller 401 is placed downstream of the secondary transfer section 118 in a rotating direction of the intermediate transfer member 112 while contacting the surface 102*a* of the intermediate transfer member 112 either with or without pressure, and is configured to be driven and rotated as the intermediate transfer member 112 moves. With such a configuration of the protecting device 400, the lubricant 402 pressed by spring power of the spring 403 against the coating roller 401 that is driven and rated as the intermediate transfer member 112 moves is chipped off and coated onto the surface 112*a* of the intermediate transfer member 112 by the coating roller 401. For this reason, since the surface 112*a* of the intermediate transfer member 112 is protected, transfer performance transferring an image from the intermediate transfer member 112 to the transfer sheet P can be upgraded.

Figure 26:
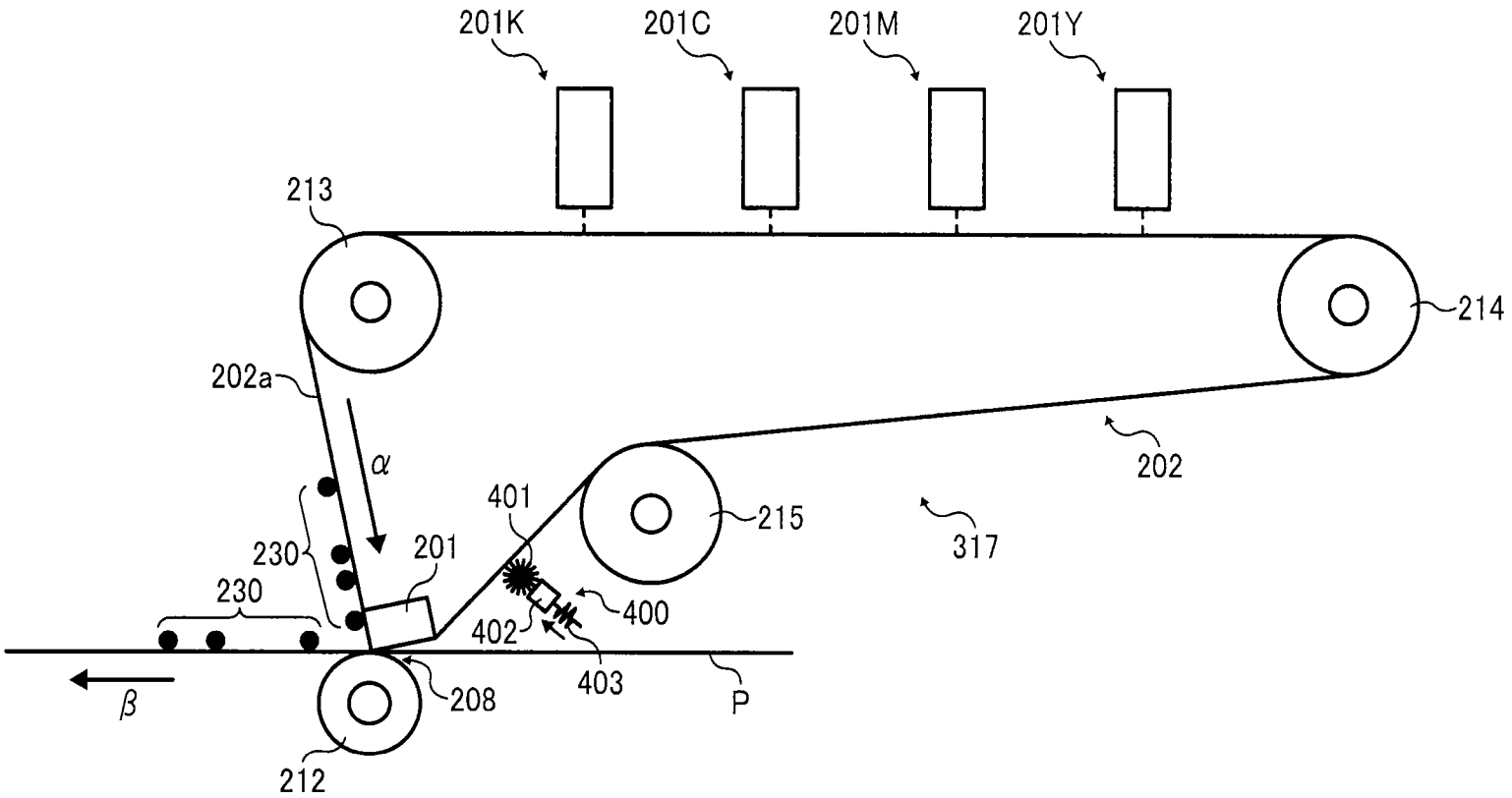
FIG. 26 illustrates an exemplary image transferring system according to a twenty-second embodiment of the present invention.

Now, a twenty-second embodiment of the present invention is described with reference to FIG. 26. As shown in FIG. 26, this embodiment additionally includes the protecting device 400 that includes the coating roller 401, the lubricant 402, and the spring 403 to the image transferring system 316 of the seventeenth embodiment as described above with reference to FIG. 18. The coating roller 401 is placed downstream of the secondary transfer section 208 in a moving direction of the transfer belt 202 while contacting the surface 202*a* of the transfer belt 202 either with or without pressure, and is configured to be driven and rotated as the transfer belt 202 moves. With such a configuration of the protecting device 400, the lubricant 402 pressed by spring power of the spring 403 against the coating roller 401 that is driven and rotated as the transfer belt 202 moves is chipped off and coated onto the surface 202*a* of the transfer belt 202 by the coating roller 401. For this reason, since the surface 202*a* of the transfer belt 202 is protected, transfer performance transferring an image from the transfer belt 202 to the transfer sheet P can be upgraded.

As the above-described protecting member 402, the below described material can be employed. As organic compound, fluoropolymer resin, such as polytetrafluoroethylene (PTFE), poly perfluoro alkyl ether (PFA), perfluoro ethylene-perfluoropropylene copolymers (FEP), polyvinylidene fluoride (pvdf), ethylene-tetrafluoroethylene copolymer (ETFE), fluorinated waxes, silicone resin, such as polymethyl silicone, polymethyl phenyl silicone, etc., silicone based waxes, and grease or the like are exemplified. Further, as member to be a typical fatty acid metal salt and a fatty acid from which hydrophobic metal salt is steadily extracted, caproic acid, caprylic acid, enanthylic acid, pelargonic acid, undecylic acid, lauric acid, myristic acid, palmitic acid, margarine, stearic acid, arachidic acid, behenic acid, palmitoleic acid, olay acid, ricinoleates, petroselinic acid, vaccenic acid, linoleic acid, linolenic acid, eleostearic acid, parinaric acid, gadoleic acid, arachidonic acid, whale oil acid, and these mixture or the like are exemplified. Further, as metalic salt of the above described member, stearic acid barium, lead stearate, stearic acid iron, stearic acid nickel, cobalt stearate, stearic acid copper, stearic acid strontium, calcium stearate, cadmium stearate, magnesium stearate, stearic acid zinc, oleic acid zinc, oleic acid magnesium, oleic acid iron, oleic acid cobalt, oleic acid copper, oleic acid leads, oleic acid manganese, palmitic acid zinc, palmitic acid cobalt, palmitic acid lead, palmitic acid magnesium, palmitic acid aluminium, palmitic acid calcium, caprylic acid lead, capric acid lead, linolenic acid zinc, linolenic acid cobalt, linolenic acid calcium, ricinoleic acid zinc, ricinoleic acid cadmium, and a mixture of these member or the like are exemplified. Further, as inorganic lubricant, mica, boron nitride, molybdenum disulfide, tungsten disulfide, talc, kaolin, montmorillonite, calcium fluoride, and graphite or the like are exemplified. However, the inorganic lubricant is not limited to the above-described member.

Figure 27:
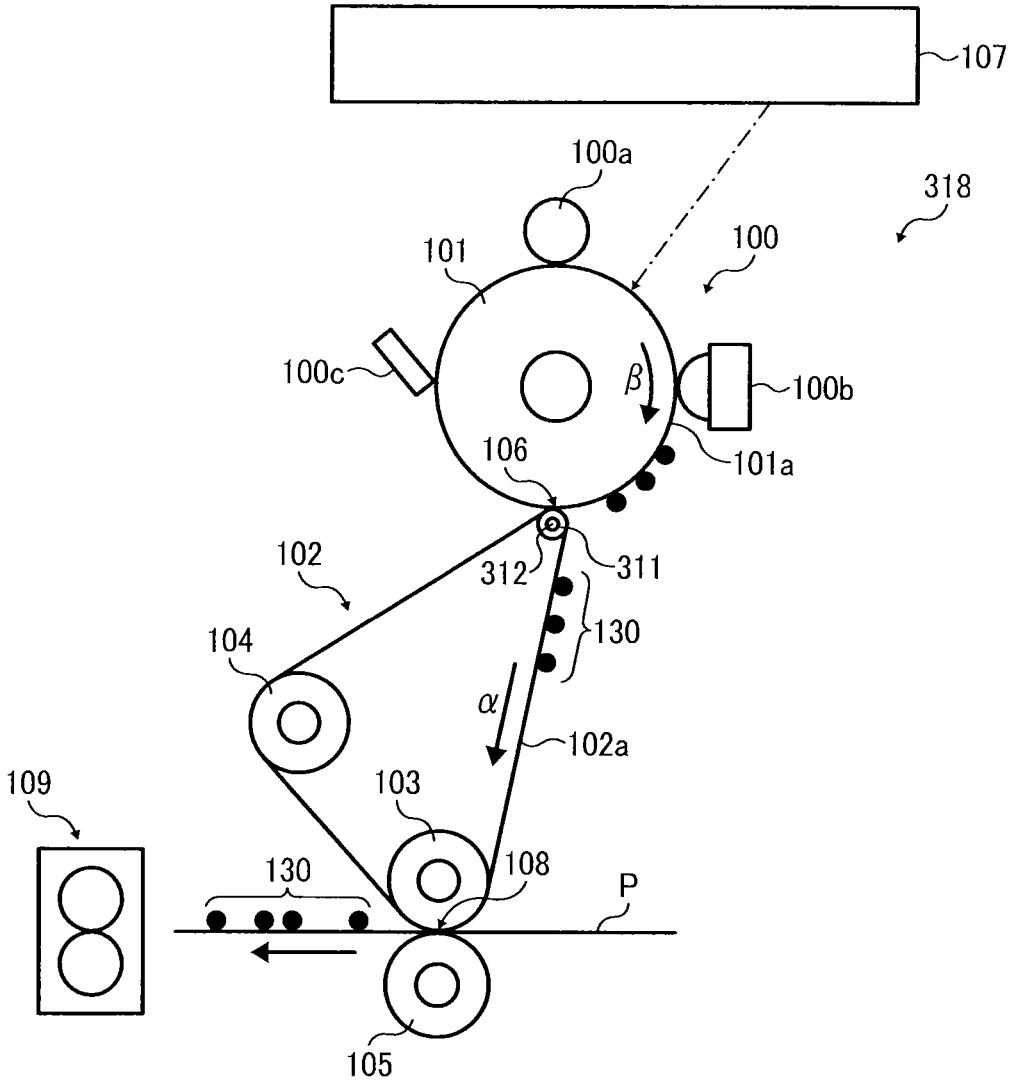
FIG. 27 is a diagram illustrating an exemplary image transferring system that employs a rotary member as the contacting member according to a twenty-third embodiment of the present invention.

Now, a twenty-third embodiment of the present invention is described with reference to FIG. 27. As shown in FIG. 27, this embodiment is an image transferring system 318 that employs a cylindrical contacting member 311 rotatably supported by a supporting axis 312 as a rotor in place of the contacting member 311 as employed in the fifteenth embodiment as described with reference to FIG. 16. Since the rotating contacting member 311 is a rotator like this, it is driven by the intermediate transfer member 102, a sliding friction caused by the intermediate transfer member 102 can be likely neglected. Accordingly, durability of the intermediate transfer member 102 can be upgraded while reducing driving force needed to drive the intermediate transfer member 102. Further, with the rotating contacting member 311 as the rotator, transferability can be ensured by enlarging the curvature of its outer circumferential surface. Accordingly, to enlarge the curvature of its outer circumferential surface, a diameter of the contacting member 311 is preferably reduced.

Figure 28:
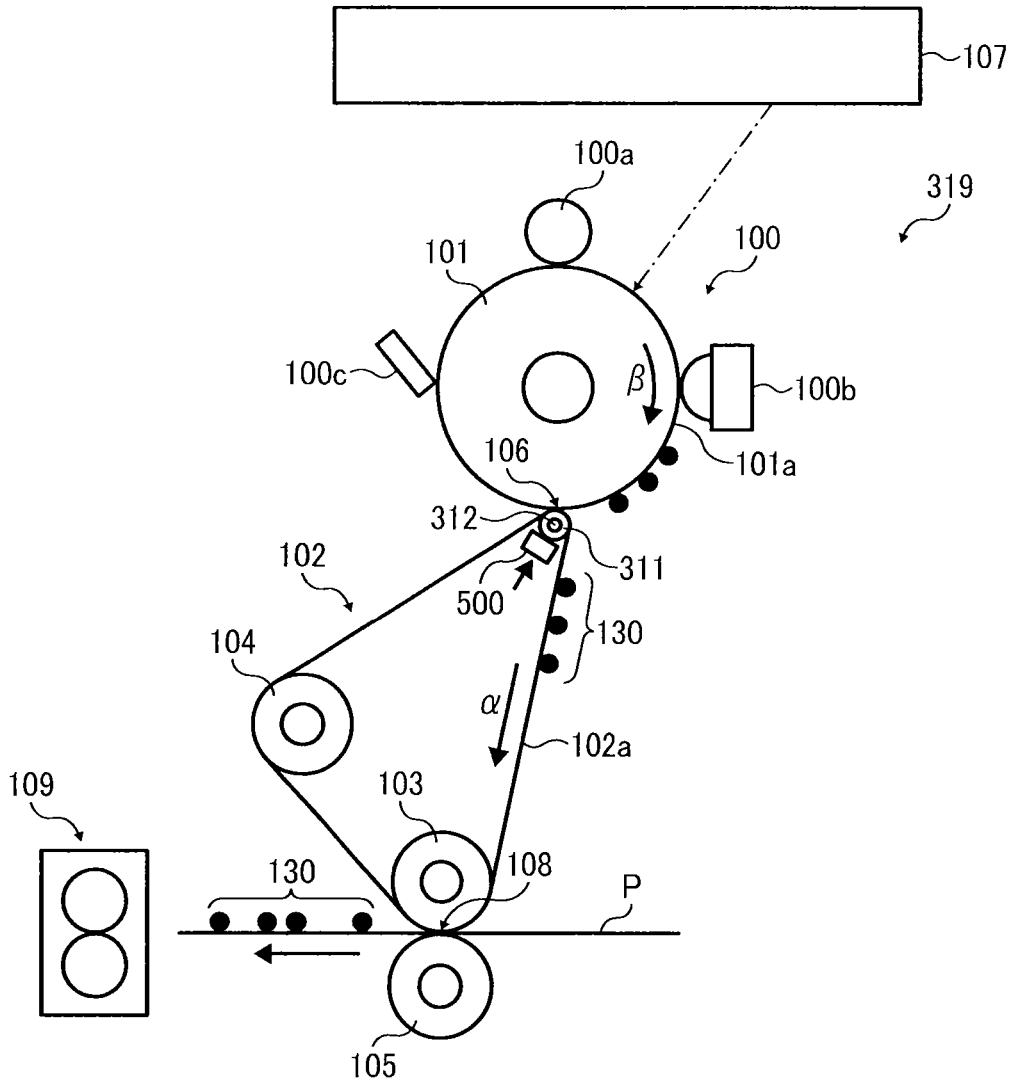
FIG. 28 is a diagram illustrating an exemplary image transferring system that employs a backup device that backs up the contacting member according to a twenty-fourth embodiment of the present invention.

Now, a twenty-fourth embodiment of the present invention is described with reference to FIG. 28. As shown in FIG. 28, this embodiment is an image transferring system 319 with a backup member 500 to suppress deflection of the contacting member 311 having the small diameter configured as the rotor as described in the fifteenth embodiment. As described earlier, with the rotating contacting member 311 as the rotator having the small diameter and curvature, transferability can be enhanced. However, since the contacting member 311 totally becomes thinner, strength of the contacting member 311 itself is degraded, and accordingly, easy to deflect. For this reason, it is expected that the contacting member 311 hardly steadily contacts the intermediate transfer member 102 (i.e., a nip) in the throughout region of the contacting member 311 extending in its rotational axis direction.

Subsequently, by placing the rotatable contacting member 311 between the interim transfer section 102 and the backup member 500 and thereby sandwiching the contacting member 311 with both parties, a contacting condition (i.e., a nip) of the intermediate transfer member 102 is stabilized while suppressing the deflection of the contacting member 311. The backup member 500 is placed on an opposite side of a abut section 106 to serve as a regulatory member to regulate movement of the contacting member 311 in a direction to separate from the intermediate transfer member 102. Here, the direction to separate from the intermediate transfer member 102 indicates a direction in which the contacting member 311 deflects. Specifically, the strength of the contacting member 311 can be supplemented by bringing the backup member 500 in contact with a backside of the contacting member 311, so that the contacting condition (i.e., the nip) can be stabilized while upgrading the transferability therein even if the thin contacting member 311 is used and tends to deflects from the intermediate transfer member 102. The backup member 500 is attached to a base of the image transferring system 319 to be able to continuously contact an outer circumferential surface 311*a* of the contacting member 311. Otherwise, the backup member 500 can be given biasing force by a spring or the like to be able to contact the outer circumferential surface 311*a* of the contacting member 311 with pressure.

Figure 29A:
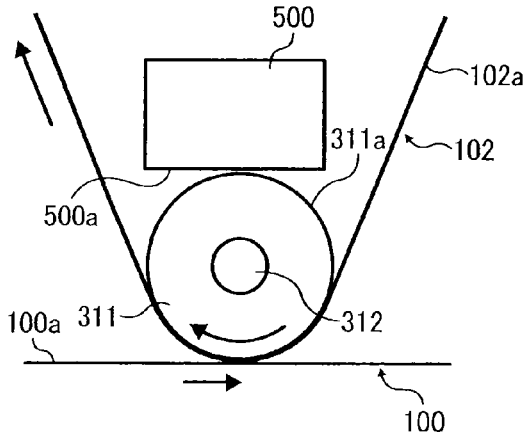
FIG. 29A is an enlarged view illustrating an exemplary contacting condition when the backup member and the contacting member contact each other via a flat surface according to one embodiment of the present invention.

Here, as shown in FIG. 29A, the backup member 500 is shaped like a rectangular parallelepiped or a cubic block member so that at least a contacting surface 500*a* thereof contacting the outer circumferential surface 311*a* of the contacting member 311 is flat. Hence, with the flat contacting surface 500*a* of the backup member 500, which contacts the outer circumferential surface 311*a* of the contacting member 311, a contacting condition becomes upgraded while more preferably suppressing the deflection of the contacting member 311.

Figure 29B:
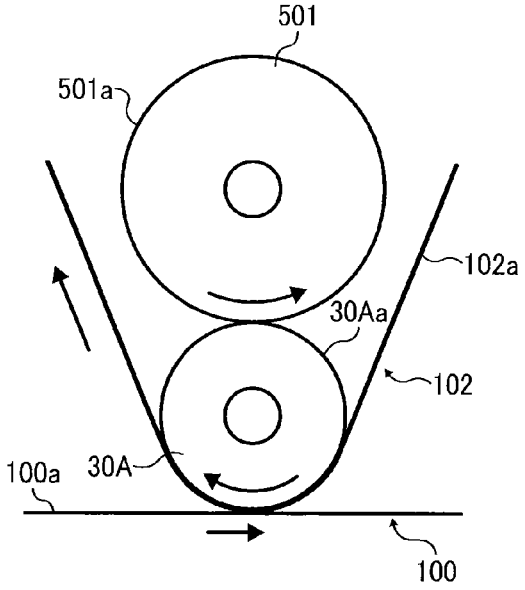
FIG. 29B is also an enlarged view illustrating an exemplary contacting condition when a rotary backup member and the contacting member contact each other according to one embodiment of the present invention.

Further, as shown in FIG. 29B, the backup member can be a rotor 501 with its surface 501*a* contacting the outer circumferential surface 311*a* of the contacting member 311 as well. With such a backup member of the rotor 501, since the backup member is driven and rotated as the contacting member 311 moves, sliding friction caused between the contacting member 311 can be likely prevented while minimizing abrasion of the contacting member 311 as an advantage.

Figure 29C:
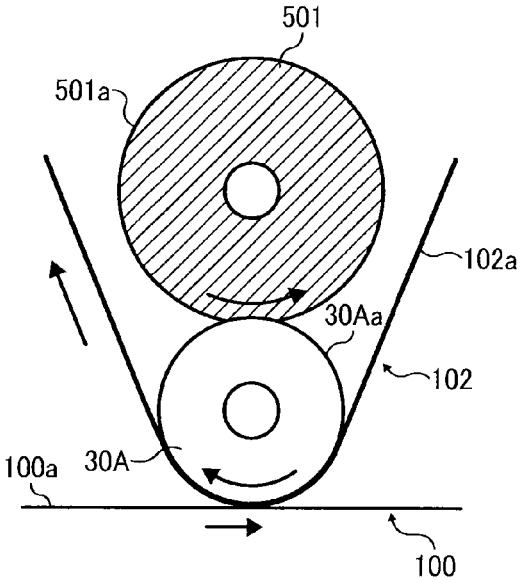
FIG. 29C is also an enlarged view illustrating an exemplary contacting condition when a deformable backup member and the contacting member contact each other according to one embodiment of the present invention.

Further, when the backup member is configured by a rotor 501, it can be composed of an elastic member such as an elastic roller as shown in FIG. 29C. In such a situation, vibration of the rotor 501 of the backup member and the contacting member 311 can be absorbed minimizing a vibration problem.

Figure 30A:
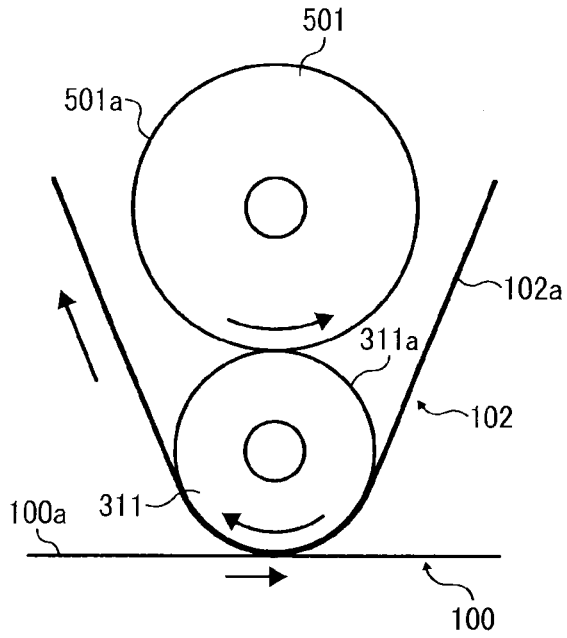
FIG. 30A is also an enlarged view illustrating an exemplary contacting condition when the rotary backup member is driven and rotated as the contacting member rotates according to one embodiment of the present invention.
Figure 30B:
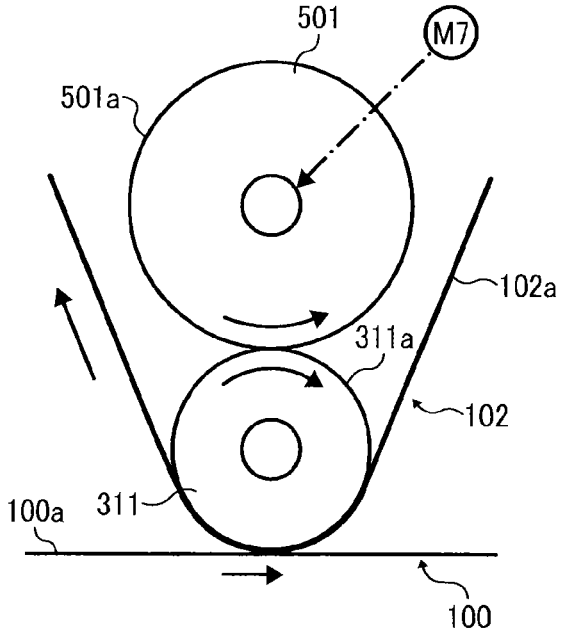
FIG. 30B is also an enlarged view illustrating an exemplary contacting condition when the rotary backup member is driven according to one embodiment of the present invention.

Further, as shown in FIG. 30A, when the rotor 501 contacts the contacting member 311 while separating from the intermediate transfer member 102, the rotor 501 is together rotated by the contacting member 311 driven and rotated by the intermediate transfer member 102. Because of this, fewer loads are posed on rotation and movement of the intermediate transfer member 102 and the contacting member 311, respectively, and accordingly, sliding friction caused thereon can be minimized even with a simple structure, so that the contacting member 311 can more effectively prevent its abrasion. Further, with the configuration of FIG. 30A, because the rotor 501 is rotated by friction force generated by the contacting member 311, it acts as a burden to rotation of the contacting member 311 and eventually movement of the intermediate transfer member 102 and its driving system. Because of this, as shown in FIG. 30B, the rotor 501 may be driven and rotated by a driving motor M7 in the same direction as the contacting member 311 at the opposed position thereto with a line velocity of the outer circumferential surface 501*a* being substantially the same as a line velocity of the outer circumferential surface 311*a* of contacting member 311. Hence, by rendering the rotor 501 functioning as a backup roller to be driven and rotated like this, the burden to rotation and movement of the contacting member 311 and the intermediate transfer member 102, respectively, is reduced, and reduction of the sliding friction can be ensured. As a result, the abrasion of the contacting member 311 can be more likely effectively prevented as an advantage.

Figure 30C:
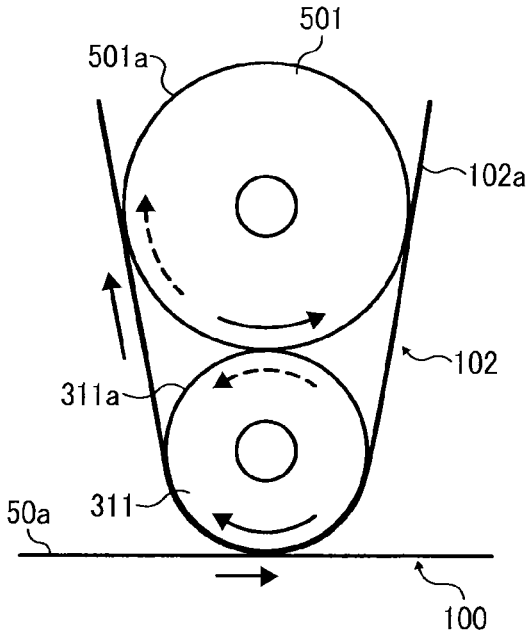
FIG. 30C is also an enlarged view illustrating an exemplary contacting condition when the rotary backup member is rotated by a cleaning member according to one embodiment of the present invention.

Otherwise, as shown in FIG. 30C, the rotor 501 is not driven by the driving motor M7, and is rather driven by the intermediate transfer member 102. Specifically, the intermediate transfer member 102 is brought in contact with the surface 501*a* of the rotor 501 to transmit its driving force to the rotor 501. In such a situation, rotational directions of the rotor 501 and the contacting member 311 are determined by a largeness of friction forces caused between the rotor 501 and the contacting member 311 and that caused between the contacting member 311 and the intermediate transfer member 102. Because of this, there exist two rotational directions for the contacting member 311 and the rotor 501. That is, both parties are driven and rotated by the intermediate transfer section 102 as shown by solid line arrows, and neither of parties is driven nor rotated by the intermediate transfer section 102. Specifically, each of these parties reversely rotates as shown by dashed line arrows in the drawing. However, because the rotor 501 can obtain drive power without relying on the driving motor M7, it can help to simplify a configuration of the system. Further, since a cleaning member 10 (the intermediate transfer member 102) is arranged contacting the rotor 501, an installation area of the intermediate transfer member 102 can be narrower while downsizing the system in comparison with a system in which the intermediate transfer member 102 does not contact the rotor 501.

Figure 31A:
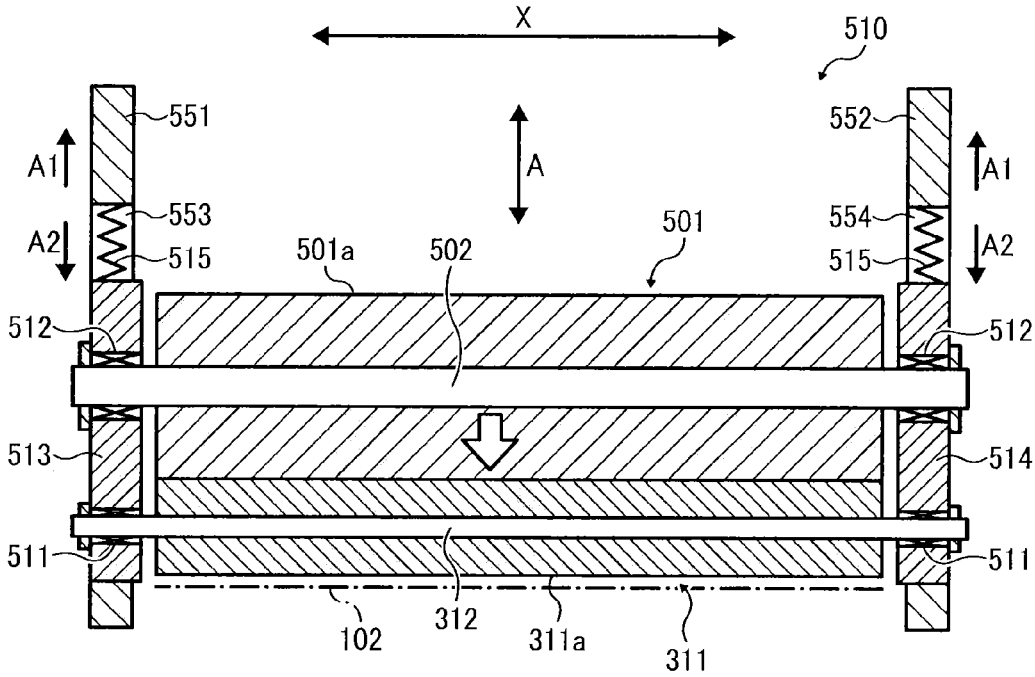
FIG. 31A is a front view illustrating an exemplary supporting mechanism that supports the contacting member and the backup member according to one embodiment of the present invention.
Figure 31B:
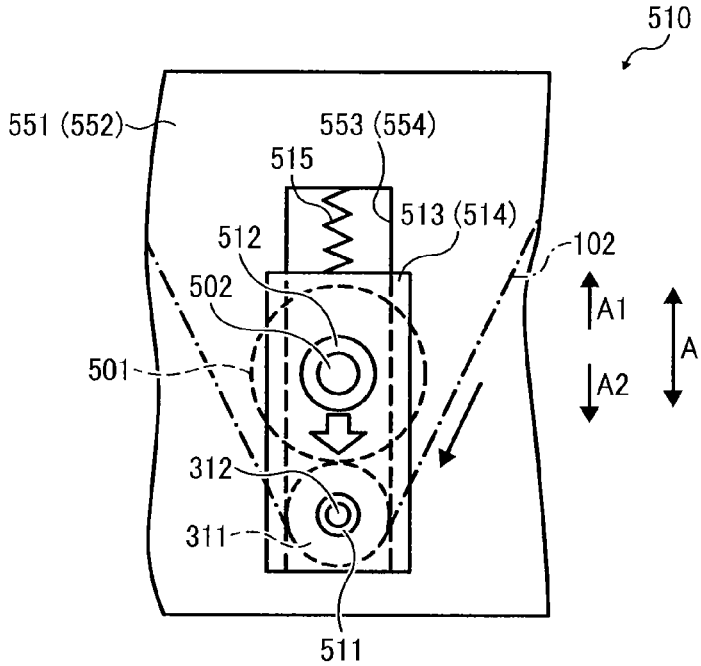
FIG. 31B is a cross-sectional view illustrating the exemplary supporting mechanism that supports the contacting member and the backup member according to one embodiment of the present invention.

Now, a supporting structure 510 that supports the contacting member 311 composed of a rotor and the rotor 501 as the rotatable backup member is described with reference to FIGS. 31A and 31B. The supporting structure 510 shown in FIGS. 31A and 31B supports the rotor 501 and the contacting member 311 in pressure contact with each other and maintains a distance between axes of both parties to be constant while enabling these parties to integrally move in approaching and separating directions to and from the intermediate transfer member 102. Here, it is supposed that one of approaching and separating directions A indicates a deflecting direction A1 in which the contacting member 311 deflects, and an opposite direction thereto indicates a biasing direction A2 in which it is biased toward the intermediate transfer member 102. The supporting structure 510 includes a pair of fixed plates 513 and 514 to freely rotatably support both ends of support axes 312 and 502 of the contacting member 311 and the rotor 501 via two pairs of bearings 511, 511, 512, and 512, respectively. The pair of fixed plates 513 and 514 is opposed to each other and freely rotatably support both of the support axes 312 and 502 in parallel to an axial direction with each other. The pair of fixed plates 513 and 514 is movably attached in the approaching and separating directions A and is held within rectangular oblong holes 553 and 554 formed in a pair of side plates 551 and 552 serving as fixing sections fixed to the image transferring system, respectively. The supporting structure 510 includes a pair coil spring 515 and 515 as biasing members to bias the fixed plates 513 and 514 in the biasing direction A2. The pair of coil springs 515 is interposed between a pair of rectangular oblong holes 553 and 554 in the side plates 551 and 552 and the fixed plates 513 and 514, respectively.

With the supporting structure 510 having the configuration like this, since the outer circumferential surface 501*a* of the rotor 501 can be kept in pressure contact with the outer circumferential surface 311*a* of the contacting member 311, deflection of the contacting member 311 can be likely prevented by bringing the backup member 501 in contact with a backside of the contacting member 311, even if the diameter of the contacting member 311 is reduced and accordingly stiffness thereof decreases.

Figure 32A:
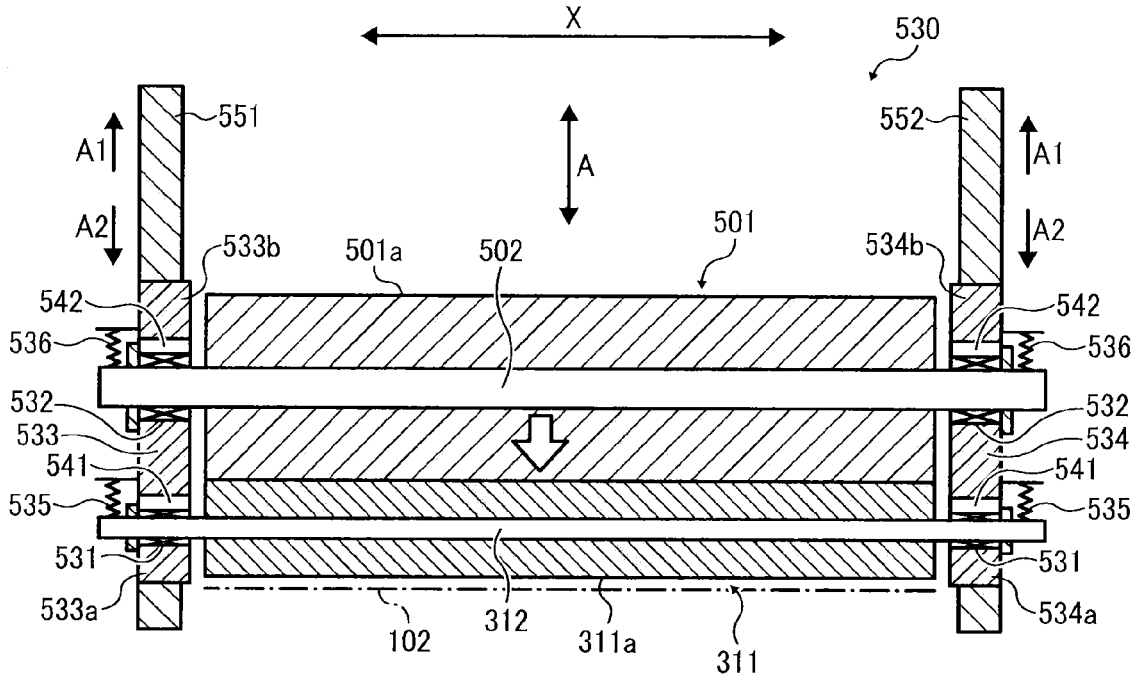
FIG. 32 A is a front view illustrating another exemplary supporting mechanism that supports the contacting member and the backup member according to one embodiment of the present invention.
FIG. 32B is a cross-sectional view illustrating another exemplary supporting mechanism that supports the contacting member and the backup member according to one embodiment of the present invention.
Figure 32B:
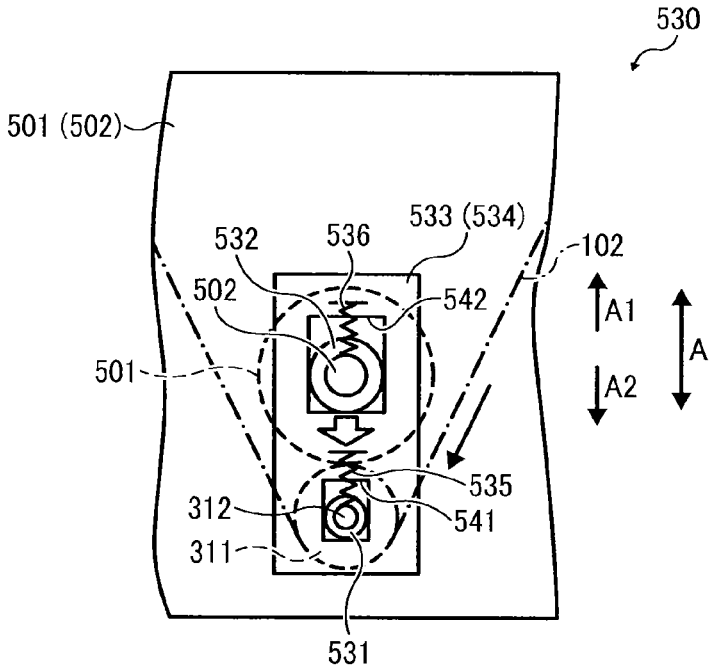

Further, another supporting structure 530 is described with reference to FIGS. 32A and 32B. As shown there, the supporting structure 530 is configured to bring the contacting member 311 in pressure contact with the rotor 501, while allowing a distance between shafts of the contacting member 311 and the rotor 501 to change and be separately movable in an approaching and separating direction A to and from the intermediate transfer member 102. The supporting structure 530 includes a pair of fixed plates 513 and 534 to freely rotatably support both ends of support axes 312 and 502 of the contacting member 311 and the rotor 501 via two pairs of bearings 531, 531, 532, and 532, respectively. The pair of fixed plates 533 and 534 is opposed to each other and freely rotatably support both of the support axes 312 and 502 in parallel to an axial direction with each other. The pair of fixed plates 533 and 534 is held by a pair of side plates 551 and 552 serving as fixing sections to fix the image transferring system, respectively. Further, two pairs of rectangular oblong holes 541, 541, 542, and 542 are formed in the fixed plates 533 and 534 each extending in the approaching and separating directions A. The pair of rectangular oblong holes 541 and 541 are formed at both ends 533*a* and 534*a* of the respective fixed plates 533 and 534 in the biasing direction A2 being opposed to each other. Into the rectangular oblong holes 541 and 541, a pair of bearings 531 and 531 freely rotatably supporting the bearing shaft 312 is movably inserted and is thereby supported in the approaching and separating directions A, respectively. The pair of rectangular oblong holes 542 and 542 is formed at both ends 533*b* and 534*b*, respectively, in the deflecting direction A1 distanced from the pair of rectangular oblong holes 541 and 541 formed in the respective fixed plates 533 and 534, being opposed to each other. Into the rectangular oblong holes 542 and 542, a pair of bearings 532 and 532 freely rotatably supporting the bearing shaft 502 is movably inserted and is thereby supported in the approaching and separating directions A, respectively.

The supporting structure 530 includes two pairs of coil springs 535, 535, 536, and 536 as urging members with the each pair biasing the support axes 312 and 502 in the approaching and separating directions A, respectively. Respective ends of the pair of coil springs 535 and 535 are fixed to the fixed plates 533 and 534 to bias both ends of the supporting shaft 312 in the biasing direction A2. Similarly, respective ends of the pair of coil springs 536 and 536 are fixed to the fixed plates 533 and 534 to bias both ends of the supporting shaft 502 in the biasing direction A2.

With the supporting structure 530 having the configuration like this, since the outer circumferential surface 501*a* of the rotor 501 can be kept in pressure contact with the outer circumferential surface 311*a* of the contacting member 311, deflection of the contacting member 311 can be likely prevented by bringing the backup member 501 in contact with a backside of the contacting member 311 even if the diameter of the contacting member 311 is reduced and accordingly stiffness thereof decreases. Hence, the above-described supporting mechanisms 510 and 530 support the rotor 501 and the cylindrical contacting member 311. However, instead of the rotor 501, a block shaped backup member 500 can be supported together with the contacting member 311 as well.

Now, yet another embodiment of the present invention applied to a cleaning system is described with reference to FIGS. 33 to 52B, wherein a cleaning system is described first and an image forming apparatus with the cleaning system is described the next.

Figure 33:
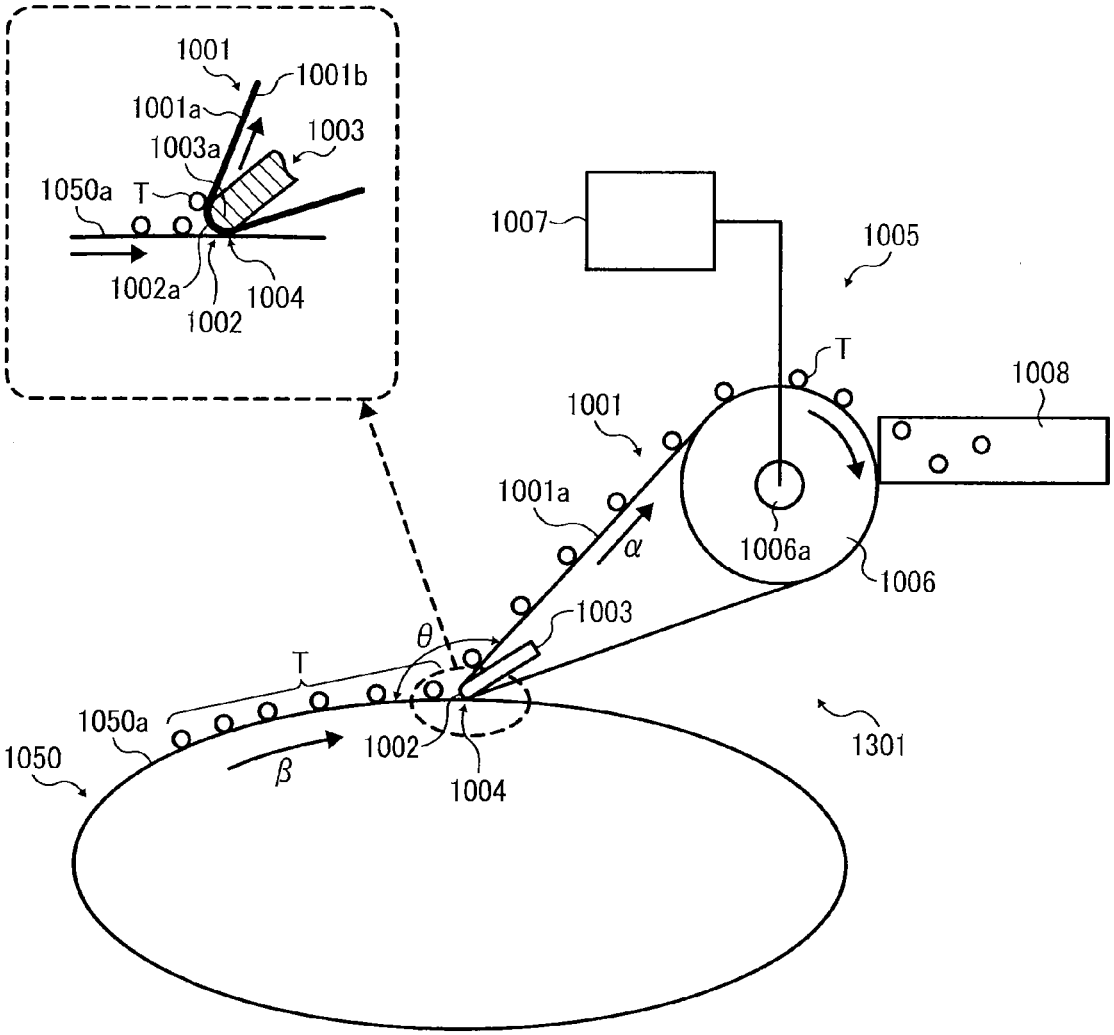
FIG. 33 illustrates an exemplary cleaning system according to a twenty-fifth embodiment of the present invention.

Initially, a twenty-fifth embodiment of the present invention is described with reference to FIG. 33. As shown in FIG. 33, a cleaning system 1301 collects adhering substances T adhering onto a surface 1050*a* (herein below, simply referred to as a surface 1050*a* of the image bearer 1050) of a rotatably moving image bearer by bringing a surface 1001*a* of an endless belt cleaning member 1001 as a collecting surface in contact with the surface 1050*a* of the image bearer 1050. The cleaning member 1001 includes a collecting surface 1001*a* therearound and partially includes an edge section 1002 to contact the surface 1050*a* of the image bearer 1050 via the collecting surface 1001*a*. Inside a loop of the cleaning member 1001, a plate like contacting member 1003 is positioned to bring the collecting surface 1001*a* in pressure contact with the surface 1050*a* of the image bearer 1050. The edge section 1002 provides a cylindrical surface 1002*a*, because a tip 1003*a* of the contacting member 1003 is brought in pressure contact with an inner surface 1001*b* of the cleaning member 1001 located opposite the collecting surface 1001*a*.

Here, a moving system 1005 is provided to move the collecting surface 1001*a* of the cleaning member 1001 in a contacting section 1004, in which the surface 1050*a* of the image bearer 1050 and the collecting surface 1001*a* contact each other, in a direction, in which the adhering substances T on the surface 1050*a* of the image bearer 1050 does not pass through the contacting section 1004. The moving system 1005 is composed of a roller 1006, around which the cleaning member 1001 is wound, and a driving motor 1007 as a driving device that drives and rotates a driving shaft 6*a* that supports the roller 1006. The cleaning member 1001 is stretched by the roller 1006 and the contacting member 1003 therebetween, and is rotated with it being brought in either normal contact or preferably pressure contact with the image bearer 1050, when driving force is communicated from a driving motor 1007 to a driving shaft 6*a* of the roller 1006 and finally the roller 1006 to drive and rotate thereof. Here, a tension is provided to the cleaning member 1001 by widening a distance between positions of the roller 1006 and the contacting member 1003 while winding it therearound. Otherwise, the tension is provided to the cleaning member 1001 by applying biasing force to one of the roller 1006 and the contacting member 1003 using a prescribed biasing member such as a spring, etc., not shown. In this embodiment, the image bearer 1050 and the cleaning member 1001 also rotate clockwise as well in the drawing, so that moving directions of the collecting surface 1001*a* and the surface 1050*a* of the image bearer 1050 are opposite to each other in the contacting section 1004. Thus, as shown in FIG. 33, in the contacting section 1004, the surface 1050*a* of the image bearer 1050 moves from left to right. Whereas, the collecting surface 1001*a* moves from right to left, by contrast.

Further, as shown there, a shape of the cleaning member 1001 wound around the roller 1006 and the contacting member 1003 includes a sharp angle (i.e., the cleaning member 1001 becomes thinner) at a position of the contacting member 1003 more than that at a position of the roller 1006. Further, the cleaning member 1001 is disposed so that an angle θ formed by the surface 1050*a* of the image bearer 1050 and the collecting surface 1001*a* of the cleaning member 1001 located downstream of the contacting section 1004 in a moving direction of the cleaning member 1001 becomes obtuse. Further, when the cleaning system 1301 according to this embodiment is applied to an image forming apparatus employing an electronic photography, the image bearer 1050 corresponds to either a photoconductor forming a toner image thereon or an intermediate transfer member, onto a surface of which a toner image is transferred.

The cleaning system 1301 also includes an adhering substance removing system 1008 to remove adhering substances T adhering to the collecting surface 1001*a* therefrom. The adhering substance removing system 1008 slidably contacts the collection side 1*a* at downstream of the contacting section 1004 in a moving direction of the cleaning member 1001, and eliminates the adhering substances T from the collecting surface 1001*a* as the cleaning member 1001 rotates and moves. As the adhering substance removing system 1008, a roller or blade shaped member is utilized.

Here, the applicants prepared and tested a model of the cleaning system 1301 with the above-described configuration by generating adhering substances T on the image bearer 1050. As a result, the applicants have confirmed that the adhering substances T do not pass downstream though the contacting section 1004 contacting the cleaning member 1001 in a rotating direction of the image bearer 1050, and that the adhering substances T are sequentially transferred on to the cleaning member 1001 in a moving direction in which the cleaning member 1001 moves, i.e., a direction in which the adhering substances T do not pass downstream through the contacting section 1004 in the rotating direction of the image bearer 1050. Because of this, the adhering substances T on the image bearer 1050 can be attracted and collected by the cleaning member 1001 without applying a transfer bias to the cleaning member 1001 as applied in a conventional system. Further, since the transfer bias is not used, an electric transfer field, which is generated by the bias, does not vary even if an environmental condition, such as temperature, humidity, etc., changes. Thus, when the adhering substances T are collected from the image bearer 1050 by the cleaning member 1001 thereonto, such a collecting process is rarely affected by the environmental condition. Accordingly, excellent cleaning performance can be obtained. Further, since a transfer bias is not needed, and accordingly, a power source therefor can be omitted, space saving and cost reduction can be readily achieved at the same time.

Figure 34:
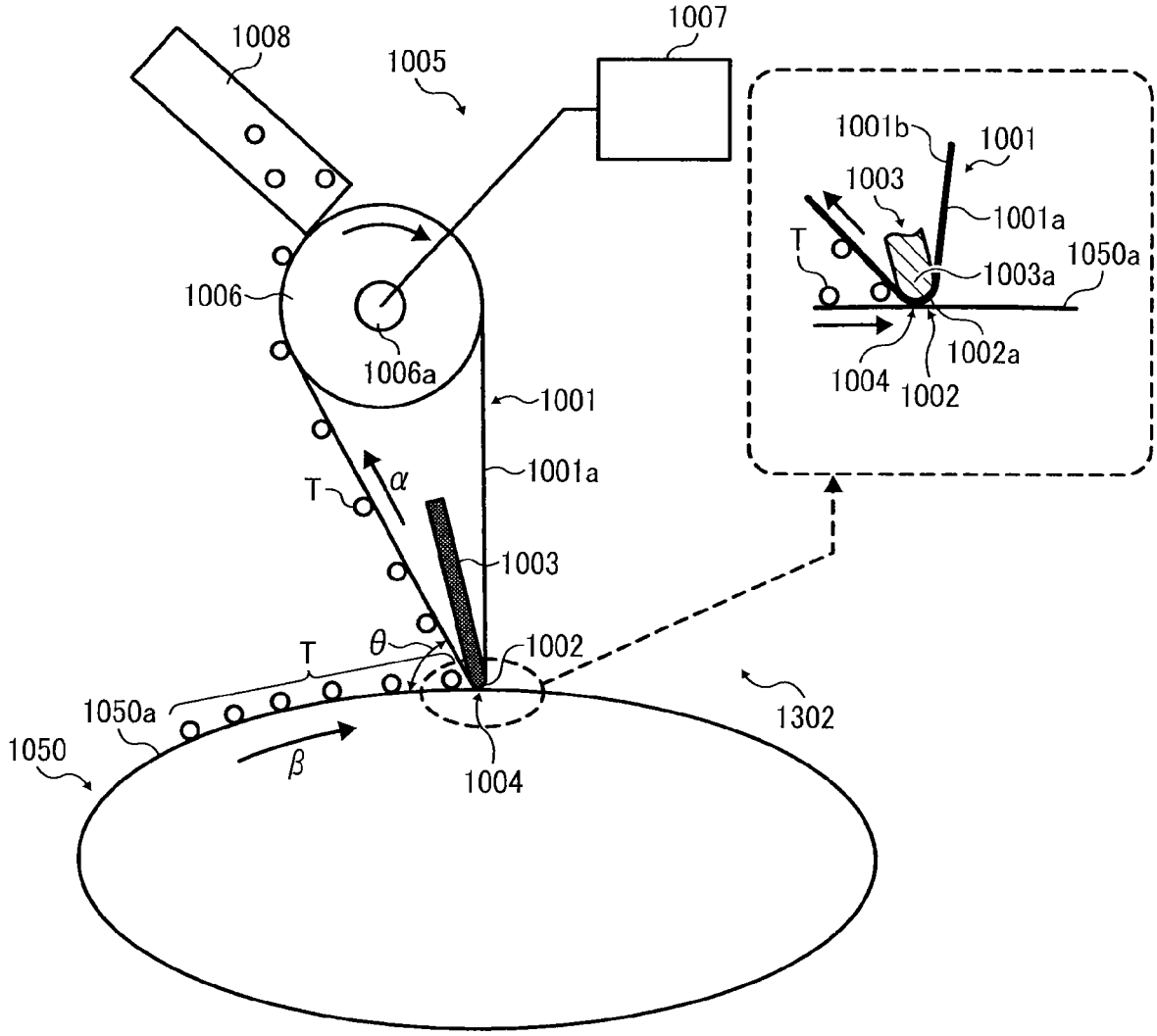
FIG. 34 illustrates an exemplary cleaning system according to a twenty-sixth embodiment of the present invention.

Now, a twenty-sixth embodiment of the present invention is described with reference to FIG. 34. As shown in FIG. 34, a cleaning system 1302 is prepared by horizontally inverting the cleaning system 1301 of the twenty-fifth embodiment around the contacting section 1004 as a symmetrical center. A difference from that of the twenty-fifth embodiment is that the cleaning member 1001 is disposed so that an angle θ formed by the surface 1050*a* of the image bearer 1050 and the collecting surface 1001*a* of the cleaning member 1001 located downstream of the contacting section 1004 becomes sharp rather than obtuse.

Again, the applicants prepared and tested a model of the cleaning system 1302 with the above-described configuration by generating adhering substances T on the image bearer 1050. As a result, similar to the system of the twenty-fifth embodiment, the applicants have confirmed that the adhering substances T do not pass downstream though the contacting section 1004 contacting the cleaning member 1001 in a rotating direction of the image bearer 1050, and that the adhering substances T are sequentially transferred on to the cleaning member 1001 in a moving direction in which the cleaning member 1001 moves, i.e., a direction in which the adhering substances T do not pass downstream through the contacting section 1004 in the rotating direction of the image bearer 1050. Thus, when the adhering substances T are collected from the image bearer 1050 by the cleaning member 1001 thereonto even in the cleaning system 1302 arranged like this, such a collecting process is rarely affected by the environmental condition. Accordingly, excellent cleaning performance can be obtained. Further, since a transfer bias is not needed, and accordingly, a power source therefor can be omitted as well, space saving and cost reduction can be readily achieved at the same time.

Figure 35:
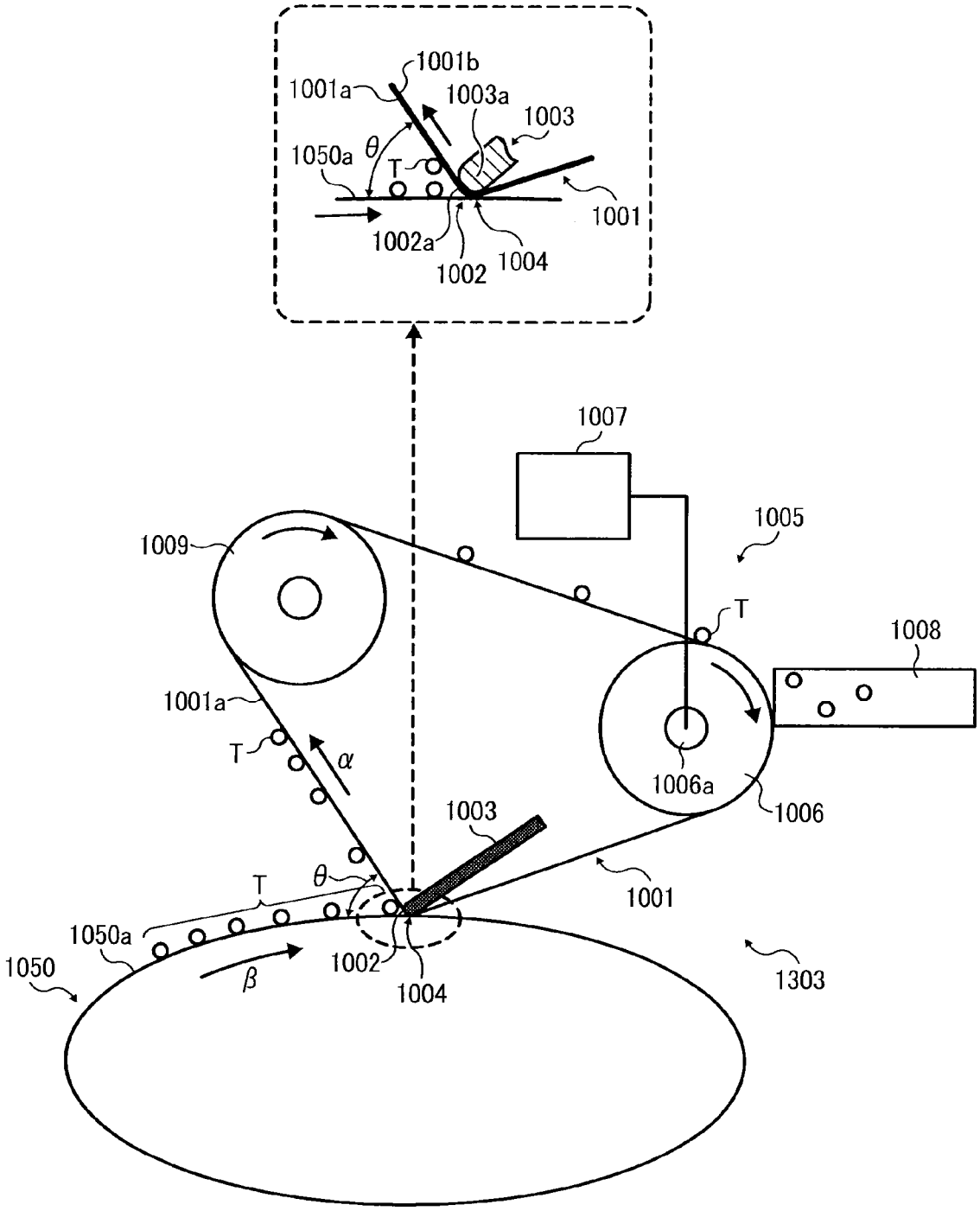
FIG. 35 illustrates an exemplary cleaning system according to a twenty-seventh embodiment of the present invention.

Now, a twenty-seventh embodiment of the present invention is described with reference to FIG. 35. As shown in FIG. 35, a cleaning system 1303 is prepared by adding a roller 1009 to the cleaning system 1301 as described in the twenty-fifth embodiment to stretch the cleaning member 1001 together with the roller 1009 and the contacting section 1003. Further, a shape of the cleaning member 1001 as a whole thus stretched and wound around the rollers 1006 and 1009 and the contacting section 1003 includes an obtuse angle at a position of the contacting member 1003. Further, the cleaning member 1001 is disposed to render an angle θ formed by the surface 1050*a* of the image bearer 1050 and the collecting surface 1001*a* of the cleaning member 1001 located downstream of the contacting section 1004 to be sharp.

Again, the applicants prepared and tested a model of the cleaning system 1303 with the above-described configuration by generating adhering substances T on the image bearer 1050. As a result, similar to the system of the twenty-fifth embodiment, the applicants have confirmed that the adhering substances T do not pass downstream though the contacting section 1004 contacting the cleaning member 1001 in a rotating direction of the image bearer 1050, and that the adhering substances T are sequentially transferred on to the cleaning member 1001 in a moving direction in which the cleaning member 1001 moves, i.e., a direction in which the adhering substances T do not pass downstream through the contacting section 1004 in the rotating direction of the image bearer 1050. Thus, when the adhering substances T are collected from the image bearer 1050 by the cleaning member 1001 thereonto even in the cleaning system 1303 arranged like this, such a collecting process is rarely affected by the environmental condition. Accordingly, excellent cleaning performance can be obtained. Further, since a transfer bias is not needed, and accordingly, a power source can be omitted as well, space-saving and cost reduction can be readily achieved at the same time.

Figure 36:
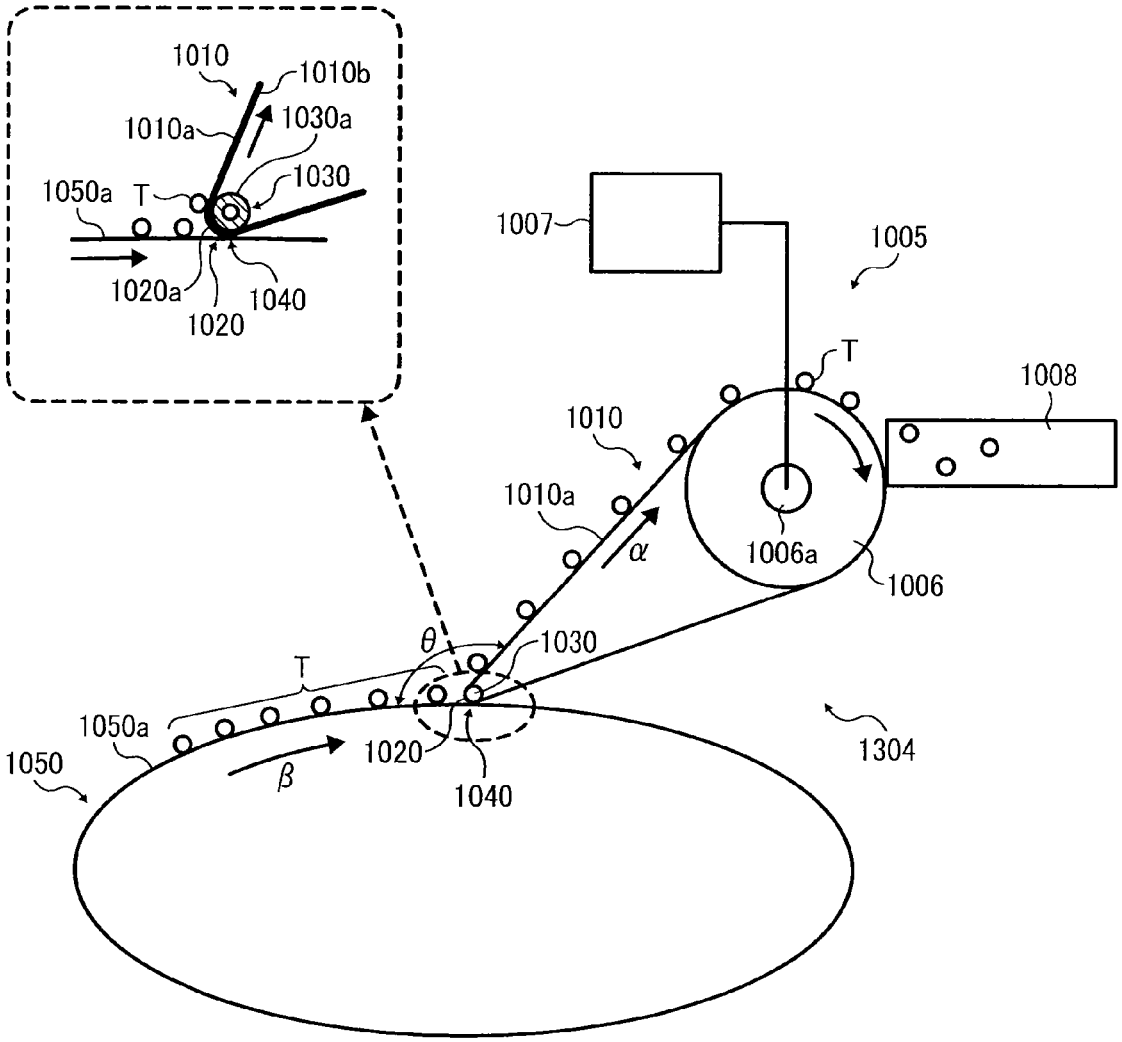
FIG. 36 illustrates an exemplary cleaning system according to a twenty-eighth embodiment of the present invention.

Now, a twenty-seventh embodiment of the present invention is described with reference to FIG. 36. As shown in FIG. 36, a cleaning system 1304 collects adhering substances T adhering onto a surface 1050*a* of an image bearer 1050 by bringing a surface 1010*a* of an endless belt cleaning member 1010 as a collecting surface thereof in contact with the surface 1050*a* of the image bearer 1050. The cleaning member 1010 includes a collecting surface 1010*a* therearound and partially includes a small diameter section 1020 contacting the surface 1050*a* of the image bearer 1050 via the collecting surface 1010*a*. Inside a loop of the cleaning member 1010, a cylindrical contacting member 1030 is positioned to bring the collecting surface 1010*a* in contact with the surface 1050*a* of the image bearer 1050. The small diameter section 1020 provides a cylindrical surface 1020*a*, because an outer circumferential surface 1030*a* of the contacting member 1030 is brought in pressure contact with an inner surface 1010*b* of the cleaning member 1010 located opposite the collecting surface 1010*a*.

Here, a moving system 1005 is provided to move the collecting surface 1010*a* of the cleaning member 1010 in a contacting section 1040, in which the surface 1050*a* of the image bearer 1050 and the collecting surface 1001*a* contact each other, in a direction, in which the adhering substances T on the surface 1050*a* of the image bearer 1050 does not pass through the contacting section 1004. The moving system 1005 includes substantially the identical configuration as that of the twenty-fifth embodiment. The cleaning member 1010 is stretched by the roller 1006 and the contacting member 1030 therebetween, and is rotated with it being brought in either normal contact or preferably pressure contact with the image bearer 1050, when driving force is communicated from a driving motor 1007 to a driving shaft 6*a* of the roller 1006 and finally the roller 1006 to drive and rotate thereof. Here, a tension is provided to the cleaning member 1010 by widening a distance between positions of the roller 1006 and the contacting member 1030 while winding it therearound. Otherwise, the tension is provided to the cleaning member 1001 by applying biasing force to one of the roller 1006 and the contacting member 1003 using a prescribed biasing member such as a spring, etc., not shown. In this embodiment, the image bearer 1050 and the cleaning member 1010 also rotate clockwise as well in the drawing, so that moving directions of the collecting surface 1010*a* and the surface 1050*a* of the image bearer 1050 are opposite to each other in the contacting section 1040.

Here, as shown there, a shape of the cleaning member 1010 wound around the roller 1006 and the contacting member 1030 includes a more sharp angle at a position of the contacting member 1030 than that at a position of the roller 1006. Whereas, the cleaning member 1010 is disposed to render an angle θ formed by the surface 1050*a* of the image bearer 1050 and the collecting surface 1010*a* of the cleaning member 1010 located downstream of the contacting section 1004 in a moving direction of the cleaning member 1010 to be obtuse.

The cleaning system 1304 also includes an adhering substance removing system 1008 to remove adhering substances T from the collecting surface 1010*a*. Similar to that in the twenty-fifth embodiment, the adhering substance removing system 1008 slidably contacts the collection side 10*a* at downstream of the contacting section 1040 in a moving direction of the cleaning member 1010, and eliminates the adhering substances T from the collecting surface 1010*a* as the cleaning member 1010 rotates and moves.

Again, the applicants prepared and tested a model of the cleaning system 1304 with the above-described configuration by generating adhering substances T on the image bearer 1050. As a result, similar to the system of the twenty-fifth embodiment, the applicants have confirmed that the adhering substances T do not pass downstream though the contacting section 1040 contacting the cleaning member 1010 in a rotating direction of the image bearer 1050, and that the adhering substances T are rather sequentially transferred on to the cleaning member 1010 in a moving direction in which the cleaning member 1010 moves, i.e., a direction in which the adhering substances T do not pass downstream through the contacting section 1040 in the rotating direction of the image bearer 1050. Because of this, the adhering substances T on the image bearer 1050 can be collected by the cleaning member 1010 thereon without applying a bias onto the cleaning member 1010 different from a conventional system. Further, since the electric transfer field is not used, neither an electric transfer field nor a transfer condition varies even if an environmental condition, such as temperature, humidity, etc., changes. Thus, when the adhering substances T are collected from the image bearer 1050 by the cleaning member 1010 thereon, such a process is rarely affected by either the electric transfer field or the environmental condition. Accordingly, excellent cleaning performance can be obtained. Further, since a transfer bias is not needed, and accordingly, a power source therefor can be omitted as well, space saving and cost reduction can be readily achieved at the same time.

Figure 37:
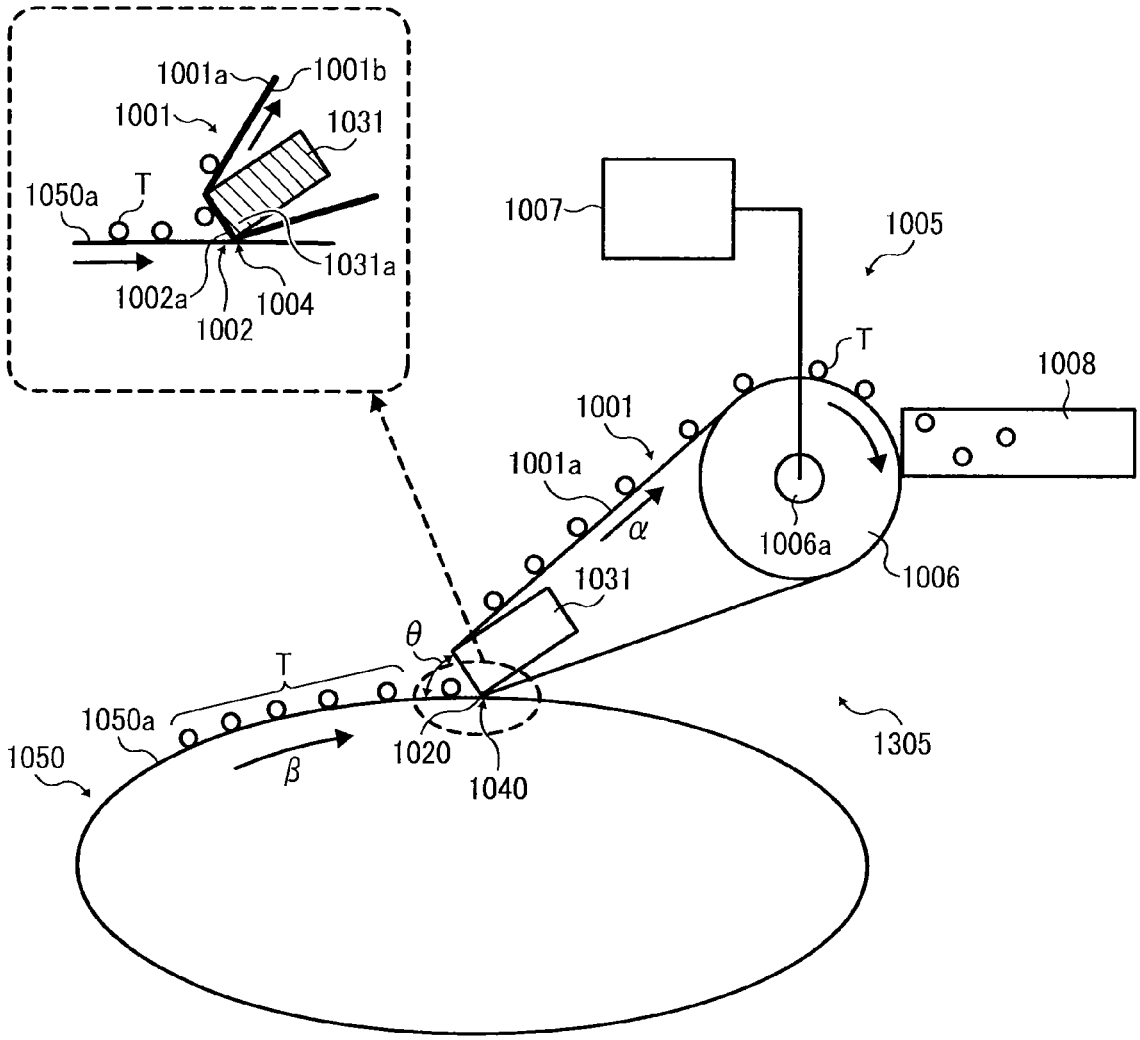
FIG. 37 illustrates an exemplary cleaning system according to a twenty-ninth embodiment of the present invention.

Now, a twenty-ninth embodiment of the present invention is described with reference to FIG. 37. As shown in FIG. 37, a cleaning system 1305 utilizes a platy contacting member 1031 thicker than the contacting member 1003 according to the twenty-fifth embodiment. In such a situation, the cleaning member 1001 is stretched and wound around the contacting member 1031 and the roller 1006, and is rotated and moved clockwise in the drawing by the driving motor 1007. An edge section 1002 of the cleaning member provides a cylindrical surface 1002*a*, because a tip 1031*a* of the contacting member 1031 is brought in pressure contact with an inner surface 1001*b* of the cleaning member 1001. Further, a shape of the cleaning member 1001 thus stretched and wound around the roller 1006 and the contacting section 1031 includes an obtuse angle at a corner section 1031*a* of the contacting member 1031. Further, the cleaning member 1001 is disposed to render an angle θ formed by the surface 1050*a* of the image bearer 1050 and the collecting surface 1001*a* of the cleaning member 1001 located downstream of the contacting section 1004 to be sharp.

Again, the applicants prepared and tested a model of the cleaning system 1305 with the above-described configuration by generating adhering substances T on the image bearer 1050. As a result, similar to the system of the twenty-fifth embodiment, the applicants have confirmed that the adhering substances T do not pass downstream though the contacting section 1004 contacting the cleaning member 1001 in a rotating direction of the image bearer 1050, and that the adhering substances T are sequentially transferred on to the cleaning member 1001 in a moving direction in which the cleaning member 1001 moves, i.e., a direction in which the adhering substances T do not pass downstream through the contacting section 1004 in the rotating direction of the image bearer 1050. Thus, when the adhering substances T are collected from the image bearer 1050 by the cleaning member 1001 thereonto even in the cleaning system 1305 arranged like this, such a collecting process is rarely affected by the environmental condition. Accordingly, excellent cleaning performance can be obtained. Further, since a transfer bias is not needed, and accordingly, a power source therefor can be omitted as well, space saving and cost reduction can be readily achieved at the same time.

Figure 38A:
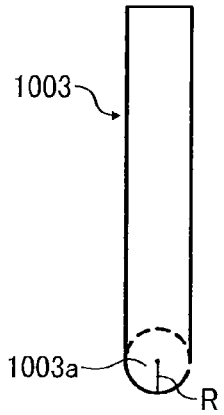
FIGS. 38A to 38C are enlarged views illustrating configurations of exemplary contacting members according to one embodiment of the present invention.
Figure 38B:
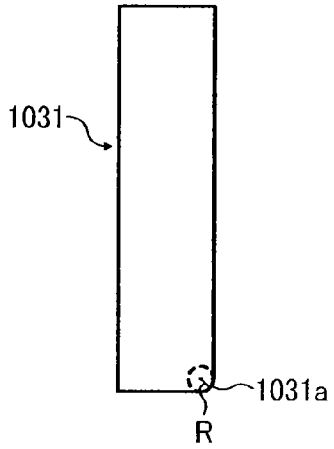
Figure 38C:
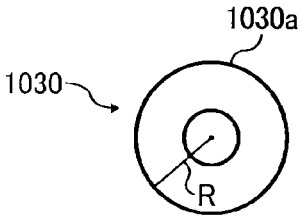

Now, various contacting members 1003, 1031, and 1030 formed by plate members and a cylindrical member, respectively, are described more in detail with reference to FIGS. 38A to 38C. In the first to twenty-seventh embodiments, the tip 1003*a* of the plate like contacting member 1003 is pressed against the inner surface 1001*b* of the cleaning member 1001 to form the contacting section contacting the surface 1050*a* of the image bearer 1050 into the cylindrical surface 1002*a*. Specifically, the tip 1003*a* of the contacting member 1003 is entirely formed into the cylindrical shape as shown in FIG. 38A (FIG. 6A), and the tip 1003*a* is almost entirely pressed against the inner surface 1001*b* of the cleaning member 1001 to form the contacting section (i.e., a position of the collecting surface 1001*a* of the cleaning member 1001) contacting the surface 1050*a* of the image bearer 1050 in a cylindrical shape to provide the cylindrical surface 1002*a*.

Whereas, in the twenty-ninth embodiment, a corner 1031*a* of the tip of the plate like contacting member 1031 thicker than the contacting member 1003 is pressed against an inner surface 1001*b* the cleaning member 1001 to form a contacting section contacting the surface 1010*a* of the image bearer 1050 in a cylindrical shape to provide the cylindrical surface 1002*a*. Specifically, the tip 1031*a* of the contacting member 1031 is partially (not entirely) formed into the cylindrical shape, and only the corner 1031*a* of the tip thereof is pressed against the inner surface 1010*b* of the cleaning member 1001 to form the contacting section contacting the surface 1050*a* of the image bearer 1050 in a cylindrical shape to provide the cylindrical surface 1002*a*. Further, in the twenty-eighth embodiment, as shown in FIG. 38C (FIG. 6C), the contacting section is formed in a cylindrical shape to provide the cylindrical surface 1020*a* by almost pressing a half of an outer circumferential surface 1030*a* of the contacting member 1030 having a roller shape against the inner surface 1010*b* of the cleaning member 1001.

Again, the applicants have tested these various cylindrical surfaces 1002*a* and 1020*a* by changing a dimension thereof and confirmed that adhering substances T do not pass through each of the respective contacting sections 1004 and 1040 and excellent cleaning performance can be obtained when a curvature radius R of each of the cylindrical surfaces 1002*a* and 1020*a* is less than about 4 mm. That is, the above-described contacting member includes a considerably smaller size employed in a conventional cleaning system (e.g. a web cleaning system) not employing a bias. Further, when the curvature radius R is about 2 mm or more, more favorable cleaning performance is obtained. As material of the contacting member 1003, resin and metals, such as aluminum, stainless steel, etc., may be used.

Figure 39A:
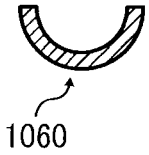
FIGS. 39A to 39D enlarged views illustrating modifications of the contacting member according to one embodiment of the present invention.
Figure 39B:
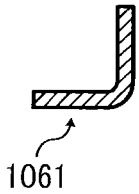
Figure 39C:
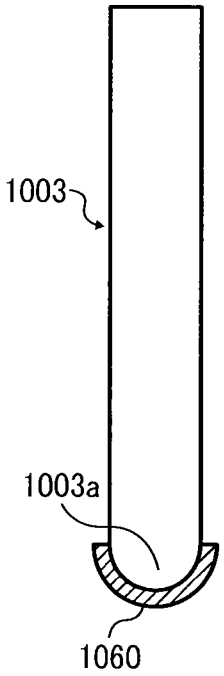
Figure 39D:
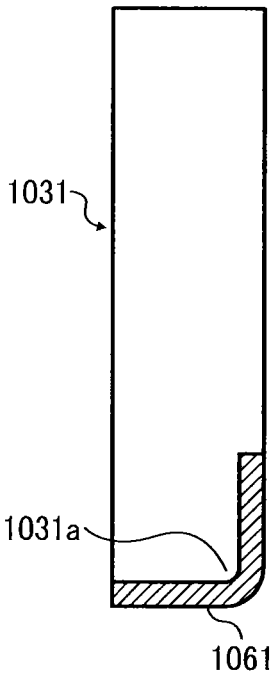

As the contacting member, it is not limited to the plates and roller shapes, and includes a cylindrical member 1060 and an L-letter shaped member 1061 may be utilized as well as shown in FIGS. 39A and 39B, for example. Further, depending on material of the cleaning member 1001 and 1010, the contacting member likely wears away as it moves and rotates when the contacting member is made of the resin. For this reason, as shown in FIGS. 39C and 39D, to the tip 1003*a* of the contacting member 1003 and the corner of the contacting member 1031, members 1060 and 1061 each made of metal can be attached, respectively.

Figure 40A:
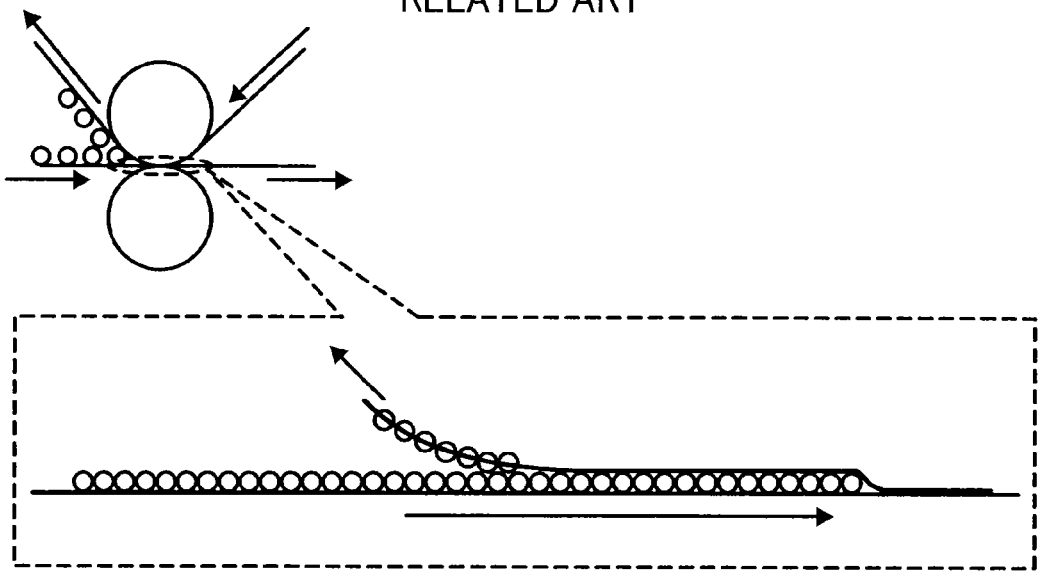
FIG. 40A RELATED ART
FIGS. 40A and 40B are diagrams illustrating a comparative related art of a conventional cleaning system and a cleaning system according to one embodiment of the present invention.
Figure 40B:
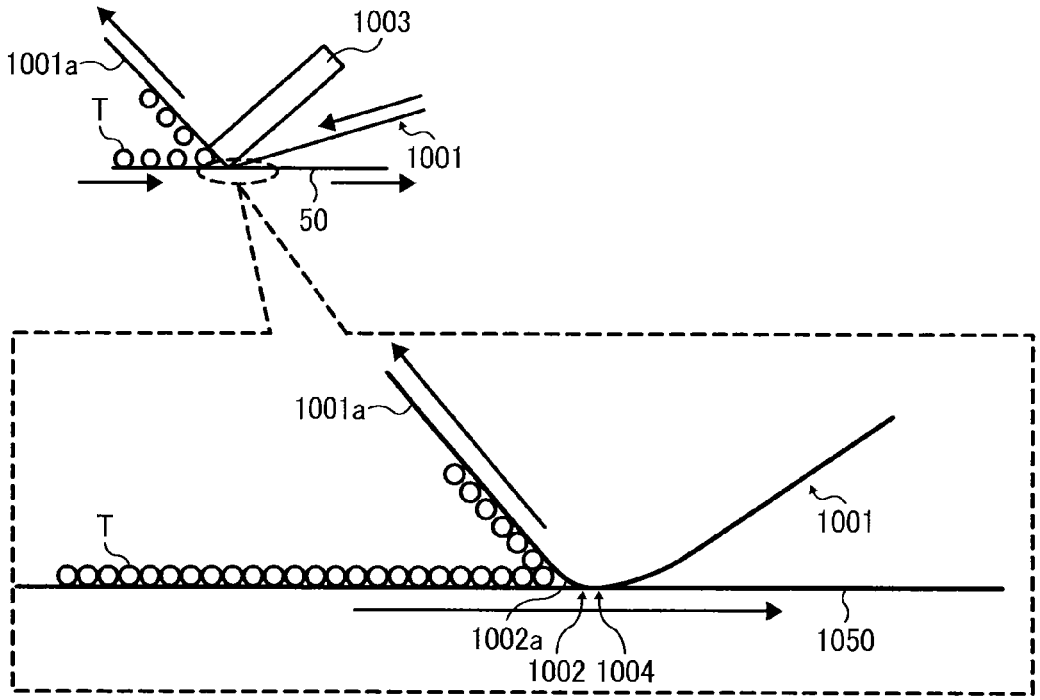

Now, a reason why cleaning performance of each of the above-described cleaning systems 1301 to 1305 is more effective than that of a conventional web cleaning system is described with reference to FIGS. 40A and 40B. FIG. 40A is an enlarged view schematically illustrating near a contacting section of the conventional Web cleaning system. FIG. 40B is also an enlarged view schematically illustrating near a contacting section of the cleaning system according to one embodiment of the present invention. As shown in FIG. 40A, in the web cleaning system, adhering substances are sandwiched by both parties up to the contacting section, and is transferred from the surface of the image bearer 1050 onto the cleaning member. That is, it is supposed that a radius of curvature is relatively large, and as a result, the adhering substances are sandwiched by both parties in the contacting section. By contrast, the cylindrical edge section 1002 is formed by the contacting member 1003 in the cleaning system according to one embodiment of the present invention, it is supposed that the adhering substances T are transferred from the surface 1050*a* of the image-bearer 1050 onto the cleaning member 1001 at the edge section 1002. That is, it is supposed that since the radius of curvature of the cylindrical surface 1002*a* of the contacting member 1003 is relatively small, the adhering substances T are not nipped up to the contacting section 1004. Further, when the roller type and thick plate like contacting member 1031 and 1030 are used, it is also supposed that the radius of curvature of each of the cylindrical surfaces 1002*a* and 1020*a* of the contacting member 1031 and 1030 is relatively small, and accordingly the adhering substances T are not sandwiched up to each of the contacting sections 1004 and 1040.

Figure 41A:
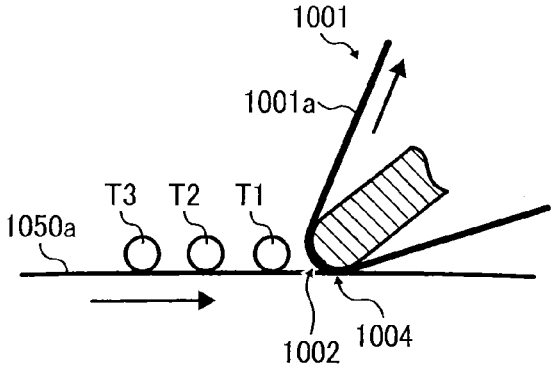
FIGS. 41A to 41D are diagrams collectively illustrating a cleaning principle employed in the cleaning system according to one embodiment of the present invention.
Figure 41B:
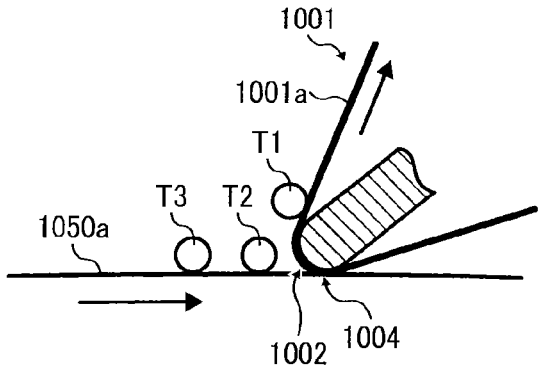
Figure 41C:
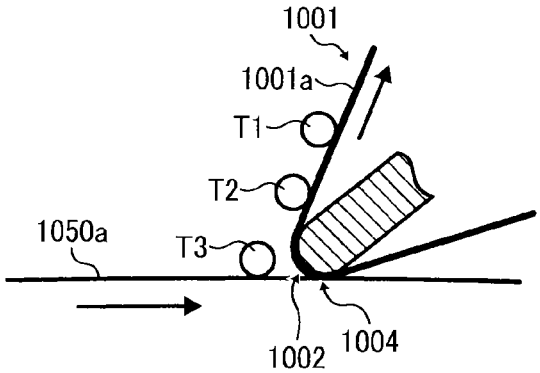
Figure 41D:
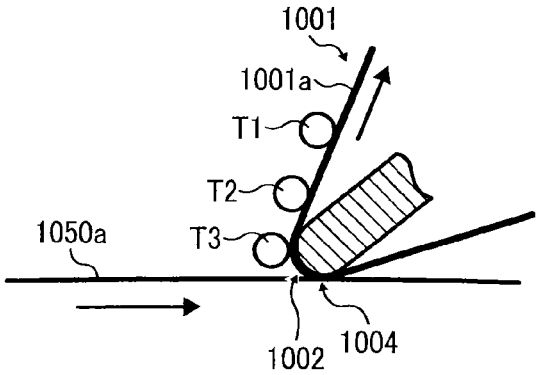

Now, exemplary cleaning operation is herein below described with reference to FIGS. 41A to 41D. FIGS. 41A to 41D are partially enlarged views of FIG. 33. In FIGS. 41A to 41D, reference codes T1, T2, and T3 schematically illustrate adhering substances adhering onto the surface 1050*a* of the image bearer 1050. As shown in FIG. 41A, these adhering substances T1, T2 and T3, are aligned in this order on the surface 1050*a* of the image bearer 1050 in a direction of its movement beginning with the image T1. As shown in FIG. 41B, since the surface 1001*a* of the cleaning member 1001 moves in a direction not to allow the adhering substance T1 to pass through the contacting section 1004, it is supposed that the adhering substance T1 coming up to the contacting section 1004 does not pass through the contacting section 1004 and is rather transferred from the surface 1050*a* of the image bearer 1050 onto the surface 1001*a* of the cleaning member 1001. Here, the direction not to allow the adhering substance T1 to pass through the contacting section 1004 is opposite a direction, in which the surface 1050*a* of the image bearer 1050 moves. Further, it is opposite a direction in which the adhering substance T1 tends to pass through the contacting section 1004. Similarly, it is supposed that the adhering substance T2 coming up to the contacting section 1004 does not pass through the contacting section 1004 and is rather transferred from the surface 1050*a* of the image bearer 1050 onto the surface 1001*a* of the cleaning member 1001 as shown in FIG. 41C as well. Yet similarly, it is supposed that the adhering substance T3 coming up to the contacting section 1004 does not pass through the contacting section 1004 and is rather transferred from the surface 1050*a* of the image bearer 1050 onto the surface 1001*a* of the cleaning member 1001 as shown in FIG. 41D as well. Hence, it is supposed that adhering substances T1, T2 and T3 lined up in an order in a direction, in which the surface 1050*a* of the image bearer 1050 moves, are sequentially transferred onto the surface 1001*a* of the cleaning member 1001.

In the above-described various embodiments, the image bearer 1050 and each of the cleaning members 1001 and 1010 move in the opposite direction to each other in each of the contacting sections 1004 and 1040. In such a situation, however, the cleaning members 1001 and 1010 can be rotated and moved to generate a difference in relative velocity between the surface 1050*a* of the image bearer 1050 and each of the cleaning members 1001 and 1010 as well. For example, in the first examples as shown in FIG. 33 as a typical example, the moving velocity of the cleaning member 1001 is changed in relation to the moving velocity of the image bearer 1050 by changing the rotational velocity of the driving motor 1007. Specifically, when a line velocity of cleaning member 1001 is represented by a, and the line velocity of the image bearer 1050 is represented by $\beta$, the following inequality may be employed, wherein $\beta$ is constant; $\alpha>\beta$, or $\alpha<\beta$. When inequality $\alpha>\beta$ is employed, toner is hardly deposited in the cleaning section and accordingly, fine cleaning performance can be preferably maintained over time. Whereas, when the inequality $\alpha<\beta$ is employed, since sliding friction decreases, durability of the image bearer 1050 can be enhanced. Specifically, when productivity (i.e., the surface line velocity $\beta$) of the image bearer 1050 is constant, a relative difference in velocity of each of the cleaning members 1001 and 1010 from the image bearer 1050 in each of the contacting sections 1004 and 1040 is the sum of $\alpha+\beta$. For this reason, by minimizing the line velocity $\alpha$ than that of $\beta$, an amount of sliding friction (or a distance) with the cleaning member 1001 or 1010 per unit time can be reduced. However, when the relation $\alpha=\beta$ is employed, a mechanism and control to generate the difference in velocity between the both parties can be simplified, because consideration of changing velocity, such as a decelerating and accelerating ratio of a driving system transmission, a rotational velocity of the driving motors M1 and M2, etc., are not needed. Hence, the above-described system of generating the relative difference in velocity between the image bearer 1050 and the cleaning member can be applied to the second and twenty-ninth embodiments of the present invention as well.

Figure 42A:
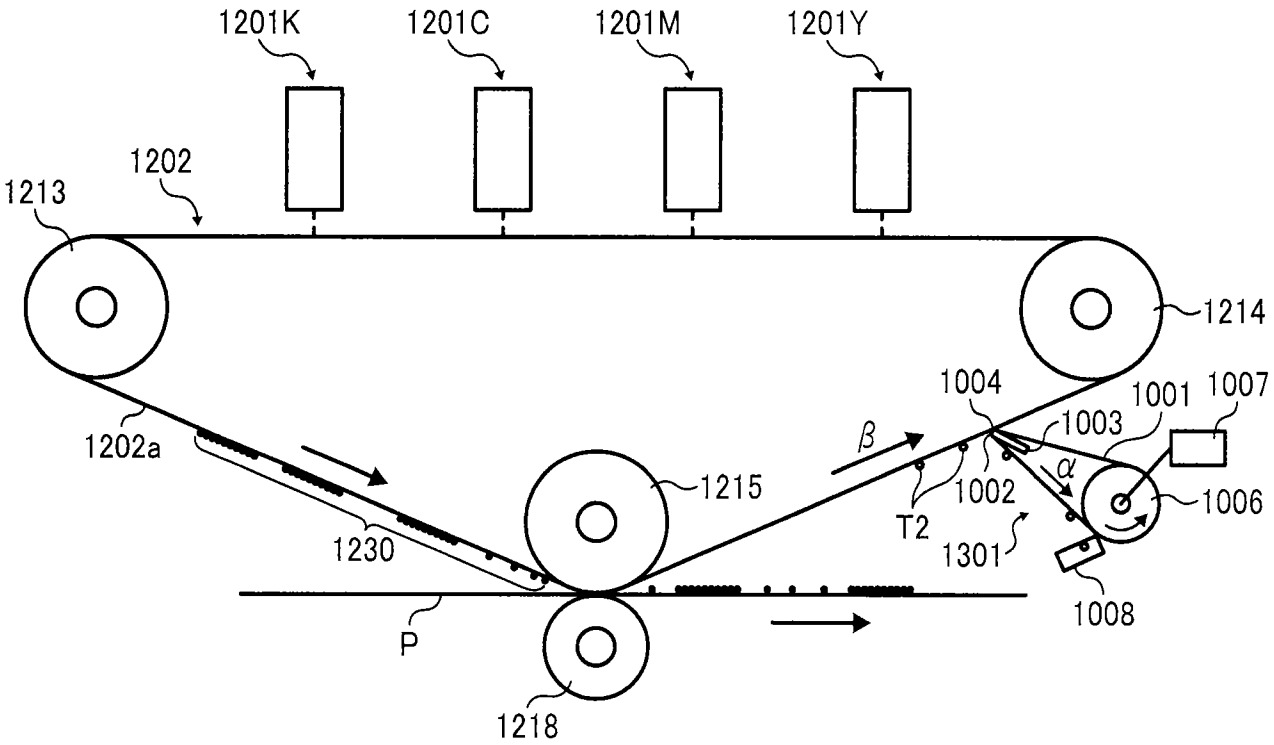
FIG. 42A is a diagram illustrating an exemplary system prepared by applying the cleaning system according to one embodiment of the present invention to a color image forming apparatus according to one embodiment of the present invention.
Figure 42B:
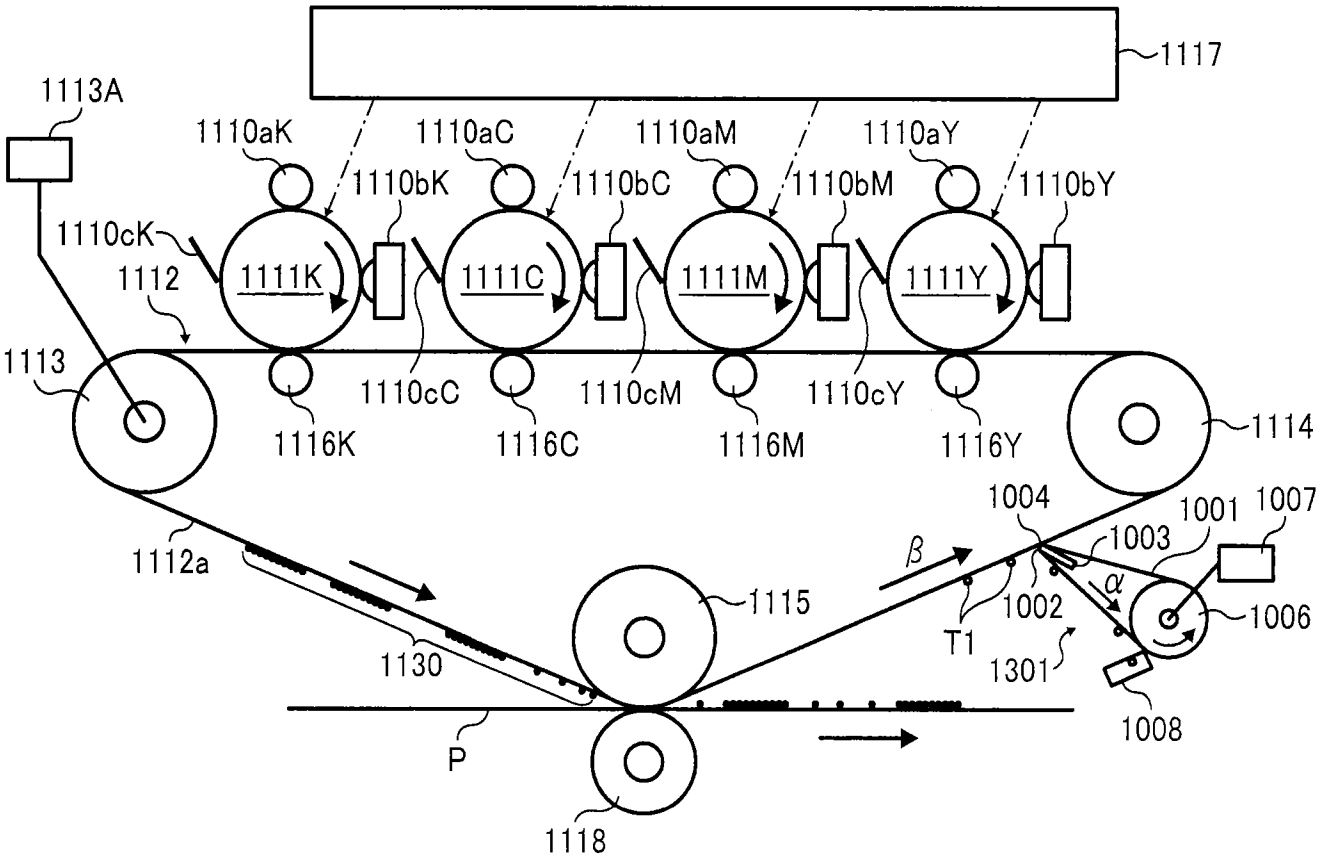
FIG. 42B is a diagram illustrating an exemplary system prepared by applying the cleaning system according to one embodiment of the present invention to a color image forming apparatus that employs an electrophotography according to a sixth embodiment of the present invention.

Now, various embodiments of image forming apparatuses, to which the above-described cleaning system is applied, are described with reference to FIGS. 42A and 42B. FIGS. 42A and 42B are schematic diagrams illustrating image forming apparatuses each equipped with an intermediate transfer member, to which the above-described cleaning system 1301 is applied to the intermediate transfer member. Especially, FIG. 42B illustrates an image forming apparatuses that employs an electrophotography and is equipped with the intermediate transfer member, to which the above-described cleaning system 1301 is applied. The image forming apparatus shown in FIG. 42B is enabled to form a full-color image by using toner particles of yellow, magenta, cyan, and black colors. In applicable diagrams, subscripts Y, M, C, and K indicate devices handling yellow, magenta, cyan, and black colors, respectively. However, these subscripts Y, M, C, and K are omitted sometimes to avoid complexity. The Image forming apparatus shown in FIG. 17 includes multiple drum-shaped photoreceptors 1111 (Y, M, C, and K) serving as image bearers, multiple image forming devices 1100 to form toner images 1130 of respective colors on surfaces 1111*a* of the photoconductor, a belt-shaped intermediate transfer member 1102 as a transferring objective, onto which the toner images 1130 formed on the respective photosensitive surfaces 1111 are sequentially transferred, and an exposing unit 1117. Each of the image forming devices 1110 includes a well-known electric charging device 1110*a* (Y, M, C, and K), a well-known developing device 1110*b* (Y, M, C, and K), and a well-known cleaning device 1110*c* (Y, M, C, and K) around each of the photoconductors 1111 that rotates and moves clockwise in the FIG. 42B.

The intermediate transfer member 1112 winds around multiple rollers 1113, 1114 and 1115. The intermediate transfer member 1112 accordingly forms primary transfer sections (Y, M, C, and K) between the pair of rollers 1113 and 1114 as it is contacted and pressed by the respective primary transfer rollers 1117 (Y, M, C, and K) against the surfaces 1111*a* of the photoconductor. Here, a transfer bias is applied to each of the primary transfer rollers 1116. The roller 1113 serves as a driving roller, and is driven and rotated by a driving motor 1113A counter-clockwise. As the driving roller 1113 is driven and rotated counter-clockwise, the belt like intermediate transfer member 1113 is also driven and moved counterclockwise as well. A secondary transfer roller 1118 is located at a position opposed to the roller 1115 to contact a surface 1112*a* of the intermediate transfer member 1112, thereby forming a secondary transfer section. However, a transfer bias is not applied to the secondary transfer section. To the secondary transfer section, a transfer sheet P is conveyed from a sheet feeding unit, not shown, at a prescribed time when a toner image 1130 formed by component color toner images sequentially transferred onto the intermediate transfer member 1112 reaches the secondary transfer section. In this embodiment, the intermediate transfer member 1112 is enabled to move and circulate counterclockwise. The cleaning system 1301 is disposed downstream of the secondary transfer section in a move direction of the intermediate transfer member 1112, with its collecting surface 1001*a* contacting a surface 1112*a* of the intermediate transfer member 1112. In this embodiment, the cleaning member 1001 is rotated by the driving motor 1007 and moves counterclockwise in the drawing. Further, a (difference in) line velocity is set to meet the following inequality when a line velocity of the cleaning member 1001 is represented by $\alpha$, and a line velocity of the transfer sheet P is represented by $\beta$; $\alpha<\beta$.

When a color image is formed in the image forming apparatus with such a configuration, each of the surfaces 1111*a* of the photoconductor is charged by each of the electrostatic device 1110*a* and a latent image of each col is formed thereon receiving an exposure light beam corresponding to the color from the exposing unit 1117 that provides scanning exposure to each of these latent images. Each of the latent images formed in this way is subsequently developed by corresponding col toner supplied by the corresponding color developing device 1110*b* to be a corresponding col component toner image. The toner image formed and borne on the each of the photosensitive surfaces 1110 are sequentially transferred on a surface 1112*a* of the intermediate transfer member 1112 in each of the transfer sections under a transfer bias to be a toner image 1130, and are further conveyed to the secondary transfer section. Each of the photoconductors 1111 bearing the transferred toner image is cleaned by each of cleaning system 1110*c*, and is initialized by each of charge removing system, not shown. To the secondary transfer section, the transfer sheet P is conveyed from a sheet feeding unit, not shown, at a time when the toner image 1130 reaches the secondary transfer section, and the toner image 1130 borne on the surface 1112*a* of the intermediate transfer member 1112 is transferred thereonto at once. The transfer sheet P bearing the transferred toner images 1130 is subsequently conveyed to a fixing device 1119, and the toner image 1130 is subjected to heat and pressure and is accordingly fixed.

At the same time, the surface 1112*a* of the intermediate transfer member 1112, from which the toner image 1130 is transferred onto the transfer sheet P in the secondary transfer section, moves toward the cleaning system 1301. Further, adhering substance T1, such as post transfer residual toner, sheet dust, etc., reaches the contacting section 1004 in which the edge section 1002 of the contacting member 1003 is located. At this moment, however, in the cleaning system 1301, the cleaning member 1001 rotates and moves counterclockwise in the drawing. Because of this, the adhering substance T1 borne on the surface 1112*a* of the intermediate transfer member does not pass downstream through the contacting section 1004 in a rotational direction of the intermediate transfer member 1112, and is sequentially transferred and collected by the collecting surface 1001*a* of cleaning member 1001 therteonto, in a direction in which the adhering substance T1 does not pass therethrough. The adhering substance T1 collected by the cleaning member 1001 is subsequently removed by an adhering substance removing system 1008 from the collecting surface 1001*a*.

Hence, when the cleaning system 1301 according to this embodiment is applied to the image forming apparatus, collection of the adhering substance T1 passing through the secondary transfer section from the surface 1112*a* of the intermediate transfer member 1112 is rarely affected by either the bias or the environmental condition. Thus, cleaning performance can be excellent. Further, since a bias is omitted, a power supply facility becomes unnecessary, so that space saving and cost reduction can be readily promoted in the image forming apparatus at the same time. Further, since a relation of the line velocity of the intermediate transfer member 1112 and that of the transfer sheet P meets the inequality $\alpha>\beta$, toner is hardly deposited in the cleaning section and accordingly, excellent cleaning performance can be preferably maintained over time. Further, the relation of the line velocity of the intermediate transfer member 1112 and that of the transfer sheet P can meet the following relations; $\alpha<\beta$, or $\alpha=\beta$. When the inequality $\alpha<\beta$ is employed, since friction decreases, durability of the image bearer 1050 can be enhanced. Whereas, when the relation $\alpha=\beta$ is employed, a mechanism and control to generate the difference in velocity between the both parties can be simplified, because consideration of changing velocity, such as a rotational velocity of the driving motor 1007, a decelerating and accelerating ratio of a driving system transmission, etc., are not needed.

Figure 43:
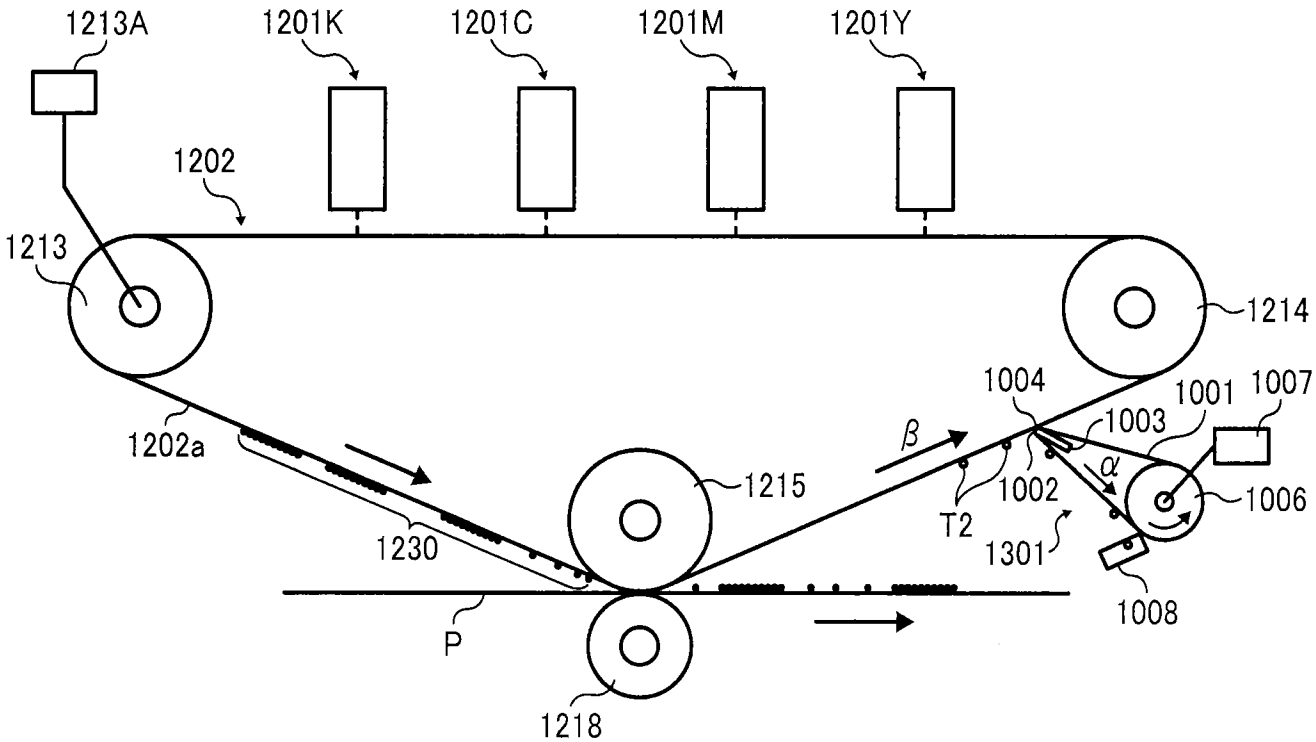
FIG. 43 is a diagram illustrating an exemplary system prepared by applying the cleaning system according to one embodiment of the present invention to an ink drop injecting type color image forming apparatus that employs an ink drop injecting system according to a thirty-first embodiment of the present invention.

Now, a thirty-first embodiment of the present invention is described with reference to FIG. 43. FIG. 43 is a schematic diagram illustrating an embodiment prepared by applying the above-described cleaning system 1301 to an intermediate transfer member provided in an image forming apparatus that ejects ink drops from a nozzle head. The image forming apparatus shown in FIG. 43 is enabled to form a full color image using ink drops of yellow, magenta, cyan, and black colors. In applicable diagrams, subscripts Y, M, C, and K indicate devices handling yellow, magenta, cyan, and black colors, respectively. However, these subscripts Y, M, C, and K are omitted sometimes to avoid complexity. The image forming apparatus includes multiple nozzle heads 1201 (Y, M, C, and K) to eject ink drops as image forming sections and a transfer belt 1202 as an image bearer that bears images formed by ejecting the ink drops from each of the nozzle heads 1201 (Y, M, C, and K). The nozzle heads 1201 (Y, M, C, and K) eject ink drops on a surface 1202*a* of the transfer belt 1202 in accordance with color image signals, respectively.

The transfer belt 1202 winds around multiple rollers 1213 and 1214, and 1215. The roller 1213 serves as a driving roller, and is driven and rotated by a driving motor 1213A counter-clockwise. As the driving roller 1213 is driven and rotated counter-clockwise, the transfer belt 1202 is also driven and moved counterclockwise as well. On a portion of the transfer belt 1202 located between these rollers 1213 and 1214, an image 1230 is formed by sequentially ejecting ink drops from the respective nozzle heads 1201, and synthesizing ink drop images thereon. A transfer roller 1218 is located at a position opposed to the roller 1215 to contact the surface 1202*a* of the transfer belt 1202 thereby forming a transfer section. To the transfer section, a transfer sheet P is conveyed from a sheet feeding unit, not shown, at a time when an image 1230 borne on the transfer belt 1202 reaches the transfer section. In this embodiment, the transfer belt 1202 is enabled to move and circulate counterclockwise. The cleaning system 1301 is positioned downstream of the transfer section in a moving direction of the transfer belt 1202 with its collecting surface 1001*a* contacting a surface 1202*a* of the transfer belt 1202. In this embodiment, the cleaning member 1001 is driven by the driving motor 1007 and moves counterclockwise in the drawing. Further, a (difference in) line velocity is set to meet the following inequality when a line velocity of the cleaning member 1001 is represented by $\alpha$, and a line velocity of the transfer belt 1202 is represented by $\beta$; $\alpha<\beta$.

When a color image is formed in the image forming apparatus with such a configuration, an ink drop image 1230 is formed on the surface 1202*a* of the transfer belt 1202 by ejecting ink drops from the respective nozzle heads 1201. The image 1230 is supported on the transfer belt 1202 and is further conveyed to the transfer section. To the transfer section, the transfer sheet P is conveyed from a sheet feeding unit, not shown, at a time when the image 1230 reaches the transfer section, and the image 1230 borne on the surface 1202*a* of the transfer belt 1202 is transferred thereonto at once.

On the other hand, the surface 1202*a* of the transfer belt 1202, from which the image has been transferred onto the transfer sheet P in the transfer section 1230, moves toward the cleaning system 1301. Subsequently, adhering substances T2, such as post transfer residual toner, sheet dust, etc., reach the contacting section 1004 in which the edge section 1002 of the contacting member 1003 is located. At this moment, however, in the cleaning system 1301, since the cleaning member 1001 rotates and moves counterclockwise in the drawing. Because of this, the adhering substances T2 borne on the surface 1202*a* of the transfer belt 1202 does not pass downstream through the contacting section 1004 in a rotational direction of the intermediate transfer member, and is sequentially transferred and collected by the collecting surface 1001*a* of cleaning member 1001 therteonto, in a direction in which the adhering substances T2 does not pass therethrough. The adhering substances T2 collected in this way by the cleaning member 1001 is subsequently removed by an adhering substance removing system 1008 from the collecting surface 1001*a*.

Hence, when the cleaning system 1301 according to this embodiment is applied to the image forming apparatus, collection of the adhering substances T2 from the surface 1202*a* of the transfer belt 1202 after passing thereof through the secondary transfer section is rarely affected by either the bias or the environmental condition. Thus, cleaning performance can be excellent. Further, since a bias is omitted, a power supply facility becomes unnecessary, so that space saving and cost reduction can be readily promoted in the image forming apparatus at the same time. Further, toner is hardly deposited in the cleaning section and accordingly, fine cleaning performance can be preferably maintained over time. Further, the relation of the line velocity of the transfer belt 1202 and that of the transfer sheet P can employ the relations $\alpha<\beta$, or $\alpha=\beta$. Specifically, when the inequality $\alpha<\beta$ is employed, since friction decreases, durability of the transfer belt 1202 can be enhanced. Whereas, when the relation $\alpha\alpha=\beta$ is employed, a mechanism and control to generate the difference in velocity between the both parties can be simplified, because consideration of changing velocity, such as a rotational velocity of the driving motor 1007, a decelerating and accelerating ratio of a driving system transmission, etc., are not needed.

In the above-described image forming apparatus, the cleaning system of the twenty-fifth embodiment is employed and applied. However, the cleaning systems 302 to 1305 of the second to twenty-ninth embodiment can be employed therein as well. Further, in the above-described image forming apparatus shown in FIG. 42B, the cleaning system is used to clean the intermediate transfer member 1112. However, the cleaning system can be also used to clean each of the photoconductors, and can also effectively remove the post transfer residual toner or sheet dust and the like therefrom.

Although the cleaning member employs the endless belt in the above-described embodiment, it can employ an ending belt (e.g., a rolling up type). Further, although a bias is not applied only to each of the cleaning members in the above-described various embodiments, it can be applied thereto and the contacting members or the like.

Here, as material of the cleaning member 1001 and 1010, polypropylene, polyethylene, polyethylene terephthalate, polyester, polyolefin, vinyl, nylon, polyimide, and polyamide-imide, or the like may be used. Further, a sheet and film made of fluorine resin, such as PTFE, PFA, PVDF, PVF, etc., may be used as well. Further usable member is prepared by coating a sheet made of fiber, such as glass, carbon, aramida, etc., with fluorocarbon resin, etc.

Further, when a surface roughness Ra (e.g. an arithmetic average roughness (hereinafter, simply referred to as a surface roughness Ra)) of each of the cleaning members 1001 and 1010, the image bearer 1050, and the transfer belt 1202 is desirably about 30 μm or less, because the adhering substances can be more likely completely removed. Here, such a surface roughness is measured using a laser microscopes (VK9500) manufactured by Keyence Corporation. Otherwise, the surface roughness Ra may be measured using a measurement system that complies with JIS B0031 as well.

The surface roughness Ra of each of the cleaning members 1001 and 1010 and the transfer belt 1202 is more desirably about 10 μm (micrometer) or less when a usage toner particle includes a diameter of about 6 μm (micrometer) or less. Further, the surface roughness Ra of the cleaning member 1001 and 1010 and the transfer belt 1202 is more desirably about 14 μm (micrometer) or less when the usage toner particle includes a diameter of about 8 μm (micrometer) or less. Yet further, the surface roughness Ra of each of the cleaning members 1001 and 1010 and the transfer belt 1202 is more desirably about 10 μm (micrometer) or less when usage liquid drops include the ink. Here, a diameter of each of the toner particle is measured using the Coulter counter Maultisizer™ (manufacture by Coulter Corp.) while employing an aperture of about 100 μm (micrometer) and calculating an average of particle sizes of 50000 pieces of measuring result. The toner particle diameter represents the number average particle size.

Further, the surface roughness Ra of each of the cleaning members 1001 and 1010 and the transfer belt 1202 is desirably about 40 μm (micrometer) or less, when a moving velocity (i.e., a surface velocity) of each of the cleaning members 1001 and 1010 is about 200 mm/sec or less. Yet further, the surface roughness Ra of each of the cleaning members 1001 and 1010 and the transfer belt 1202 is desirably about 30 μm (micrometer) or less, when the moving velocity of each of the cleaning members 1001 and 1010 ranges between about 200 mm/sec or more and about 400 mm/sec or less. Further, the surface roughness Ra of each of the cleaning members 1001 and 1010 and the transfer belt 1202 is desirably about 20 μm (micrometer) or less, when the moving velocity of each of the cleaning members 1001 and 1010 is about 400 mm/sec or more.

Figure 44:
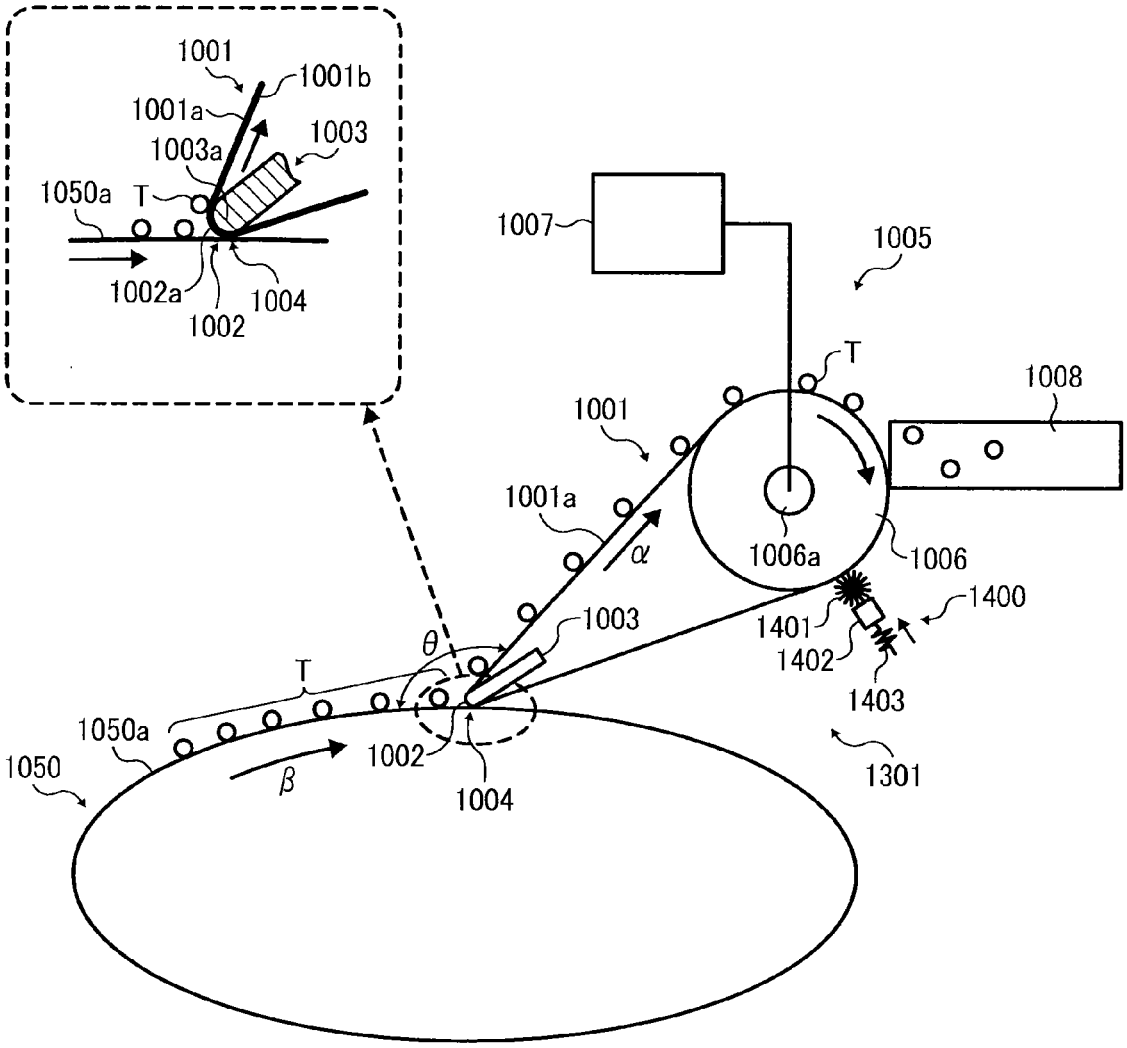
FIG. 44 is a diagram illustrating a cleaning system with a protecting device according to a thirty-second embodiment of the present invention.

Now, a thirty-second embodiment of the present invention is described with reference to FIG. 44. As shown in FIG. 44, this embodiment additionally includes a protecting device 1400 to the cleaning system 1301 of the twenty-fifth embodiment. The protecting device 1400 includes a solid lubricant 1402 as a protecting member, a coating roller 1401 to coat the solid lubricant 1402 onto a collecting surface 1001*a* of the cleaning member 1001 as a coating member, and a spring 1403 to urge the solid lubricant 1402 toward the coating roller 1401 as a biasing member. In this embodiment, the coating roller 1401 is configured by a rotatable brush roller with its brush tip contacting both the collecting surface 1001*a* of the cleaning member 1001 and the lubricant 1402 preferably with or without pressure.

The coating roller 1401 is placed upstream of a contacting section 1004, in which the surface 1050*a* of the image bearer 1050 and the collecting surface 1001*a* of the cleaning member 1001 contact each other, and downstream of the adhering substance removing system 1008 in a rotating direction of the cleaning member 1001, while contacting the collecting surface 1001*a* of the cleaning member 1001 with or without pressure. In this embodiment, the coating roller 1401 is driven and rotated as the cleaning member 1001 moves. However, the coating roller 1401 can be driven and rotated by providing driving force from a power source such as a driving motor, not shown, to the coating roller 1401.

With such a configuration of the protecting device 1400, the lubricant 1402 pressed by spring power of the spring 1403 against the coating roller 1401 that is driven and rotated as the cleaning member 1001 moves is chipped off and coated onto the collecting surface 1001*a* of the cleaning member 1001 by the coating roller 1401. For this reason, since the collecting surface 1001*a* of the cleaning member 1001 and the cleaning member 1001 itself are protected, cleaning performance of cleaning the surface 1050*a* of the image bearer 1050 and the collecting surface 1001*a* of the cleaning member 1001 can be upgraded. Further, since the protecting device 1400 coats the collecting surface 1001*a* of the cleaning member 1001 with the lubricant 1402 after the adhering substance removing system 1008 cleans thereof, the adhering substance removing system 1008 does not scrape off the lubricant 1402 before it reaches the contacting section 1004, and accordingly, coating efficiency can be preferably maintained. Further, even when the protecting device 1400 is added to one of the second to twenty-ninth embodiments, the similar advantageous result can be obtained as the thirty-second embodiment.

Figure 45:
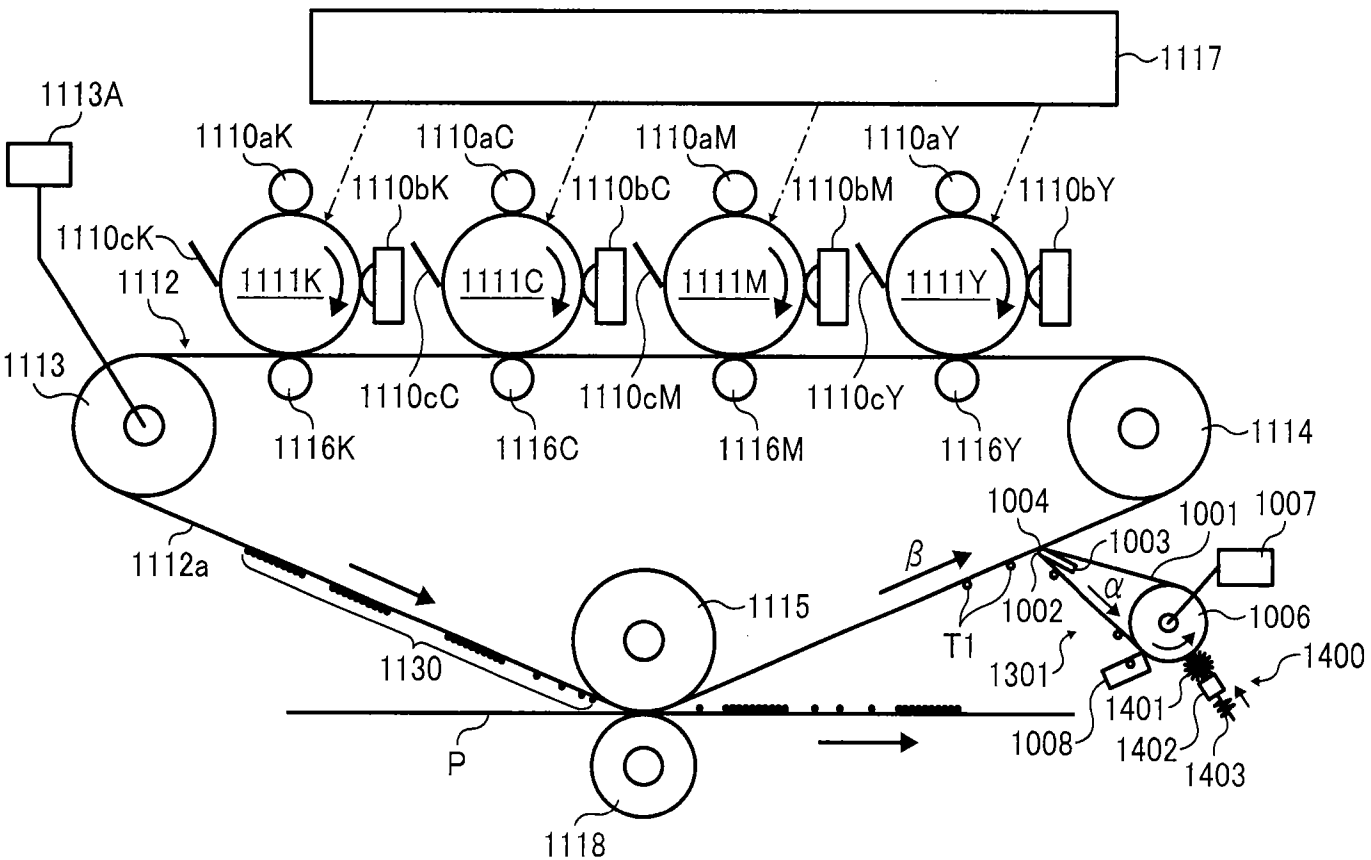
FIG. 45 is a diagram illustrating an exemplary system prepared by applying the cleaning system with the protecting device to a color image forming apparatus that employs an electrophotography according to a thirty-third embodiment of the present invention.

Now, a ninth embodiment of the present invention is described with reference to FIG. 45. As shown in FIG. 45, this embodiment additionally includes the protecting device 1400 beside the cleaning system 1301 of the thirtieth embodiment. The protecting device 1400 includes a solid lubricant 1402 as a protecting member, a coating roller 1401 to coat the solid lubricant 1402 onto the collecting surface 1001*a* of the cleaning member 1001 as a coating member, and a spring 1403 to urge the solid lubricant 1402 toward the coating roller 1401 as a biasing member. In this embodiment, the collecting surface 1001*a* of the cleaning member 1001 contacts the surface 1102*a* of the intermediate transfer member 1102 in the contacting section 1004.

Specifically, the coating roller 1401 is placed on the downstream side of the adhering substance removing system 1008 and the upstream side of the contacting section 1004 contacting the surface 1112*a* of the intermediate transfer member 1112 in a direction in which the cleaning member 1001 circulates. Thus, the coating roller 1401 contacts the collecting surface 1001*a* of the cleaning member 1001 either with or without pressure, and is thereby driven and rotated therebetween.

With such a configuration of the protecting device 1400, the lubricant 1402 pressed by spring power of the spring 1403 against the coating roller 1401 that is driven and rotated as the cleaning member 1001 moves is chipped off and coated onto the collecting surface 1001*a* of the cleaning member 1001 by the coating roller 1401. For this reason, since the cleaning member 1001 and the collecting surface 1001*a* thereof are protected, cleaning performance of cleaning the collecting surface 1001*a* of the cleaning member 1001 and the surface 1112*a* of the intermediate transfer member 1112 can be upgraded. Further, since the protecting device 1400 coats the surface 101*a* of the photoconductor with the lubricant 1402 after the adhering substance removing system 1008 cleans thereof, the adhering substance removing system 1008 does not scrape off the lubricant 1402 before it reaches the contacting section 1004, and accordingly, coating efficiency can be preferably maintained.

Figure 46:
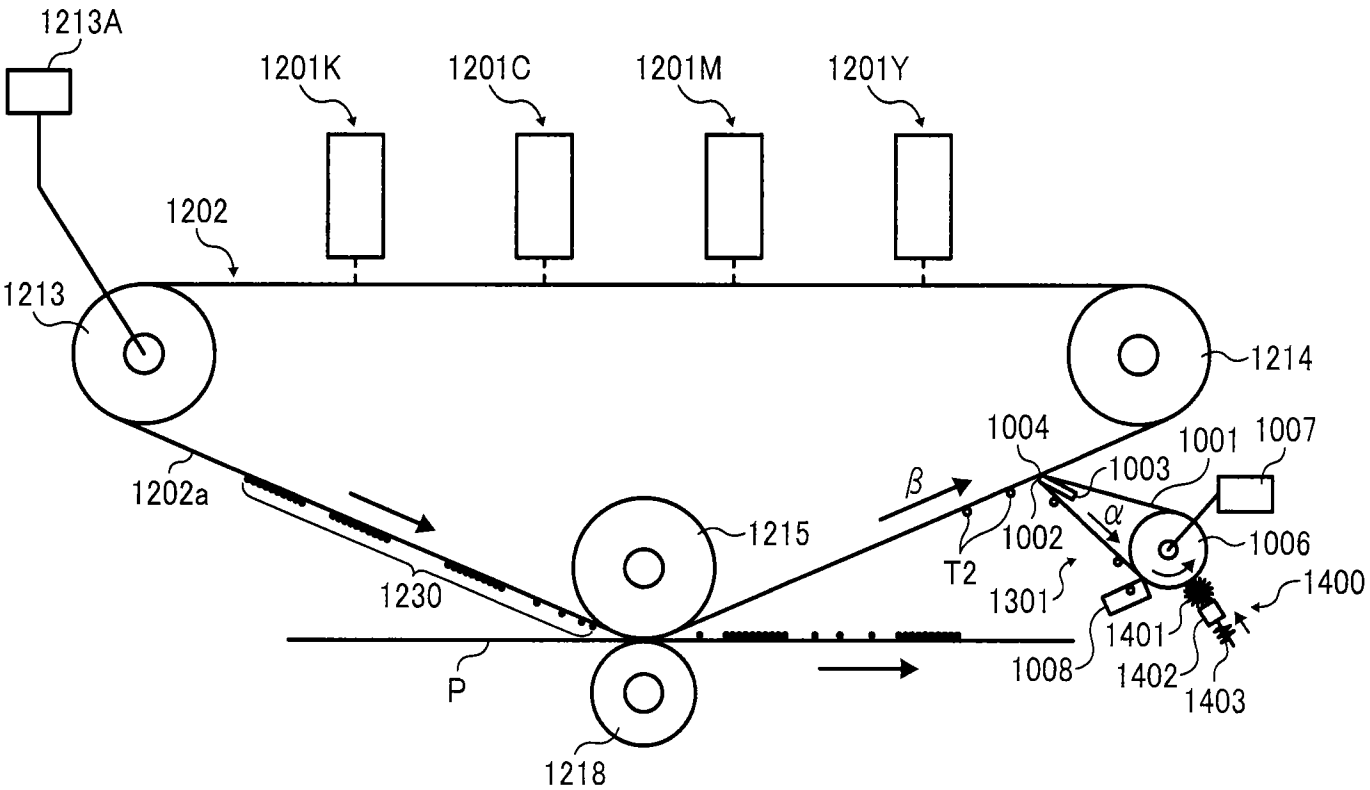
FIG. 46 is a diagram illustrating an exemplary system prepared by applying the cleaning system with the protecting device to an ink drop injecting type color image forming apparatus that employs an ink drop injecting system according to a thirty-fourth embodiment of the present invention.

Now, a thirty-fourth embodiment of the present invention is described with reference to FIG. 46. As shown in FIG. 46, this embodiment additionally includes the protecting device 1400 beside the cleaning system 1301 of the thirty-first embodiment. Accordingly, the protecting device 1400 includes a solid lubricant 1402 as a protecting member, a coating roller 1401 to coat the solid lubricant 1402 onto the collecting surface 1001*a* of the cleaning member 1001 as a coating member, and a spring 1403 to urge the solid lubricant 1402 toward the coating roller 1401 as a biasing member. In this embodiment, the collecting surface 1001*a* of the cleaning member 1001 contacts the surface 1202*a* of the transfer belt 1202 as the image bearer in the contacting section 1004.

The coating roller 1401 is placed on the downstream side of the adhering substance removing system 1008 and the upstream side of the contacting section 1004 contacting the surface 1202*a* of the transfer belt 1202 in a rotational direction in which the cleaning member 1001 circulates. The coating roller 1401 is thus configured to contact the collecting surface 1001*a* of the cleaning member 1001 either with or without pressure, and is thereby driven and rotated between the cleaning system 1100 and the primary transfer section 1106.

With such a configuration of the protecting device 1400, the lubricant 1402 pressed by spring power of the spring 1403 against the coating roller 1401 that is driven and rotated as the cleaning member 1001 moves is chipped off and coated onto the collecting surface 1001*a* of the cleaning member 1001 by the coating roller 1401. For this reason, since the cleaning member 1001 and the collecting surface 1001*a* thereof are protected, cleaning performance of cleaning the collecting surface 1001*a* of the cleaning member 1001 and the surface 1202*a* of the transfer belt 1202 can be upgraded. Further, since the protecting device 1400 coats the surface 1001*a* of the cleaning member 1001 with the lubricant 1402 after the adhering substance removing system 1008 cleans thereof, the adhering substance removing system 1008 does not scrape off the lubricant 1402 before it reaches the contacting section 1004, and accordingly, coating efficiency can be preferably maintained.

Here, as the above-described protecting member 1402, the below described material can be employed. As organic compound, fluoropolymer resin, such as polytetrafluoroethylene (PTFE), poly perfluoro alkyl ether (PFA), perfluoro ethylene-perfluoropropylene copolymers (FEP), polyvinylidene fluoride (PVdF), ethylene-tetrafluoroethylene copolymer (ETFE), fluorinated waxes, silicone resin, such as polymethyl silicone, polymethyl phenyl silicone, etc., silicone based waxes, and grease or the like are exemplified. Further, as member to be a typical fatty acid metal salt and a fatty acid from which hydrophobic metal salt is steadily extracted, caproic acid, caprylic acid, enanthylic acid, pelargonic acid, undecylic acid, lauric acid, myristic acid, palmitic acid, margarine, stearic acid, arachidic acid, behenic acid, palmitoleic acid, olay acid, ricinoleates, petroselinic acid, vaccenic acid, linoleic acid, linolenic acid, eleostearic acid, parinaric acid, gadoleic acid, arachidonic acid, whale oil acid, and these mixture or the like are exemplified. Further, as metallic salt of the above described member, stearic acid barium, lead stearate, stearic acid iron, stearic acid nickel, cobalt stearate, stearic acid copper, stearic acid strontium, calcium stearate, cadmium stearate, magnesium stearate, stearic acid zinc, oleic acid zinc, oleic acid magnesium, oleic acid iron, oleic acid cobalt, oleic acid copper, oleic acid leads, oleic acid manganese, palmitic acid zinc, palmitic acid cobalt, palmitic acid lead, palmitic acid magnesium, palmitic acid aluminum, palmitic acid calcium, caprylic acid lead, capric acid lead, linolenic acid zinc, linolenic acid cobalt, linolenic acid calcium, ricinoleic acid zinc, ricinoleic acid cadmium, and a mixture of these member or the like are exemplified. Further, as inorganic lubricant, mica, boron nitride, molybdenum disulfide, tungsten disulfide, talc, kaolin, montmorillonite, calcium fluoride, and graphite or the like are exemplified. However, the inorganic lubricant is not limited to the above-described member.

Figure 47:
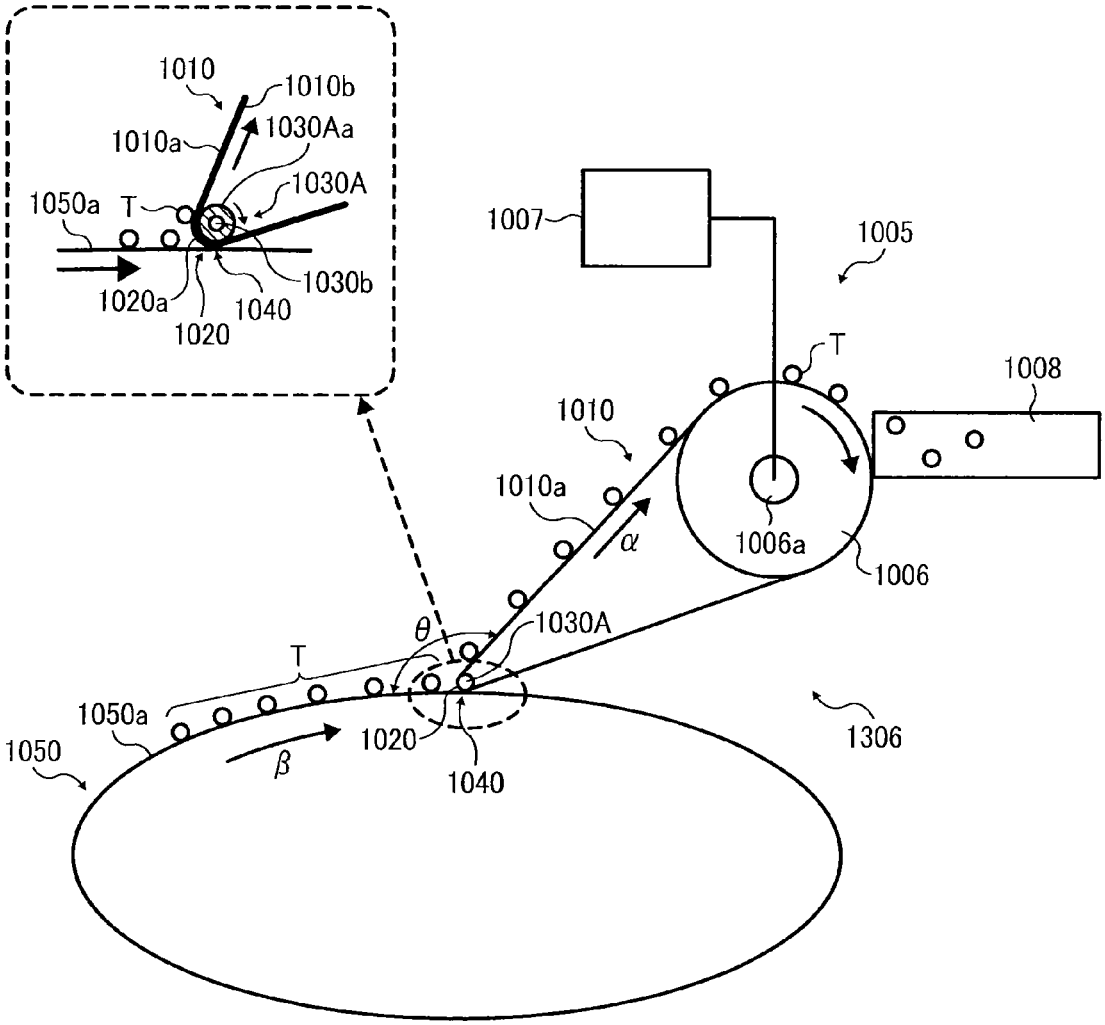
FIG. 47 is a diagram illustrating a cleaning system with a contacting member composed of a rotor.

Now, a thirty-fifth embodiment of the present invention is described with reference to FIG. 47. As shown in FIG. 47, this embodiment is a cleaning system 1306 that employs another cylindrical contacting member 1030A rotatably supported by a supporting axis 1030*b* as a rotor in place of the cylindrical contacting member 1030 as employed in the twenty-eighth embodiment. Since the rotating contacting member 1030A is a rotator like this, it is driven by the cleaning member 1010, a sliding friction caused by the cleaning member 1010 can be likely neglected. Accordingly, durability of the cleaning member 1010 can be enhanced while reducing driving force needed to drive the cleaning member 1010. Further, with the rotating contacting member 1030A acting as the rotator, transferability can be also ensured by enlarging the curvature of its outer circumferential surface. Accordingly, to enlarge the curvature of its outer circumferential surface, a diameter of the contacting member 1030A is preferably reduced.

Figure 48:
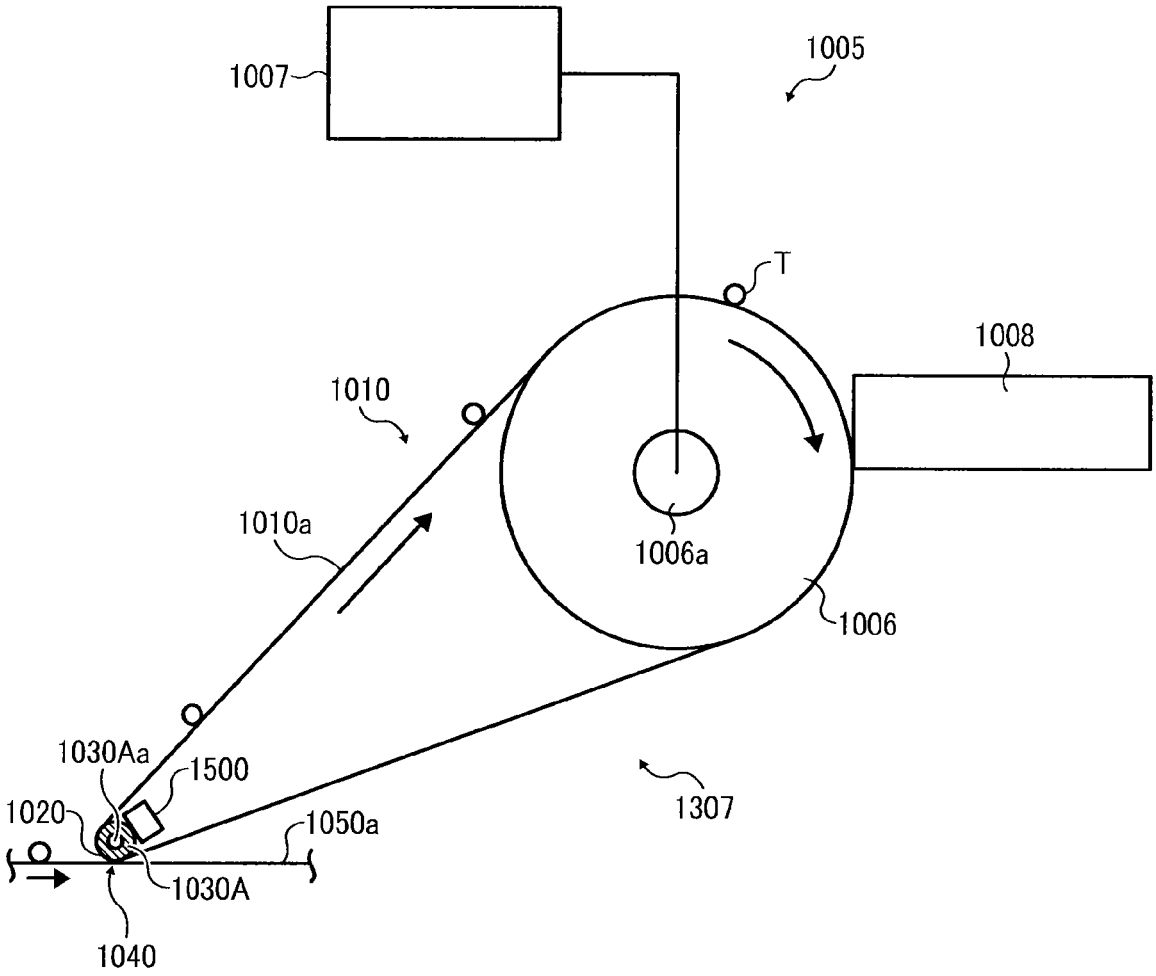
FIG. 48 is a diagram illustrating a cleaning system with a backup device according to a thirty-sixth embodiment of the present invention.

Now, a thirty-sixth embodiment of the present invention is described with reference to FIG. 48. As shown in FIG. 48, this embodiment is a cleaning system 1307 with a backup member 1500 to suppress deflection of the contacting member 1030A configured as the rotor having the small diameter as described in the thirty-fifth embodiment. As described earlier, with the rotating contacting member 1030A of the rotator having the small diameter and curvature, transferability can be enhanced. However, since the contacting member 1030A totally becomes thinner, strength of the contacting member 1030A itself decreases, and accordingly, becomes easy to deflect. For this reason, the contacting member 1030A may hardly steadily contacts the cleaning member 1010 (to keep a nip to be constant) over the throughout region in a direction of its rotational axis.

In this regard, placing the rotatable contacting member 1030A between the cleaning member 1010 and the backup member 1500, and thereby sandwiching the contacting member 1030A with both parties, a contacting condition (i.e., the constant nip) of the cleaning member 1010 is stabilized while suppressing the deflection of the contacting member 1030A. Specifically, the backup member 1500 is placed on an opposite side of the contacting section 1040 to serve as a regulatory member to regulate movement of the contacting member 1030A in a direction to separate from the cleaning member 1010. Here, the direction to separate from the cleaning member 1010 indicates a direction in which the contacting member 1030A deflects. In this way, the strength of the contacting member 1030A can be supplemented by bringing the backup member 1500 in contact with a backside of the contacting member 1030A, and accordingly, the contacting condition (i.e., the constant nip) can be stabilized while upgrading the transferability therein even if the thin contacting member 1030A is used, which generally tends to deflects from the cleaning member 1010. The backup member 1500 is attached to a base of the cleaning system 1306 to be able to continuously contact an outer circumferential surface 1030Aa of the contacting member 1030A. Otherwise, the backup member 1500 can be given biasing force by a spring or the like to be able to contact the outer circumferential surface 1030Aa of the contacting member 1030A with pressure.

Figure 49A:
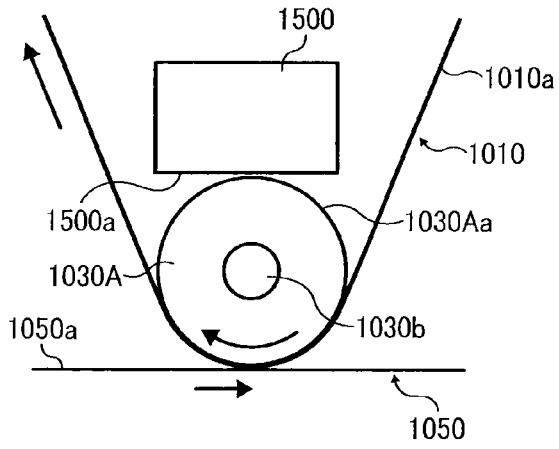
FIG. 49A is an enlarged view illustrating a contacting condition of a backup member having a flat contact surface and the contacting member according to one embodiment of the present invention.

Here, as shown in FIG. 49A, the backup member 1500 is shaped like a rectangular parallelepiped or a cubic block so that at least a contacting surface 1500*a* of the backup member 1500 contacting the outer circumferential surface 1030Aa of the contacting member 1030A is flat. Hence, with the flat contacting surface 1500*a* of the backup member 1500, which contacts the outer circumferential surface 1030Aa of the contacting member 1030A, a contacting condition becomes upgraded while more preferably suppressing the deflection of the contacting member 1030A.

Figure 49B:
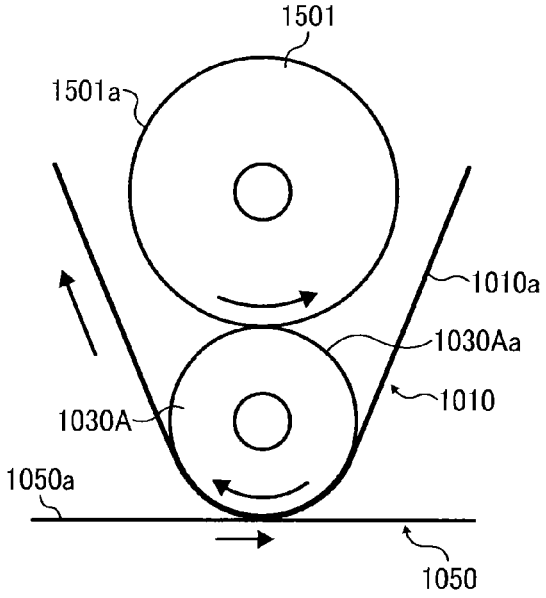
FIG. 49B is an enlarged view illustrating a contacting condition of a backup member composed of the rotor and the contacting member according to one embodiment of the present invention.

Further, as shown in FIG. 49B, the backup member can be a rotor 1501 with its surface 1501*a* contacting the outer circumferential surface 1030Aa of the contacting member 1030A as well. With such a backup member of the rotor 1501, since the backup member is driven and rotated as the contacting member 1030A moves, sliding friction caused by the contacting member 1030A can be likely prevented while minimizing abrasion of the contacting member 1030A as an advantage.

Figure 49C:
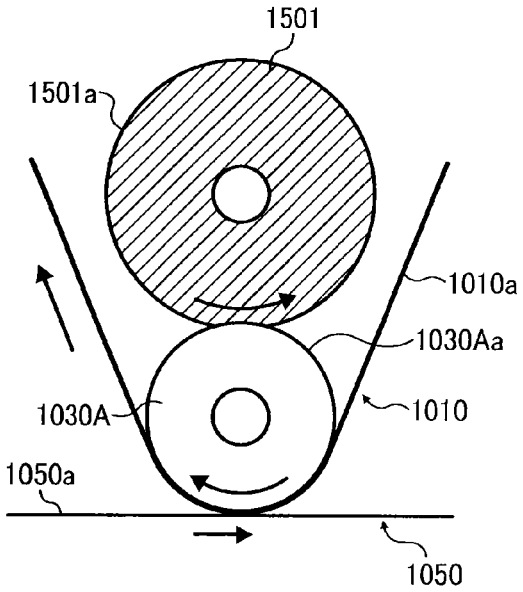
FIG. 49C is an enlarged view illustrating a contacting condition of a deformable backup member and the contacting member according to one embodiment of the present invention.

Further, when the backup member is configured by the rotor 1501 in this way, it can be composed of an elastic member such as an elastic roller, etc., as shown in FIG. 49C. In such a situation, vibration of the rotor 1501 of the backup member and the contacting member 1030A can be absorbed minimizing a vibration problem.

Figure 50A:
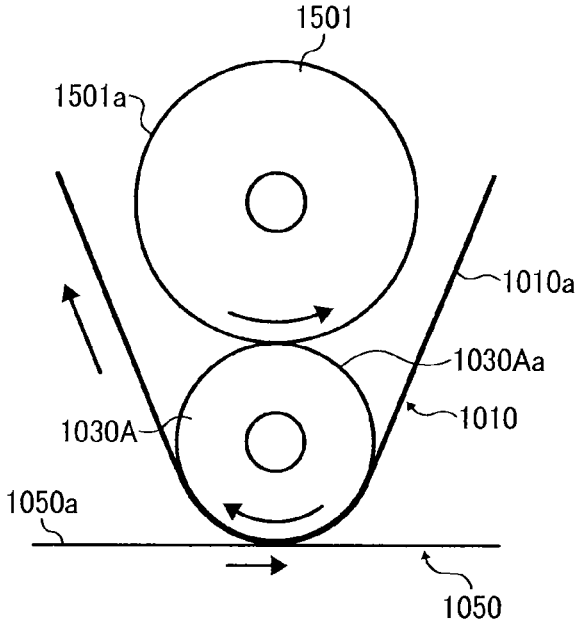
FIG. 50A is an enlarged view illustrating a contacting condition of a backup member composed of the rotor and the contacting member when the backup member is driven and rotated by the contacting member according to one embodiment of the present invention.
Figure 50B:
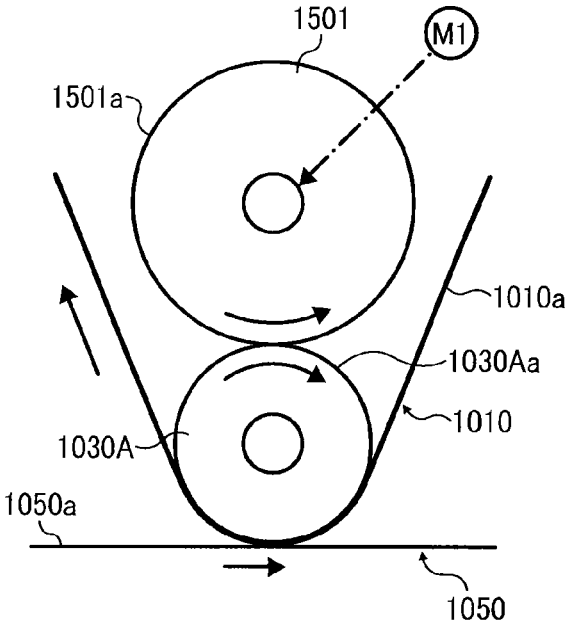
FIG. 50B is an enlarged view illustrating a contacting condition of a backup member composed of the rotor and the contacting member when the backup member is driven and rotated by a motor.

Further, as shown in FIG. 50A, when the rotor 1501 contacts the contacting member 1030A while separating from the cleaning member 1010, the rotor 1501 is together rotated by the contacting member 1030A driven and rotated by the cleaning member 1010. Because of this, fewer loads are posed on rotation and movement of the contacting member 1030A and the cleaning member 1010, respectively, and accordingly, sliding friction caused thereon can be minimized even with a simple structure, so that the contacting member 1030A can more effectively prevent its abrasion. Further, with the configuration of FIG. 50A, because the rotor 1501 is rotated by friction force generated by the contacting member 1030A, it acts as a burden to rotation of the contacting member 1030A and eventually movement of the cleaning member 1010 and driving system of the cleaning member 1010. Because of this, as shown in FIG. 50B, the rotor 1501 may be driven and rotated by a driving motor M1 in the same direction as the contacting member 1030A at the opposed position thereto with a line velocity of the outer circumferential surface 1501*a* being substantially the same as a line velocity of the outer circumferential surface 1030Aa of contacting member 1030A. Hence, by rendering the rotor 1501 functioning as a backup roller to be driven and rotated like this, the burden to rotation and movement of the contacting member 1030A and the cleaning member 1010, respectively, is reduced, and reduction of the sliding friction is ensured as well. As a result, the abrasion of the contacting member 1030A can be more likely effectively prevented.

Figure 50C:
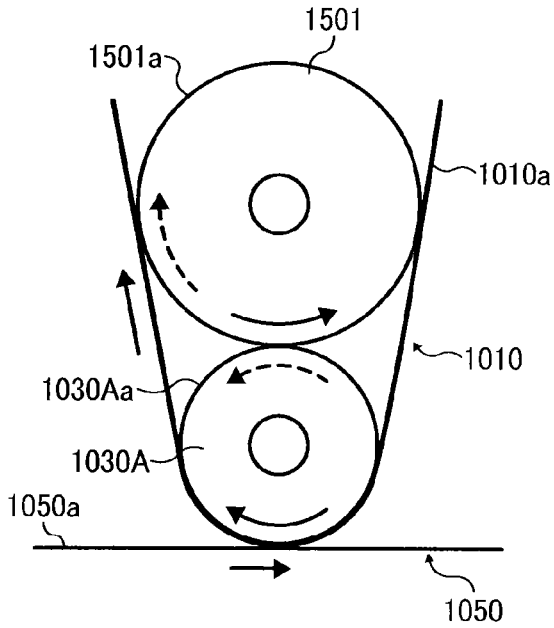
FIG. 50C is an enlarged view illustrating a contacting condition when the rotary backup member is rotated by a cleaning member according to one embodiment of the present invention.

Otherwise, as shown in FIG. 50C, the rotor 1501 is not driven by the driving motor M1, and is instead driven by the cleaning member 1010. Specifically, the cleaning member 1010 is brought in contact with the surface 1501*a* of the rotor 1501 to transmit its driving force to the rotor 1501. In such a situation, rotational directions of the rotor 1501 and the contacting member 1030A are determined by a largeness of friction forces caused between the rotor 1501 and the contacting member 1030A and that caused between the contacting member 1030A and the cleaning member 1010. Because of this, there exist two rotational directions for the contacting member 1030A and the rotor 1501. That is, both parties are driven and rotated by the cleaning member 1010 in directions as shown by solid line arrows, and neither of parties is driven nor rotated by the cleaning member 1010. Specifically, each of these parties reversely rotates to the cleaning member 1010 in directions as shown by dashed line arrows in the drawing. However, because the rotor 1501 can obtain driving power without relying on the driving motor M1, it can help to simplify a configuration of the system. Further, since a cleaning member 1010 is arranged contacting the rotor 1501, an installation area of the cleaning member 1010 can be narrower while downsizing the system in comparison with a system in which the cleaning member 1010 does not contact the rotor 1501.

Figure 51A:
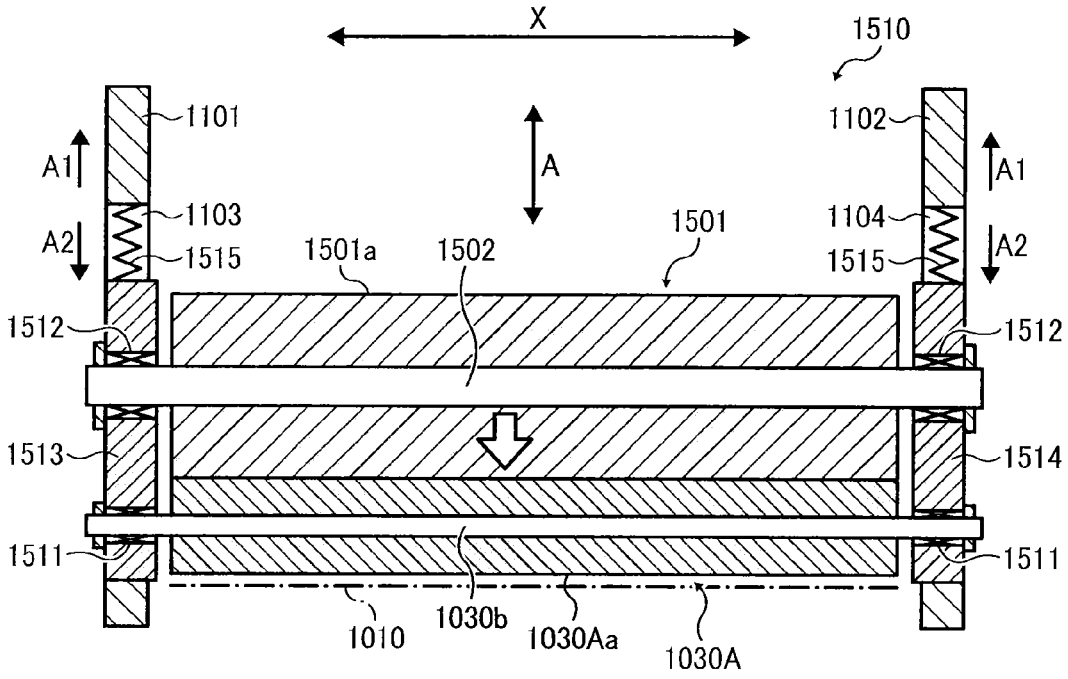
FIG. 51A is a front view illustrating an exemplary supporting mechanism that supports the contacting member and the backup member according to one embodiment of the present invention.
Figure 51B:
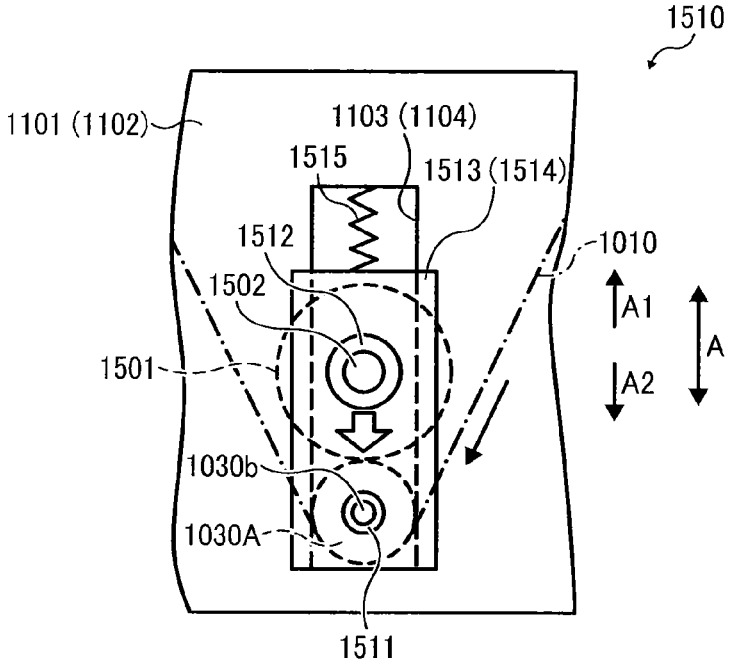
FIG. 51B is a cross-sectional view illustrating the exemplary supporting mechanism that supports the contacting member and the backup member according to one embodiment of the present invention.

Now, a supporting structure 1510 that supports the contacting member 1030A composed of a rotor and the rotor 1501 as the rotatable backup member is described with reference to FIGS. 51A and 51B. The supporting structure 1510 shown in FIGS. 51A and 51B brings the rotor 1501 and the contacting member 1030A in pressure contact with each other and maintains a distance between axes of both parties to be constant while enabling these parties to integrally move in approaching and separating directions to and from the cleaning member 1010. Here, it is supposed that one of the approaching and separating directions A indicates a deflecting direction A1 in which the contacting member 1030A deflects, and an opposite direction thereto indicates a biasing direction A2 in which it is biased toward the cleaning member 1010. The supporting structure 1510 includes a pair of fixed plates 1513 and 1514 to freely rotatably support both ends of support axes 1030Aa and 1502 of the contacting member 1030A and the rotor 1501 via two pairs of bearings 1511, 1511, 1512, and 1512, respectively. The pair of fixed plates 1513 and 1514 is opposed to each other and freely rotatably support both of the support axes 1030Aa and 1502 in parallel to its axial direction with each other. The pair of fixed plates 1513 and 1514 is movably attached in the approaching and separating directions A and is held within rectangular oblong holes 1103 and 1104 formed in a pair of side plates 1101 and 1102 serving as fixing sections fixed to the cleaning system, respectively. The supporting structure 1510 includes a pair coil spring 1515 and 1515 as biasing members to bias the fixed plates 1513 and 1514 in the biasing direction A2, respectively. The pair of coil springs 1515 and 1515 is interposed between the pair of rectangular oblong holes 1103 and 1104 in the side plates 1101 and 1102 and the fixed plates 1513 and 1514, respectively.

With the supporting structure 1510 having the configuration like this, since the outer circumferential surface 1501*a* of the rotor 1501 can be kept in pressure contact with the outer circumferential surface 1030Aa of the contacting member 1030A, deflection of the contacting member 1030A can be likely prevented by bringing the backup member 1501 in contact with a backside of the contacting member 1030A, even if the diameter of the contacting member 1030A is reduced and accordingly stiffness thereof decreases.

Figure 52A:
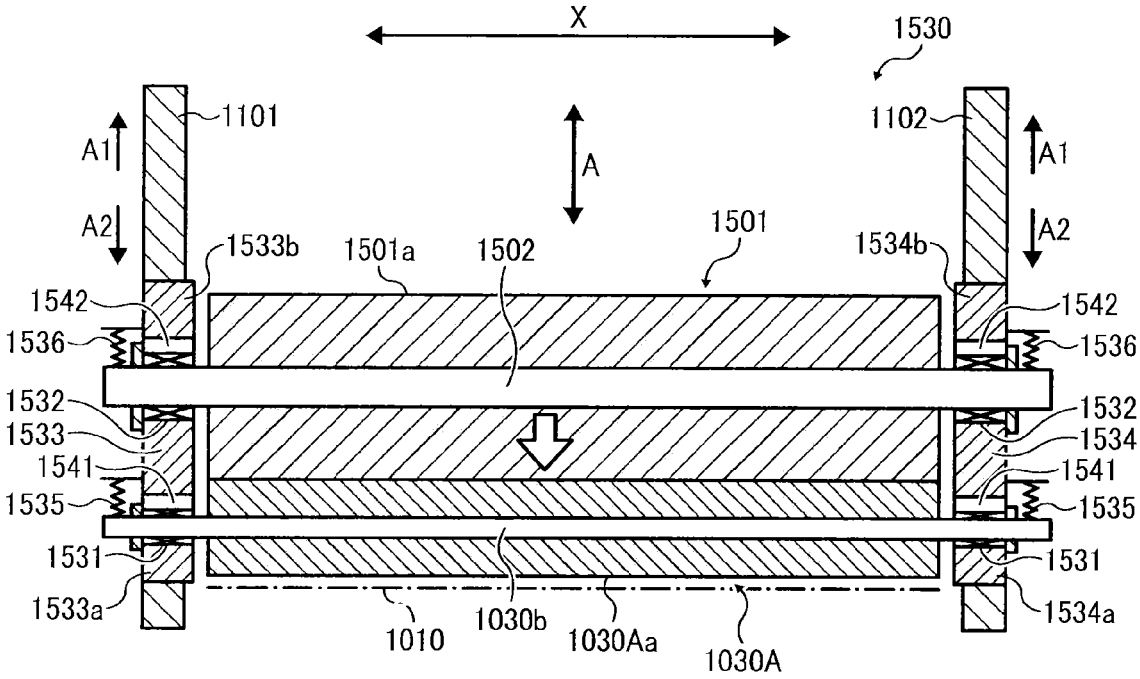
FIG. 52A is a front view illustrating another exemplary supporting mechanism that supports the contacting member and the backup member according to one embodiment of the present invention.
Figure 52B:
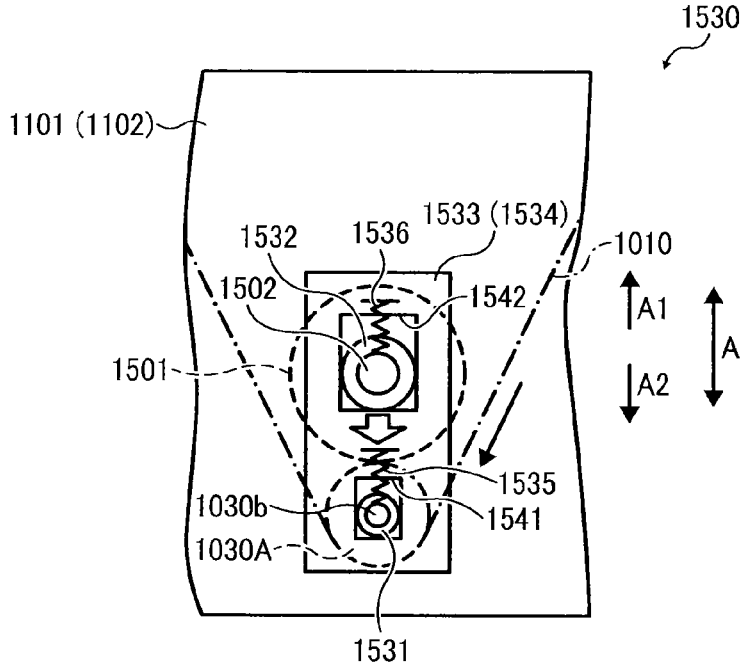
FIG. 52B is a cross-sectional view illustrating another exemplary supporting mechanism that supports the contacting member and the backup member according to one embodiment of the present invention.

Further, another supporting structure 1530 is described with reference to FIGS. 52A and 52B. As shown there, the supporting structure 1530 is configured such that the contacting member 1030A is brought in pressure contact with the rotor 1501. A distance between shafts of the contacting member 1030A and the rotor 1501 is variable so that both parties can separately movable in an approaching and separating direction A to and from the cleaning member 1010. The supporting structure 1530 includes a pair of fixed plates 1513 and 1534 to freely rotatably support both ends of support axes 1030Aa and 1502 of the contacting member 1030A and the rotor 1501 via two pairs of bearings 1531, 1531, 1532, and 1532, respectively. The pair of fixed plates 1533 and 1534 is opposed to each other and freely rotatably support both of the support axes 1030Aa and 1502 in parallel to an axial direction with each other. The pair of fixed plates 1533 and 1534 is held by a pair of side plates 1101 and 1102 serving as fixing sections fixed to the cleaning system, respectively. Two pairs of rectangular oblong holes 1541, 1541, 1542, and 1542 are formed in the fixed plates 1533 and 1534 each extending in the approaching and separating directions A. The pair of rectangular oblong holes 1541 and 1541 are formed at both ends 1533*a* and 1534*a* of the respective fixed plates 1533 and 1534 in the biasing direction A2 being opposed to each other. Into the rectangular oblong holes 1541 and 1541, a pair of bearings 1531 and 1531 freely rotatably supporting the bearing shaft 1030*b* is movably inserted and is thereby supported in the approaching and separating directions A, respectively. Whereas, the pair of rectangular oblong holes 1542 and 1542 is formed at both ends 1533*b* and 1534*b*, respectively, in the deflecting direction A1 distanced from the pair of rectangular oblong holes 1541 and 1541 formed in the respective fixed plates 1533 and 1534, being opposed to each other. Into the rectangular oblong holes 1542 and 1542, a pair of bearings 1532 and 1532 freely rotatably supporting the bearing shaft 1502 is movably inserted and is thereby supported in the approaching and separating directions A, respectively.

Further, the supporting structure 1510 includes two pairs of coil springs 1535, 1535, 1536, and 1536 as urging members with the each pair biasing the support axes 1030*b* and 1502 in the approaching and separating directions A, respectively. Respective ends of the pair of coil springs 1535 and 1535 are fixed to the fixed plates 1533 and 1534 to bias both ends of the supporting shaft 1030*b* in the biasing direction A2. Similarly, respective ends of the pair of coil springs 1535 and 1536 are fixed to the fixed plates 1533 and 1534 to bias both ends of the supporting shaft 1502 in the biasing direction A2.

Hence, with the supporting structure 1530 having the configuration like this, since the outer circumferential surface 1501*a* of the rotor 1501 can be kept in pressure contact with the outer circumferential surface 1030Aa of the contacting member 1030A, deflection of the contacting member 1030A can be likely prevented by bringing the rotor 1501 as the backup member in contact with a backside of the contacting member 1030A even if the diameter of the contacting member 1030A is reduced and accordingly stiffness thereof decreases. Hence, the above-described supporting mechanisms 1510 and 1530 support the rotor 1501 and the cylindrical contacting member 1030A. However, instead of the rotor 1501, a block shaped backup member 1500 can be supported together with the contacting member 1030A as well.

Hence, the present invention at least includes the below described various aspects. Specifically, according to one aspect, a method of transferring an image comprises the steps of bringing an image bearer bearing an image thereon as a transfer origin in contact with a transferring objective (onto which the image is transferred) as a transfer destination; moving at least one of the image bearer and the transferring objective in a prescribed direction; and sequentially transferring the image borne on the image bearer onto the transferring objective in a contacting section in which the image bearer and the transferring objective contact each other in a direction in which the image does not pass through the contacting section.

In another aspect, the method further comprises the step of rendering the image bearer and the transferring objective to move in an opposite direction to each other in the contacting section before the step of sequentially transferring the image borne on the image bearer onto the transferring objective.

In yet another aspect, the method further comprises the step of relatively creating a difference in line velocity between the image bearer and the transferring objective before the step of sequentially transferring the image borne on the image bearer onto the transferring objective.

In yet another aspect, the step of relatively creating a difference in line velocity between the image bearer and the transferring objective includes the sub step of establishing a relation of the line velocity between the image bearer and the transferring objective to meet the following inequality when the line velocity of the transferring objective is represented by $\alpha$ and that of the image bearer is represented by $\beta$: $\alpha>\beta$.

In yet another aspect, the step of relatively creating a difference in line velocity between the image bearer and the transferring objective includes the sub step of establishing a relation of a line velocity between the image bearer and the transferring objective to meet the following inequality when the line velocity of the transferring objective is represented by $\alpha$ and that of the image bearer is represented by $\beta$: $\alpha<\beta$.

In yet another aspect, the step of bringing an image bearer bearing an image thereon in contact with a transferring objective includes the sub step of: either pressing a contacting member against the transferring objective via the image bearer, or pressing the contacting member against the image bearer via the transferring objective.

In yet another aspect, the step of rendering the image bearer and the transferring objective to move in an opposite direction to each other in the contacting section includes the sub steps of: either pressing a contacting member against the transferring objective via the image bearer, or pressing the contacting member against the image bearer via the transferring objective; and moving the contacting member in a prescribed direction.

In yet another aspect, the step of rendering the image bearer and the transferring objective to move in an opposite direction to each other in the contacting section includes the sub steps of: either pressing a contacting member against the transferring objective via the image bearer, or pressing the contacting member against the image bearer via the transferring objective; and moving the contacting member while relatively creating a difference in line velocity between the image bearer and the transferring objective.

In yet another aspect, an image transferring system comprises: an image bearer to bear an image thereon as a transfer origin; and a transferring objective in contact with the image bearer as a transfer destination. The image on the image bearer is transferred onto the transferring objective by implementing the above-described method.

In yet another aspect, an image forming apparatus comprises: an image forming device to form an image on an image bearer as a transfer origin; and the above-described image transferring system.

In yet another aspect, an image forming apparatus comprises: an image bearer to bear an image thereon; a transferring objective having a surface contacting a surface of the image bearer in a contacting section therebetween; and a power source to drive one of the image bearer and the transferring objective and render the surface of the image bearer to sequentially enter the contacting section from a first side, and render the surface of the transferring objective to sequentially exit from the contacting section toward the first side.

In yet another aspect, the image is a toner image formed by using toner particles having a grain size of about 8 μm (micrometer) or less, and an averaged surface roughness Ra of the image bearer is about 14 μm (micrometer) or less.

In yet another aspect, the grain size of the toner particle is about 6 μm (micrometer) or less, and the averaged surface roughness Ra of the image bearer is about 10 μm (micrometer) or less.

In yet another aspect, the image is formed by using ink drops, and an averaged surface roughness Ra of the image bearer is about 10 μm (micrometer) or less.

In yet another aspect, a line velocity of the transferring objective is 200 mm/sec or less, and an averaged surface roughness Ra of the image bearer is about 40 μm (micrometer) or less.

In yet another aspect, a line velocity of the transferring objective ranges between 200 mm/sec or more and 400 mm/sec or less, and an averaged surface roughness Ra of the image bearer is about 30 μm (micrometer) or less.

In yet another aspect, a line velocity of the transferring objective is 400 mm/sec or more, and an averaged surface roughness Ra of the image bearer is about 20 μm (micrometer) or less.

In yet another aspect, the image forming apparatus further comprises a contacting member to contact a backside of the image bearer in the contacting section while employing a belt type image bearer.

In yet another aspect, the image forming apparatus further comprises a contacting member to contact a backside of the transferring objective in the contacting section while employing a belt type transferring objective.

In yet another aspect, the contacting member is a rotor.

In yet another aspect, the image forming apparatus further comprises a backup member to suppress deflection of the contacting member.

In yet another aspect, the backup member includes a flat contact surface contacting an outer circumferential surface of the contacting member.

In yet another aspect, the backup member is a rotor with its surface contacting an outer circumferential surface of the contacting member.

In yet another aspect, the rotor is composed of an elastic member.

In yet another aspect, an image forming apparatus comprises: a first image bearer to bear a toner image thereon; a second image bearer contacting the first image bearer in a contacting section; a first motor to rotate the first image bearer in a first rotational direction; and a second motor to rotate the second image bearer in the first rotational direction.

In yet another aspect, a toner image on the first image bearer is transferred onto the second image bearer.

In yet another aspect, the toner image on the first image bearer is transferred onto the second image bearer before entering the contacting section. In yet another aspect, the image forming apparatus further comprises a transfer roller contacting the second image bearer via a recording sheet.

In yet another aspect, the image forming apparatus further comprises a fixing device to fix the toner image onto the recording sheet.

In yet another aspect, an image forming apparatus comprises: an image bearer to bear a toner image thereon; a sheet conveying roller to convey the recording sheet by bringing it in contact with the image bearer in a contacting section; a first motor to drive and move the image bearer in a first direction in the contacting section; and a second motor to drive the conveying roller to convey the recording sheet in a second direction opposite the first direction in the contacting section.

In yet another aspect, the toner image on the image bearer is transferred onto the recording sheet by driving the image bearer and the conveying roller.

In yet another aspect, the toner image on the image bearer is transferred onto the recording sheet before entering the contacting section.

In yet another aspect, an image forming apparatus comprises: a first image bearer to bear a toner image on its surface; a second image bearer having a surface contacting the surface of the first image bearer in a contacting section; a driving source to move the surface of the first image bearer in the first direction in the contacting section, and to move the surface of the second image bearer in a second direction opposite the first direction in the contacting section.

In yet another aspect, the toner image on the first image bearer is transferred onto the second image bearer by moving the surface of the first image bearer in the first direction while moving the surface of the second image bearer in a second direction opposite the first direction in the contacting section.

In yet another aspect, an image forming apparatus comprises: an image bearer to bear a toner image on its surface and contact a recording sheet in a contacting section; and a driving source to move the surface of the image bearer in a first direction in the contacting section, and move a surface of the recording sheet in a second direction opposite the first direction in the contacting section.

In yet another aspect, the toner image on the image bearer is transferred onto the recording sheet by moving the surface of the image bearer in a first direction in the contacting section while moving the surface of the recording sheet in a second direction opposite the first direction in the contacting section.

In yet another aspect, a cleaning system comprises: a cleaning member having a surface brought in contact with a movable surface of an image bearer to clean the image bearer by collecting adhering substances adhering and remaining on the movable surface of the image bearer, the cleaning member including an edge or a small diameter portion in a contacting section contacting the surface of the image bearer; and a moving system to move a surface of the cleaning member in a direction in which the adhering substances on the surface of the image bearer do not pass through the contacting section.

In yet another aspect, the cleaning system further comprises a contacting member contacting a backside of the cleaning member to form the edge or the small diameter portion of the cleaning member.

In yet another aspect, the contacting member is a plate like member, and the edge portion of the cleaning member is formed by pressing a tip of the plate like member against the image bearer through the cleaning member from behind thereof.

In yet another aspect, the contacting member includes a cylindrical surface at its tip, and the edge portion of the cleaning member is formed by pressing the cylindrical surface of the contacting member against the image bearer through the cleaning member from behind thereof.

In yet another aspect, the contacting member is a cylindrical member, and the edge portion of the cleaning member is formed by pressing the cylindrical member against the image bearer through the cleaning member from behind thereof.

In yet another aspect, the cylindrical surface includes a radius of curvature of 4 mm or less.

In yet another aspect, the cylindrical member includes a radius of curvature of 2 mm or more.

In yet another aspect, the moving system rotates and moves the cleaning member to render the respective surfaces of the cleaning member and the image bearer move and rotate in an opposite direction to each other at least in the contacting section.

In yet another aspect, the moving system rotates and moves the cleaning member to create a difference in relative velocity between the respective surfaces of the cleaning member and the image bearer.

In yet another aspect, the moving system rotates and moves the cleaning member to establish a relation of a line velocity between the cleaning member and the image bearer to meet the following inequality when the line velocity of the cleaning member is represented by $\alpha$ and that of the image bearer is represented by $\beta$: $\alpha>\beta$.

In yet another aspect, the moving system rotates and moves the cleaning member to establish a relation of a line velocity between the cleaning member and the image bearer to meet the following inequality when the line velocity of the cleaning member is represented by $\alpha$ and that of the image bearer is represented by $\beta$: $\alpha<\beta$.

In yet another aspect, the cleaning system further comprises an adhering substance removing system to remove adhering substances adhering onto the surface of the cleaning member therefrom. The adhering substance removing system contacts the surface of the cleaning member downstream of the contacting section in a moving direction of the cleaning member.

In yet another aspect, the image is a toner image formed by using toner particles having a grain size of the toner particle is about 8 μm (micrometer) or less, and wherein an averaged surface roughness Ra of the image bearer is about 14 μm (micrometer) or less.

In yet another aspect, the grain size of the toner particle is about 6 μm (micrometer) or less, and the averaged surface roughness Ra of the image bearer is about 10 μm (micrometer) or less. In yet another aspect, the adhering substances are ink drops, and an averaged surface roughness Ra of the image bearer is about 10 μm (micrometer) or less.

In yet another aspect, a line velocity of the cleaning member is 200 mm/sec or less, and an averaged surface roughness Ra of the image bearer is about 40 μm (micrometer) or less. In yet another aspect, a line velocity of the cleaning member ranges between 200 mm/sec or more and 400 mm/sec or less, and an averaged surface roughness Ra of the image bearer is about 30 μm (micrometer) or less.

In yet another aspect, a line velocity of the cleaning member is 400 mm/sec or more, and an averaged surface roughness Ra of the image bearer is about 20 μm (micrometer) or less. In yet another aspect, the contacting member is a rotor.

In yet another aspect, the cleaning system further comprises a backup member to reinforce the contacting member and suppress deflection of the contacting member.

In yet another aspect, the backup member includes a flat contact surface contacting an outer circumferential surface of the contacting member.

In yet another aspect, the backup member is a rotor with its surface contacting an outer circumferential surface of the contacting member.

In yet another aspect, the rotor is composed of an elastic member.

In yet another aspect, an image forming apparatus includes the above-described cleaning system.

In yet another aspect, the image forming apparatus further comprises: an image bearer to bear a toner image thereon; a cleaning member having an edge portion or a small diameter section, the cleaning member contacting the image bearer at the edge portion or the small diameter section; a first motor to rotate the image bearer in a first rotational direction; and a second motor to rotate a second image bearer (the cleaning member) in the first rotational direction.

In yet another aspect, toner borne on the image bearer is transferred onto the cleaning member before entering either the edge portion or the small diameter section.

In yet another aspect, an image forming apparatus comprising: an image bearer to bear a toner image on its surface; a cleaning member having an edge portion or a small diameter section, the cleaning member contacting the image bearer at the edge portion or the small diameter section; and a driving source to move the surface of the image bearer in the first direction in a contacting section contacting the edge portion or the small diameter section of the cleaning member, and move the surface of a second image bearer (the cleaning member) in a second direction opposite the first direction in the edge portion or the small diameter section thereof.

In yet another aspect, toner borne on the image bearer is transferred onto the cleaning member before entering either edge portion or the small diameter section.

In yet another aspect, an averaged surface roughness Ra of the cleaning member is about 40 μm (micrometer) or less.

In yet another aspect, an averaged surface roughness Ra of the cleaning member is about 14 μm (micrometer) or less. In yet another aspect, an averaged surface roughness Ra of the cleaning member is about 10 μm (micrometer) or less.

According to one embodiment of the present invention, an excellent transferring process can be obtained without impacts of an electric transfer field and an environment condition. According to another embodiment of the present invention, since adhering substances on a surface of an image bearer does not pass through a contact area formed between a cleaning member and the surface of the image bearer, the adhering substances are transferred onto a surface of the cleaning member at an edge or a small diameter section of the cleaning member. Thus, the adhering substances borne on the surface of an image bearer can be effectively collected, so that an excellent cleaning performance can be obtained.

Numerous additional modifications and variations of the present invention are possible in light of the above teachings. It is therefore to be understood that within the scope of the appended claims, the present invention may be executed otherwise than as specifically described herein. For example, the order of steps for forming the image forming apparatus is not limited to the above-described various embodiments and can be precisely changed.

What is claimed is:

1. A method of transferring an image, comprising the steps of:

bringing an image bearer bearing an image thereon as a transfer origin in contact with a transferring objective onto which the image is transferred as a transfer destination;

moving at least one of the image bearer and the transferring objective in a prescribed direction; and reproducing the image on the transferring objective by sequentially transferring the image borne on the image bearer onto the transferring objective in a contacting section in which the image bearer and the transferring objective contact each other in a direction in which the image does not pass through the contacting section.

2. The method as claimed in claim 1, further comprising the step of moving the at least one of the image bearer and the transferring objective in an opposite direction to each other in the contacting section before the step of sequentially transferring the image borne on the image bearer onto the transferring objective.

3. The method as claimed in claim 1, further comprising the step of relatively creating a difference in line velocity between the image bearer and the transferring objective before the step of sequentially transferring the image borne on the image bearer onto the transferring objective.

4. The method as claimed in claim 3, wherein the step of relatively creating a difference in line velocity between the image bearer and the transferring objective includes the sub step of establishing a relation of a line velocity between the image bearer and the transferring objective to meet the following inequality when the line velocity of the transferring objective is represented by a and that of the image bearer is represented by β: $\alpha>\beta$.

5. The method as claimed in claim 3, wherein the step of relatively creating a difference in line velocity between the image bearer and the transferring objective includes the sub step of establishing a relation of a line velocity between the image bearer and the transferring objective to meet the following inequality when the line velocity of the transferring objective is represented by a and that of the image bearer is represented by β: $\alpha<\beta$.

6. The method as claimed in claim 1, wherein the step of bringing an image bearer bearing an image thereon in contact with a transferring objective includes the sub step of either pressing a contacting member against the transferring objective via the image bearer, or pressing the contacting member against the image bearer via the transferring objective.

7. The method as claimed in claim 2, wherein the step of rendering the image bearer and the transferring objective to move in an opposite direction to each other in the contacting section includes the sub steps of:

either pressing a contacting member against the transferring objective via the image bearer, or pressing the contacting member against the image bearer via the transferring objective; and moving the contacting member in a prescribed direction.

8. The method as claimed in claim 2, wherein the step of rendering the image bearer and the transferring objective to move in an opposite direction to each other in the contacting section includes the sub steps of:

either pressing a contacting member against the transferring objective via the image bearer, or pressing the contacting member against the image bearer via the transferring objective; and moving the contacting member while relatively creating a difference in line velocity between the image bearer and the transferring objective.

9. An image transferring system, comprising:

an image bearer to bear an image thereon as a transfer origin; and a transferring objective in contact with the image bearer as a transfer destination, wherein the image on the image bearer is transferred onto the transferring objective by implementing the method as claimed in claim 1.

10. An image forming apparatus comprising: an image forming device to form an image on an image bearer as a transfer origin; and the image transferring system as claimed in claim 9.

11. An image transferring system comprising:

means for bringing an image bearer bearing an image thereon as a transfer origin in contact with a transferring objective onto which the image is transferred as a transfer destination; and means for moving at least one of the image bearer and the transferring objective in a prescribed direction and reproducing the image on the transferring objective by sequentially transferring the image borne on the image bearer onto the transferring objective in a contacting section in which the image bearer and the transferring objective contact each other in a direction in which the image does not pass through the contacting section.

12. An image transferring system comprising: an image bearer bearing an image thereon as a transfer origin; and a transferring objective that contacts the image bearer, the image being transferred from the image bearer to the transferring objective as a transfer destination, wherein at least one of the image bearer and the transferring objective are moved in a prescribed direction and the image is reproduced on the transferring objective by sequentially transferring the image borne on the image bearer onto the transferring objective in a contacting section in which the image bearer and the transferring objective contact each other in a direction in which the image does not pass through the contacting section.

* * * * *